US010134237B2

(12) United States Patent
Fujisawa et al.

(10) Patent No.: US 10,134,237 B2
(45) Date of Patent: Nov. 20, 2018

(54) RANDOM DETERMINATION FOR SWITCHING TO A CHANCE MODE USING A CHANCE MODE VIDEO REEL

(71) Applicants: Universal Entertainment Corporation, Tokyo (JP); Aruze Gaming (Hong Kong) Limited, Kowloon (HK)

(72) Inventors: Masumi Fujisawa, Tokyo (JP); Yukinori Inamura, Tokyo (JP); Yoichi Kato, Tokyo (JP); Hiromoto Yamauchi, Tokyo (JP); Yukihiro Kawakami, Tokyo (JP); Masahiro Yoshida, Tokyo (JP)

(73) Assignees: UNIVERSAL ENTERTAINMENT CORPORATION, Tokyo (JP); ARUZE GAMING (HONG KONG) LIMITED, Kowloon (HK)

( * ) Notice: Subject to any disclaimer, the term of this patent is extended or adjusted under 35 U.S.C. 154(b) by 55 days.

(21) Appl. No.: 15/274,791

(22) Filed: Sep. 23, 2016

(65) Prior Publication Data

US 2017/0092048 A1 Mar. 30, 2017

(30) Foreign Application Priority Data

Sep. 25, 2015 (JP) ..... 2015-188996

(51) Int. Cl.
*G07F 17/32* (2006.01)
*G07F 17/34* (2006.01)

(52) U.S. Cl.
CPC ..... *G07F 17/3267* (2013.01); *G07F 17/3209* (2013.01); *G07F 17/3211* (2013.01); *G07F 17/3213* (2013.01); *G07F 17/3246* (2013.01); *G07F 17/34* (2013.01)

(58) Field of Classification Search
CPC ..... G07F 17/3267; G07F 17/34
See application file for complete search history.

(56) References Cited

U.S. PATENT DOCUMENTS 9,177,448 B2 * 11/2015 Caputo ..... G07F 17/34
9,196,124 B2 * 11/2015 Vermaak ..... G07F 17/3265
9,536,376 B2 * 1/2017 Caputo ..... G07F 17/34
2011/0028202 A1 * 2/2011 Naicker ..... G07F 17/3244 463/20
2013/0184046 A1 * 7/2013 Vermaak ..... G07F 17/3265 463/20
2014/0256402 A1 * 9/2014 Caputo ..... G07F 17/34 463/20

(Continued)

*Primary Examiner* — David Duffy
(74) *Attorney, Agent, or Firm* — Lex IP Meister, PLLC

(57) ABSTRACT

A gaming machine which makes it possible to improve monotonous game play is provided. A gaming machine includes: a display device configured to display a game result by rearranging symbols arranged on video reels; a storage device configured to store a normal mode video reel on which the symbols including a predetermined symbol are arranged and a chance mode video reel on which the number of the predetermined symbol is larger than the number of the predetermined symbol on the normal mode video reel; and a controller configured to perform switching between a game in a normal mode using the normal mode video reel and a game in a chance mode using the chance mode video reel, when a predetermined condition is satisfied.

4 Claims, 78 Drawing Sheets

(56) References Cited

U.S. PATENT DOCUMENTS

| | | | | |
|---|---|---|---|---|
| 2015/0348374 | A1* | 12/2015 | Dupuis | G07F 17/34 463/20 |
| 2016/0035181 | A1* | 2/2016 | Caputo | G07F 17/34 463/21 |
| 2016/0078711 | A1* | 3/2016 | Rucker | G07F 17/34 463/21 |
| 2017/0018143 | A1* | 1/2017 | Nakamura | G07F 17/3267 |
| 2017/0032625 | A1* | 2/2017 | Nakamura | G07F 17/32 |

* cited by examiner

BUTTON LAYOUT

FIG.8

NORMAL MODE VIDEO REELS(WAYS BET1:3WAYS)

| | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | JACK | NINE | ACE | NINE | KING |
| 4 | KING | TEN | FISH | JACK | TURTLE |
| 5 | TURTLE | PHOENIX | TEN | LION | ACE |
| 6 | TEN | ACE | TURTLE | KING | QUEEN |
| 7 | LION | FISH | JACK | FISH | LION |
| 8 | JACK | JACK | PACKET | TEN | JACK |
| 9 | NINE | TURTLE | NINE | PHOENIX | NINE |
| 10 | PACKET | NINE | TURTLE | NINE | PACKET |
| 11 | JACK | PACKET | KING | PACKET | TEN |
| 12 | ACE | ACE | TEN | ACE | KING |
| 13 | FISH | QUEEN | LION | FEATURE | TURTLE |
| 14 | KING | FEATURE | QUEEN | QUEEN | JACK |
| 15 | QUEEN | KING | NINE | FISH | NINE |
| 16 | LION | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | TURTLE | WILD | KING | FISH |
| 20 | NINE | TEN | QUEEN | TURTLE | JACK |
| 21 | PACKET | FEATURE | TEN | ACE | ACE |
| 22 | JACK | QUEEN | PACKET | JACK | NINE |
| 23 | TEN | PACKET | ACE | FEATURE | TURTLE |
| 24 | TURTLE | NINE | PHOENIX | TEN | TEN |
| 25 | JACK | KING | QUEEN | PACKET | ACE |
| 26 | | PHOENIX | FISH | KING | PACKET |
| 27 | | TEN | NINE | | QUEEN |
| 28 | | FISH | | | ACE |
| 29 | | | | | LION |
| 30 | | | | | TEN |
| 31 | | | | | FISH |
| 32 | | | | | ACE |
| 33 | | | | | KING |
| 34 | | | | | |

FIG.9

NORMAL MODE VIDEO REELS(WAYS BET2:9WAYS)

| | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | JACK | NINE | ACE | NINE | KING |
| 4 | KING | TEN | FISH | JACK | TURTLE |
| 5 | TURTLE | PHOENIX | TEN | LION | ACE |
| 6 | TEN | ACE | TURTLE | KING | QUEEN |
| 7 | LION | FISH | JACK | FISH | LION |
| 8 | JACK | JACK | PACKET | TEN | JACK |
| 9 | NINE | TURTLE | NINE | PHOENIX | NINE |
| 10 | PACKET | NINE | TURTLE | NINE | PACKET |
| 11 | JACK | PACKET | KING | PACKET | TEN |
| 12 | ACE | ACE | TEN | ACE | KING |
| 13 | FISH | QUEEN | LION | FEATURE | TURTLE |
| 14 | KING | FEATURE | QUEEN | QUEEN | JACK |
| 15 | QUEEN | KING | NINE | FISH | NINE |
| 16 | LION | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | TURTLE | WILD | KING | FISH |
| 20 | NINE | TEN | QUEEN | TURTLE | JACK |
| 21 | PACKET | FEATURE | TEN | ACE | ACE |
| 22 | JACK | QUEEN | PACKET | JACK | NINE |
| 23 | TEN | PACKET | ACE | FEATURE | TURTLE |
| 24 | TURTLE | NINE | PHOENIX | TEN | TEN |
| 25 | JACK | KING | QUEEN | PACKET | ACE |
| 26 | | PHOENIX | FISH | KING | PACKET |
| 27 | | TEN | NINE | | QUEEN |
| 28 | | FISH | | | ACE |
| 29 | | | | | LION |
| 30 | | | | | TEN |
| 31 | | | | | FISH |
| 32 | | | | | ACE |
| 33 | | | | | KING |
| 34 | | | | | |

FIG.10

NORMAL MODE VIDEO REELS(WAYS BET3:27WAYS)

| | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | JACK | FEATURE | WILD | FISH |
| 3 | JACK | WILD | ACE | NINE | KING |
| 4 | KING | NINE | FISH | JACK | TURTLE |
| 5 | TURTLE | ACE | TEN | LION | ACE |
| 6 | TEN | PHOENIX | TURTLE | KING | QUEEN |
| 7 | JACK | NINE | JACK | FISH | LION |
| 8 | TURTLE | FISH | PACKET | TEN | JACK |
| 9 | TEN | ACE | NINE | PHOENIX | NINE |
| 10 | KING | TURTLE | TURTLE | NINE | PACKET |
| 11 | JACK | TEN | KING | PACKET | TEN |
| 12 | TEN | PACKET | TEN | ACE | KING |
| 13 | LION | ACE | LION | FEATURE | TURTLE |
| 14 | JACK | QUEEN | QUEEN | QUEEN | JACK |
| 15 | QUEEN | FEATURE | NINE | FISH | NINE |
| 16 | LION | KING | PHOENIX | TEN | FEATURE |
| 17 | JACK | LION | QUEEN | LION | QUEEN |
| 18 | TEN | ACE | TEN | ACE | ACE |
| 19 | FEATURE | QUEEN | WILD | KING | FISH |
| 20 | NINE | PACKET | QUEEN | TURTLE | JACK |
| 21 | PACKET | ACE | TEN | ACE | ACE |
| 22 | JACK | FEATURE | PACKET | JACK | NINE |
| 23 | TEN | NINE | ACE | FEATURE | TURTLE |
| 24 | KING | FISH | PHOENIX | TEN | TEN |
| 25 | JACK | ACE | QUEEN | PACKET | ACE |
| 26 | | PACKET | FISH | KING | PACKET |
| 27 | | NINE | NINE | | QUEEN |
| 28 | | QUEEN | | | ACE |
| 29 | | FISH | | | LION |
| 30 | | | | | TEN |
| 31 | | | | | FISH |
| 32 | | | | | ACE |
| 33 | | | | | KING |
| 34 | | | | | |

FIG.11

NORMAL MODE VIDEO REELS(WAYS BET4:81WAYS)

| | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | QUEEN | NINE | ACE | NINE | KING |
| 4 | TEN | TEN | FISH | JACK | TURTLE |
| 5 | PACKET | PHOENIX | TEN | LION | ACE |
| 6 | JACK | ACE | TURTLE | KING | QUEEN |
| 7 | QUEEN | FISH | JACK | FISH | LION |
| 8 | LION | JACK | PACKET | TEN | JACK |
| 9 | KING | TURTLE | NINE | PHOENIX | NINE |
| 10 | ACE | NINE | TURTLE | NINE | PACKET |
| 11 | PACKET | PACKET | KING | PACKET | TEN |
| 12 | NINE | ACE | TEN | ACE | KING |
| 13 | ACE | QUEEN | LION | FEATURE | TURTLE |
| 14 | LION | FEATURE | QUEEN | QUEEN | JACK |
| 15 | KING | KING | NINE | FISH | NINE |
| 16 | FISH | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | TURTLE | WILD | KING | FISH |
| 20 | NINE | TEN | QUEEN | TURTLE | JACK |
| 21 | PACKET | FEATURE | TEN | ACE | ACE |
| 22 | JACK | QUEEN | PACKET | JACK | NINE |
| 23 | TEN | PACKET | ACE | FEATURE | TURTLE |
| 24 | TURTLE | NINE | PHOENIX | TEN | TEN |
| 25 | QUEEN | PHOENIX | QUEEN | PACKET | ACE |
| 26 | | TEN | FISH | KING | PACKET |
| 27 | | KING | NINE | | QUEEN |
| 28 | | FISH | | | ACE |
| 29 | | | | | LION |
| 30 | | | | | TEN |
| 31 | | | | | FISH |
| 32 | | | | | ACE |
| 33 | | | | | KING |
| 34 | | | | | |

FIG.12

NORMAL MODE VIDEO REELS(WAYS BET5:243WAYS)

| | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | QUEEN | NINE | ACE | NINE | KING |
| 4 | NINE | TEN | FISH | JACK | TURTLE |
| 5 | FISH | PHOENIX | TEN | LION | ACE |
| 6 | ACE | ACE | TURTLE | KING | QUEEN |
| 7 | KING | FISH | JACK | FISH | LION |
| 8 | PHOENIX | JACK | PACKET | TEN | JACK |
| 9 | ACE | TURTLE | NINE | PHOENIX | NINE |
| 10 | NINE | NINE | TURTLE | NINE | PACKET |
| 11 | LION | PACKET | KING | PACKET | TEN |
| 12 | ACE | ACE | TEN | ACE | KING |
| 13 | JACK | QUEEN | LION | FEATURE | TURTLE |
| 14 | LION | FEATURE | QUEEN | QUEEN | JACK |
| 15 | ACE | KING | NINE | FISH | NINE |
| 16 | PACKET | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | TURTLE | WILD | KING | FISH |
| 20 | NINE | TEN | QUEEN | TURTLE | JACK |
| 21 | PACKET | FEATURE | TEN | ACE | ACE |
| 22 | JACK | QUEEN | PACKET | JACK | NINE |
| 23 | TEN | PACKET | ACE | FEATURE | TURTLE |
| 24 | TURTLE | NINE | PHOENIX | TEN | TEN |
| 25 | QUEEN | PHOENIX | QUEEN | PACKET | ACE |
| 26 | | TEN | FISH | KING | PACKET |
| 27 | | KING | NINE | | QUEEN |
| 28 | | FISH | | | ACE |
| 29 | | | | | LION |
| 30 | | | | | TEN |
| 31 | | | | | FISH |
| 32 | | | | | ACE |
| 33 | | | | | KING |
| 34 | | | | | |

FIG.13

CHANCE MODE VIDEO REELS(WAYS BET1:3WAYS) NO. 1

| NO. | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | JACK | NINE | ACE | NINE | KING |
| 4 | KING | TEN | FISH | JACK | TURTLE |
| 5 | TURTLE | PHOENIX | TEN | LION | ACE |
| 6 | TEN | ACE | TURTLE | KING | QUEEN |
| 7 | LION | FISH | JACK | FISH | LION |
| 8 | JACK | JACK | PACKET | TEN | JACK |
| 9 | NINE | TURTLE | NINE | PHOENIX | NINE |
| 10 | PACKET | NINE | TURTLE | NINE | PACKET |
| 11 | JACK | PACKET | KING | PACKET | TEN |
| 12 | ACE | ACE | TEN | ACE | KING |
| 13 | FISH | QUEEN | LION | FEATURE | TURTLE |
| 14 | KING | FEATURE | QUEEN | QUEEN | JACK |
| 15 | QUEEN | KING | NINE | FISH | NINE |
| 16 | LION | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | TURTLE | WILD | KING | FISH |
| 20 | NINE | TEN | QUEEN | TURTLE | JACK |
| 21 | PACKET | FEATURE | TEN | ACE | ACE |
| 22 | JACK | QUEEN | PACKET | JACK | NINE |
| 23 | TEN | PACKET | ACE | FEATURE | TURTLE |
| 24 | TURTLE | NINE | PHOENIX | TEN | TEN |
| 25 | JACK | KING | QUEEN | PACKET | ACE |

| NO. | REEL 1 | REEL 2 | REEL 3 | REEL 4 | REEL 5 |
|---|---|---|---|---|---|
| 26 | FEATURE | PHOENIX | FISH | KING | PACKET |
| 27 | NINE | TEN | NINE | | QUEEN |
| 28 | PACKET | FISH | | | ACE |
| 29 | JACK | ACE | | | LION |
| 30 | TEN | QUEEN | | | TEN |
| 31 | FEATURE | FEATURE | | | FISH |
| 32 | NINE | KING | | | ACE |
| 33 | PACKET | LION | | | |
| 34 | JACK | ACE | | | |
| 35 | TEN | QUEEN | | | |
| 36 | FEATURE | FEATURE | | | |
| 37 | NINE | KING | | | |
| 38 | PACKET | LION | | | |
| 39 | JACK | ACE | | | |
| 40 | TEN | QUEEN | | | |
| 41 | FEATURE | FEATURE | | | |
| 42 | NINE | KING | | | |
| 43 | PACKET | LION | | | |
| 44 | JACK | ACE | | | |
| 45 | TEN | QUEEN | | | |
| 46 | FEATURE | FEATURE | | | |
| 47 | NINE | KING | | | |
| 48 | PACKET | LION | | | |
| 49 | JACK | ACE | | | |
| 50 | TEN | QUEEN | | | |

FIG.14

CHANCE MODE VIDEO REELS(WAYS BET1:3WAYS) NO. 2

| NO. | REEL 1 | REEL 2 | REEL 3 | REEL 4 | REEL 5 |
|---|---|---|---|---|---|
| 51 | FEATURE | FEATURE | | | |
| 52 | NINE | KING | | | |
| 53 | PACKET | LION | | | |
| 54 | JACK | ACE | | | |
| 55 | TEN | QUEEN | | | |
| 56 | FEATURE | FEATURE | | | |
| 57 | NINE | KING | | | |
| 58 | PACKET | LION | | | |
| 59 | JACK | ACE | | | |
| 60 | TEN | QUEEN | | | |
| 61 | FEATURE | FEATURE | | | |
| 62 | NINE | KING | | | |
| 63 | PACKET | LION | | | |
| 64 | JACK | ACE | | | |
| 65 | TEN | QUEEN | | | |
| 66 | FEATURE | FEATURE | | | |
| 67 | NINE | KING | | | |
| 68 | PACKET | LION | | | |
| 69 | JACK | ACE | | | |
| 70 | TEN | QUEEN | | | |
| 71 | FEATURE | FEATURE | | | |
| 72 | NINE | KING | | | |
| 73 | PACKET | LION | | | |
| 74 | JACK | ACE | | | |
| 75 | TEN | QUEEN | | | |

| NO. | REEL 1 | REEL 2 | REEL 3 | REEL 4 | REEL 5 |
|---|---|---|---|---|---|
| 76 | FEATURE | FEATURE | | | |
| 77 | NINE | KING | | | |
| 78 | PACKET | LION | | | |
| 79 | JACK | ACE | | | |
| 80 | TEN | QUEEN | | | |
| 81 | FEATURE | FEATURE | | | |
| 82 | NINE | KING | | | |
| 83 | PACKET | LION | | | |
| 84 | JACK | ACE | | | |
| 85 | TEN | QUEEN | | | |
| 86 | FEATURE | FEATURE | | | |
| 87 | NINE | KING | | | |
| 88 | PACKET | LION | | | |
| 89 | JACK | ACE | | | |
| 90 | TEN | QUEEN | | | |
| 91 | FEATURE | FEATURE | | | |
| 92 | NINE | KING | | | |
| 93 | PACKET | LION | | | |
| 94 | JACK | ACE | | | |
| 95 | TEN | QUEEN | | | |
| 96 | FEATURE | FEATURE | | | |
| 97 | NINE | KING | | | |
| 98 | PACKET | LION | | | |
| 99 | JACK | ACE | | | |
| 100 | TEN | QUEEN | | | |

FIG.15

CHANCE MODE VIDEO REELS(WAYS BET1:3WAYS) NO. 3

| NO. | REEL 1 | REEL 2 | REEL 3 | REEL 4 | REEL 5 |
|---|---|---|---|---|---|
| 101 | FEATURE | FEATURE | | | |
| 102 | NINE | KING | | | |
| 103 | PACKET | LION | | | |
| 104 | JACK | ACE | | | |
| 105 | TEN | QUEEN | | | |
| 106 | FEATURE | FEATURE | | | |
| 107 | NINE | KING | | | |
| 108 | PACKET | LION | | | |
| 109 | JACK | ACE | | | |
| 110 | TEN | QUEEN | | | |
| 111 | FEATURE | FEATURE | | | |
| 112 | NINE | KING | | | |
| 113 | PACKET | LION | | | |
| 114 | JACK | ACE | | | |
| 115 | TEN | QUEEN | | | |
| 116 | FEATURE | FEATURE | | | |
| 117 | NINE | KING | | | |
| 118 | PACKET | LION | | | |
| 119 | JACK | ACE | | | |
| 120 | TEN | QUEEN | | | |
| 121 | FEATURE | FEATURE | | | |
| 122 | NINE | KING | | | |
| 123 | PACKET | LION | | | |
| 124 | JACK | ACE | | | |
| 125 | TEN | QUEEN | | | |

| NO. | REEL 1 | REEL 2 | REEL 3 | REEL 4 | REEL 5 |
|---|---|---|---|---|---|
| 126 | FEATURE | FEATURE | | | |
| 127 | NINE | KING | | | |
| 128 | PACKET | LION | | | |
| 129 | JACK | ACE | | | |
| 130 | TEN | QUEEN | | | |
| 131 | FEATURE | FEATURE | | | |
| 132 | NINE | KING | | | |
| 133 | PACKET | LION | | | |
| 134 | JACK | ACE | | | |
| 135 | TEN | QUEEN | | | |
| 136 | FEATURE | FEATURE | | | |
| 137 | NINE | KING | | | |
| 138 | PACKET | LION | | | |
| 139 | JACK | ACE | | | |
| 140 | TEN | QUEEN | | | |
| 141 | FEATURE | FEATURE | | | |
| 142 | NINE | KING | | | |
| 143 | PACKET | LION | | | |
| 144 | JACK | ACE | | | |
| 145 | TEN | QUEEN | | | |
| 146 | FEATURE | FEATURE | | | |
| 147 | NINE | KING | | | |
| 148 | PACKET | LION | | | |
| 149 | JACK | ACE | | | |
| 150 | TEN | QUEEN | | | |

FIG.16

CHANCE MODE VIDEO REELS(WAYS BET1:3WAYS) NO. 4

| NO. | REEL 1 | REEL 2 | REEL 3 | REEL 4 | REEL 5 |
|---|---|---|---|---|---|
| 151 | FEATURE | FEATURE | | | |
| 152 | NINE | KING | | | |
| 153 | PACKET | LION | | | |
| 154 | JACK | ACE | | | |
| 155 | TEN | QUEEN | | | |
| 156 | FEATURE | FEATURE | | | |
| 157 | NINE | KING | | | |
| 158 | PACKET | LION | | | |
| 159 | JACK | ACE | | | |
| 160 | TEN | QUEEN | | | |
| 161 | FEATURE | FEATURE | | | |
| 162 | NINE | KING | | | |
| 163 | PACKET | LION | | | |
| 164 | JACK | ACE | | | |
| 165 | TEN | QUEEN | | | |
| 166 | FEATURE | FEATURE | | | |
| 167 | NINE | KING | | | |
| 168 | PACKET | LION | | | |
| 169 | JACK | ACE | | | |
| 170 | TEN | QUEEN | | | |
| 171 | FEATURE | FEATURE | | | |
| 172 | NINE | KING | | | |
| 173 | PACKET | LION | | | |
| 174 | JACK | ACE | | | |
| 175 | TEN | QUEEN | | | |

| NO. | REEL 1 | REEL 2 | REEL 3 | REEL 4 | REEL 5 |
|---|---|---|---|---|---|
| 176 | FEATURE | FEATURE | | | |
| 177 | NINE | KING | | | |
| 178 | PACKET | LION | | | |
| 179 | JACK | ACE | | | |
| 180 | TEN | QUEEN | | | |
| 181 | FEATURE | FEATURE | | | |
| 182 | NINE | KING | | | |
| 183 | PACKET | LION | | | |
| 184 | JACK | ACE | | | |
| 185 | TEN | QUEEN | | | |
| 186 | FEATURE | FEATURE | | | |
| 187 | NINE | KING | | | |
| 188 | PACKET | LION | | | |
| 189 | JACK | ACE | | | |
| 190 | TEN | QUEEN | | | |
| 191 | FEATURE | FEATURE | | | |
| 192 | NINE | KING | | | |
| 193 | PACKET | LION | | | |
| 194 | JACK | ACE | | | |
| 195 | TEN | QUEEN | | | |
| 196 | | | | | |
| 197 | | | | | |
| 198 | | | | | |
| 199 | | | | | |
| 200 | | | | | |

FIG.17

CHANCE MODE VIDEO REELS(WAYS BET2:9WAYS) NO. 1

| NO. | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | JACK | NINE | ACE | NINE | KING |
| 4 | KING | TEN | FISH | JACK | TURTLE |
| 5 | TURTLE | PHOENIX | TEN | LION | ACE |
| 6 | TEN | ACE | TURTLE | KING | QUEEN |
| 7 | LION | FISH | JACK | FISH | LION |
| 8 | JACK | JACK | PACKET | TEN | JACK |
| 9 | NINE | TURTLE | NINE | PHOENIX | NINE |
| 10 | PACKET | NINE | TURTLE | NINE | PACKET |
| 11 | JACK | PACKET | KING | PACKET | TEN |
| 12 | ACE | ACE | TEN | ACE | KING |
| 13 | FISH | QUEEN | LION | FEATURE | TURTLE |
| 14 | KING | FEATURE | QUEEN | QUEEN | JACK |
| 15 | QUEEN | KING | NINE | FISH | NINE |
| 16 | LION | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | TURTLE | WILD | KING | FISH |
| 20 | NINE | TEN | QUEEN | TURTLE | JACK |
| 21 | PACKET | FEATURE | TEN | ACE | ACE |
| 22 | JACK | QUEEN | PACKET | JACK | NINE |
| 23 | TEN | PACKET | ACE | FEATURE | TURTLE |
| 24 | TURTLE | NINE | PHOENIX | TEN | TEN |
| 25 | JACK | KING | QUEEN | PACKET | ACE |

| NO. | REEL 1 | REEL 2 | REEL 3 | REEL 4 | REEL 5 |
|---|---|---|---|---|---|
| 26 | FEATURE | PHOENIX | FISH | KING | PACKET |
| 27 | NINE | TEN | NINE | | QUEEN |
| 28 | PACKET | FISH | | | ACE |
| 29 | JACK | ACE | | | LION |
| 30 | TEN | QUEEN | | | TEN |
| 31 | FEATURE | FEATURE | | | FISH |
| 32 | NINE | KING | | | ACE |
| 33 | PACKET | LION | | | KING |
| 34 | JACK | ACE | | | |
| 35 | TEN | QUEEN | | | |
| 36 | FEATURE | FEATURE | | | |
| 37 | NINE | KING | | | |
| 38 | PACKET | LION | | | |
| 39 | JACK | ACE | | | |
| 40 | TEN | QUEEN | | | |
| 41 | FEATURE | FEATURE | | | |
| 42 | NINE | KING | | | |
| 43 | PACKET | LION | | | |
| 44 | JACK | ACE | | | |
| 45 | TEN | QUEEN | | | |
| 46 | FEATURE | FEATURE | | | |
| 47 | NINE | KING | | | |
| 48 | PACKET | LION | | | |
| 49 | JACK | ACE | | | |
| 50 | TEN | QUEEN | | | |

FIG.18

CHANCE MODE VIDEO REELS(WAYS BET2:9WAYS) NO. 2

| NO. | REEL 1 | REEL 2 | REEL 3 | REEL 4 | REEL 5 |
|---|---|---|---|---|---|
| 51 | FEATURE | FEATURE | | | |
| 52 | NINE | KING | | | |
| 53 | PACKET | LION | | | |
| 54 | JACK | ACE | | | |
| 55 | TEN | QUEEN | | | |
| 56 | FEATURE | FEATURE | | | |
| 57 | NINE | KING | | | |
| 58 | PACKET | LION | | | |
| 59 | JACK | ACE | | | |
| 60 | TEN | QUEEN | | | |
| 61 | FEATURE | FEATURE | | | |
| 62 | NINE | KING | | | |
| 63 | PACKET | LION | | | |
| 64 | JACK | ACE | | | |
| 65 | TEN | QUEEN | | | |
| 66 | FEATURE | FEATURE | | | |
| 67 | NINE | KING | | | |
| 68 | PACKET | LION | | | |
| 69 | JACK | ACE | | | |
| 70 | TEN | QUEEN | | | |
| 71 | FEATURE | FEATURE | | | |
| 72 | NINE | KING | | | |
| 73 | PACKET | LION | | | |
| 74 | JACK | ACE | | | |
| 75 | TEN | QUEEN | | | |

| NO. | REEL 1 | REEL 2 | REEL 3 | REEL 4 | REEL 5 |
|---|---|---|---|---|---|
| 76 | FEATURE | FEATURE | | | |
| 77 | NINE | KING | | | |
| 78 | PACKET | LION | | | |
| 79 | JACK | ACE | | | |
| 80 | TEN | QUEEN | | | |
| 81 | FEATURE | FEATURE | | | |
| 82 | NINE | KING | | | |
| 83 | PACKET | LION | | | |
| 84 | JACK | ACE | | | |
| 85 | TEN | QUEEN | | | |
| 86 | FEATURE | FEATURE | | | |
| 87 | NINE | KING | | | |
| 88 | PACKET | LION | | | |
| 89 | JACK | ACE | | | |
| 90 | TEN | QUEEN | | | |
| 91 | FEATURE | FEATURE | | | |
| 92 | NINE | KING | | | |
| 93 | PACKET | LION | | | |
| 94 | JACK | ACE | | | |
| 95 | TEN | QUEEN | | | |
| 96 | FEATURE | FEATURE | | | |
| 97 | NINE | KING | | | |
| 98 | PACKET | LION | | | |
| 99 | JACK | ACE | | | |
| 100 | TEN | QUEEN | | | |

FIG.19

CHANCE MODE VIDEO REELS(WAYS BET2:9WAYS) NO. 3

| NO. | REEL 1 | REEL 2 | REEL 3 | REEL 4 | REEL 5 |
|---|---|---|---|---|---|
| 101 | FEATURE | FEATURE | | | |
| 102 | NINE | KING | | | |
| 103 | PACKET | LION | | | |
| 104 | JACK | ACE | | | |
| 105 | TEN | QUEEN | | | |
| 106 | FEATURE | FEATURE | | | |
| 107 | NINE | KING | | | |
| 108 | PACKET | LION | | | |
| 109 | JACK | ACE | | | |
| 110 | TEN | QUEEN | | | |
| 111 | FEATURE | FEATURE | | | |
| 112 | NINE | KING | | | |
| 113 | PACKET | LION | | | |
| 114 | JACK | ACE | | | |
| 115 | TEN | QUEEN | | | |
| 116 | FEATURE | FEATURE | | | |
| 117 | NINE | KING | | | |
| 118 | PACKET | LION | | | |
| 119 | JACK | ACE | | | |
| 120 | TEN | QUEEN | | | |
| 121 | FEATURE | FEATURE | | | |
| 122 | NINE | KING | | | |
| 123 | PACKET | LION | | | |
| 124 | JACK | ACE | | | |
| 125 | TEN | QUEEN | | | |

| NO. | REEL 1 | REEL 2 | REEL 3 | REEL 4 | REEL 5 |
|---|---|---|---|---|---|
| 126 | FEATURE | FEATURE | | | |
| 127 | NINE | KING | | | |
| 128 | PACKET | LION | | | |
| 129 | JACK | ACE | | | |
| 130 | TEN | QUEEN | | | |
| 131 | FEATURE | FEATURE | | | |
| 132 | NINE | KING | | | |
| 133 | PACKET | LION | | | |
| 134 | JACK | ACE | | | |
| 135 | TEN | QUEEN | | | |
| 136 | FEATURE | FEATURE | | | |
| 137 | NINE | KING | | | |
| 138 | PACKET | LION | | | |
| 139 | JACK | ACE | | | |
| 140 | TEN | QUEEN | | | |
| 141 | FEATURE | FEATURE | | | |
| 142 | NINE | KING | | | |
| 143 | PACKET | LION | | | |
| 144 | JACK | ACE | | | |
| 145 | TEN | QUEEN | | | |
| 146 | FEATURE | FEATURE | | | |
| 147 | NINE | KING | | | |
| 148 | PACKET | LION | | | |
| 149 | JACK | ACE | | | |
| 150 | TEN | QUEEN | | | |

FIG.20

CHANCE MODE VIDEO REELS(WAYS BET2:9WAYS) NO. 4

| NO. | REEL 1 | REEL 2 | REEL 3 | REEL 4 | REEL 5 |
|---|---|---|---|---|---|
| 151 | FEATURE | FEATURE | | | |
| 152 | NINE | KING | | | |
| 153 | PACKET | LION | | | |
| 154 | JACK | ACE | | | |
| 155 | TEN | QUEEN | | | |
| 156 | FEATURE | FEATURE | | | |
| 157 | NINE | KING | | | |
| 158 | PACKET | LION | | | |
| 159 | JACK | ACE | | | |
| 160 | TEN | QUEEN | | | |
| 161 | FEATURE | FEATURE | | | |
| 162 | NINE | KING | | | |
| 163 | PACKET | LION | | | |
| 164 | JACK | ACE | | | |
| 165 | TEN | QUEEN | | | |
| 166 | FEATURE | FEATURE | | | |
| 167 | NINE | KING | | | |
| 168 | PACKET | LION | | | |
| 169 | JACK | ACE | | | |
| 170 | TEN | QUEEN | | | |
| 171 | FEATURE | FEATURE | | | |
| 172 | NINE | KING | | | |
| 173 | PACKET | LION | | | |
| 174 | JACK | ACE | | | |
| 175 | TEN | QUEEN | | | |

| NO. | REEL 1 | REEL 2 | REEL 3 | REEL 4 | REEL 5 |
|---|---|---|---|---|---|
| 176 | FEATURE | FEATURE | | | |
| 177 | NINE | KING | | | |
| 178 | PACKET | LION | | | |
| 179 | JACK | ACE | | | |
| 180 | TEN | QUEEN | | | |
| 181 | FEATURE | FEATURE | | | |
| 182 | NINE | KING | | | |
| 183 | PACKET | LION | | | |
| 184 | JACK | ACE | | | |
| 185 | TEN | QUEEN | | | |
| 186 | FEATURE | FEATURE | | | |
| 187 | NINE | KING | | | |
| 188 | PACKET | LION | | | |
| 189 | JACK | ACE | | | |
| 190 | TEN | QUEEN | | | |
| 191 | FEATURE | FEATURE | | | |
| 192 | NINE | KING | | | |
| 193 | PACKET | LION | | | |
| 194 | JACK | ACE | | | |
| 195 | TEN | QUEEN | | | |
| 196 | | | | | |
| 197 | | | | | |
| 198 | | | | | |
| 199 | | | | | |
| 200 | | | | | |

FIG.21

CHANCE MODE VIDEO REELS(WAYS BET3:27WAYS) NO. 1

| NO. | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | JACK | NINE | ACE | NINE | KING |
| 4 | KING | ACE | FISH | JACK | TURTLE |
| 5 | TURTLE | PHOENIX | TEN | LION | ACE |
| 6 | TEN | NINE | TURTLE | KING | QUEEN |
| 7 | JACK | FISH | JACK | FISH | LION |
| 8 | TURTLE | ACE | PACKET | TEN | JACK |
| 9 | TEN | TURTLE | NINE | PHOENIX | NINE |
| 10 | KING | TEN | TURTLE | NINE | PACKET |
| 11 | JACK | PACKET | KING | PACKET | TEN |
| 12 | TEN | ACE | TEN | ACE | KING |
| 13 | LION | QUEEN | LION | FEATURE | TURTLE |
| 14 | JACK | FEATURE | QUEEN | QUEEN | JACK |
| 15 | QUEEN | KING | NINE | FISH | NINE |
| 16 | LION | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | PACKET | WILD | KING | FISH |
| 20 | NINE | ACE | QUEEN | TURTLE | JACK |
| 21 | PACKET | FEATURE | TEN | ACE | ACE |
| 22 | JACK | NINE | PACKET | JACK | NINE |
| 23 | TEN | FISH | ACE | FEATURE | TURTLE |
| 24 | KING | ACE | PHOENIX | TEN | TEN |
| 25 | JACK | PACKET | QUEEN | PACKET | ACE |

| NO. | REEL 1 | REEL 2 | REEL 3 | REEL 4 | REEL 5 |
|---|---|---|---|---|---|
| 26 | FEATURE | NINE | FISH | KING | PACKET |
| 27 | NINE | QUEEN | NINE | | QUEEN |
| 28 | PACKET | FISH | | | ACE |
| 29 | JACK | ACE | | | LION |
| 30 | TEN | QUEEN | | | TEN |
| 31 | FEATURE | FEATURE | | | FISH |
| 32 | NINE | KING | | | ACE |
| 33 | PACKET | LION | | | KING |
| 34 | JACK | ACE | | | |
| 35 | TEN | QUEEN | | | |
| 36 | FEATURE | FEATURE | | | |
| 37 | NINE | KING | | | |
| 38 | PACKET | LION | | | |
| 39 | JACK | ACE | | | |
| 40 | TEN | QUEEN | | | |
| 41 | FEATURE | FEATURE | | | |
| 42 | NINE | KING | | | |
| 43 | PACKET | LION | | | |
| 44 | JACK | ACE | | | |
| 45 | TEN | QUEEN | | | |
| 46 | FEATURE | FEATURE | | | |
| 47 | NINE | KING | | | |
| 48 | PACKET | LION | | | |
| 49 | JACK | ACE | | | |
| 50 | TEN | QUEEN | | | |

FIG.22

CHANCE MODE VIDEO REELS(WAYS BET3:27WAYS) NO. 2

| NO. | REEL 1 | REEL 2 | REEL 3 | REEL 4 | REEL 5 |
|---|---|---|---|---|---|
| 51 | FEATURE | FEATURE | | | |
| 52 | NINE | KING | | | |
| 53 | PACKET | LION | | | |
| 54 | JACK | ACE | | | |
| 55 | TEN | QUEEN | | | |
| 56 | FEATURE | FEATURE | | | |
| 57 | NINE | KING | | | |
| 58 | PACKET | LION | | | |
| 59 | JACK | ACE | | | |
| 60 | TEN | QUEEN | | | |
| 61 | FEATURE | FEATURE | | | |
| 62 | NINE | KING | | | |
| 63 | PACKET | LION | | | |
| 64 | JACK | ACE | | | |
| 65 | TEN | QUEEN | | | |
| 66 | FEATURE | FEATURE | | | |
| 67 | NINE | KING | | | |
| 68 | PACKET | LION | | | |
| 69 | JACK | ACE | | | |
| 70 | TEN | QUEEN | | | |
| 71 | FEATURE | FEATURE | | | |
| 72 | NINE | KING | | | |
| 73 | PACKET | LION | | | |
| 74 | JACK | ACE | | | |
| 75 | TEN | QUEEN | | | |

| NO. | REEL 1 | REEL 2 | REEL 3 | REEL 4 | REEL 5 |
|---|---|---|---|---|---|
| 76 | FEATURE | FEATURE | | | |
| 77 | NINE | KING | | | |
| 78 | PACKET | LION | | | |
| 79 | JACK | ACE | | | |
| 80 | TEN | QUEEN | | | |
| 81 | FEATURE | FEATURE | | | |
| 82 | NINE | KING | | | |
| 83 | PACKET | LION | | | |
| 84 | JACK | ACE | | | |
| 85 | TEN | QUEEN | | | |
| 86 | FEATURE | FEATURE | | | |
| 87 | NINE | KING | | | |
| 88 | PACKET | LION | | | |
| 89 | JACK | ACE | | | |
| 90 | TEN | QUEEN | | | |
| 91 | FEATURE | FEATURE | | | |
| 92 | NINE | KING | | | |
| 93 | PACKET | LION | | | |
| 94 | JACK | ACE | | | |
| 95 | TEN | QUEEN | | | |
| 96 | FEATURE | FEATURE | | | |
| 97 | NINE | KING | | | |
| 98 | PACKET | LION | | | |
| 99 | JACK | ACE | | | |
| 100 | TEN | QUEEN | | | |

FIG.23

CHANCE MODE VIDEO REELS(WAYS BET3:27WAYS) NO. 3

| NO. | REEL 1 | REEL 2 | REEL 3 | REEL 4 | REEL 5 |
|---|---|---|---|---|---|
| 101 | FEATURE | FEATURE | | | |
| 102 | NINE | KING | | | |
| 103 | PACKET | LION | | | |
| 104 | JACK | ACE | | | |
| 105 | TEN | QUEEN | | | |
| 106 | FEATURE | FEATURE | | | |
| 107 | NINE | KING | | | |
| 108 | PACKET | LION | | | |
| 109 | JACK | ACE | | | |
| 110 | TEN | QUEEN | | | |
| 111 | FEATURE | FEATURE | | | |
| 112 | NINE | KING | | | |
| 113 | PACKET | LION | | | |
| 114 | JACK | ACE | | | |
| 115 | TEN | QUEEN | | | |
| 116 | FEATURE | FEATURE | | | |
| 117 | NINE | KING | | | |
| 118 | PACKET | LION | | | |
| 119 | JACK | ACE | | | |
| 120 | TEN | QUEEN | | | |
| 121 | FEATURE | FEATURE | | | |
| 122 | NINE | KING | | | |
| 123 | PACKET | LION | | | |
| 124 | JACK | ACE | | | |
| 125 | TEN | QUEEN | | | |

| NO. | REEL 1 | REEL 2 | REEL 3 | REEL 4 | REEL 5 |
|---|---|---|---|---|---|
| 126 | FEATURE | FEATURE | | | |
| 127 | NINE | KING | | | |
| 128 | PACKET | LION | | | |
| 129 | JACK | ACE | | | |
| 130 | TEN | QUEEN | | | |
| 131 | FEATURE | FEATURE | | | |
| 132 | NINE | KING | | | |
| 133 | PACKET | LION | | | |
| 134 | JACK | ACE | | | |
| 135 | TEN | QUEEN | | | |
| 136 | FEATURE | FEATURE | | | |
| 137 | NINE | KING | | | |
| 138 | PACKET | LION | | | |
| 139 | JACK | ACE | | | |
| 140 | TEN | QUEEN | | | |
| 141 | FEATURE | FEATURE | | | |
| 142 | NINE | KING | | | |
| 143 | PACKET | LION | | | |
| 144 | JACK | ACE | | | |
| 145 | TEN | QUEEN | | | |
| 146 | FEATURE | FEATURE | | | |
| 147 | NINE | KING | | | |
| 148 | PACKET | LION | | | |
| 149 | JACK | ACE | | | |
| 150 | TEN | QUEEN | | | |

FIG.24

CHANCE MODE VIDEO REELS(WAYS BET3:27WAYS) NO. 4

| NO. | REEL 1 | REEL 2 | REEL 3 | REEL 4 | REEL 5 |
|---|---|---|---|---|---|
| 151 | FEATURE | FEATURE | | | |
| 152 | NINE | KING | | | |
| 153 | PACKET | LION | | | |
| 154 | JACK | ACE | | | |
| 155 | TEN | QUEEN | | | |
| 156 | FEATURE | FEATURE | | | |
| 157 | NINE | KING | | | |
| 158 | PACKET | LION | | | |
| 159 | JACK | ACE | | | |
| 160 | TEN | QUEEN | | | |
| 161 | FEATURE | FEATURE | | | |
| 162 | NINE | KING | | | |
| 163 | PACKET | LION | | | |
| 164 | JACK | ACE | | | |
| 165 | TEN | QUEEN | | | |
| 166 | FEATURE | FEATURE | | | |
| 167 | NINE | KING | | | |
| 168 | PACKET | LION | | | |
| 169 | JACK | ACE | | | |
| 170 | TEN | QUEEN | | | |
| 171 | FEATURE | FEATURE | | | |
| 172 | NINE | KING | | | |
| 173 | PACKET | LION | | | |
| 174 | JACK | ACE | | | |
| 175 | TEN | QUEEN | | | |

| NO. | REEL 1 | REEL 2 | REEL 3 | REEL 4 | REEL 5 |
|---|---|---|---|---|---|
| 176 | FEATURE | FEATURE | | | |
| 177 | NINE | KING | | | |
| 178 | PACKET | LION | | | |
| 179 | JACK | ACE | | | |
| 180 | TEN | QUEEN | | | |
| 181 | FEATURE | FEATURE | | | |
| 182 | NINE | KING | | | |
| 183 | PACKET | LION | | | |
| 184 | JACK | ACE | | | |
| 185 | TEN | QUEEN | | | |
| 186 | FEATURE | FEATURE | | | |
| 187 | NINE | KING | | | |
| 188 | PACKET | LION | | | |
| 189 | JACK | ACE | | | |
| 190 | TEN | QUEEN | | | |
| 191 | FEATURE | FEATURE | | | |
| 192 | NINE | KING | | | |
| 193 | PACKET | LION | | | |
| 194 | JACK | ACE | | | |
| 195 | TEN | QUEEN | | | |
| 196 | | | | | |
| 197 | | | | | |
| 198 | | | | | |
| 199 | | | | | |
| 200 | | | | | |

FIG.25

CHANCE MODE VIDEO REELS(WAYS BET4:81WAYS) NO. 1

| NO. | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | QUEEN | NINE | ACE | NINE | KING |
| 4 | TEN | TEN | FISH | JACK | TURTLE |
| 5 | PACKET | PHOENIX | TEN | LION | ACE |
| 6 | JACK | ACE | TURTLE | KING | QUEEN |
| 7 | QUEEN | FISH | JACK | FISH | LION |
| 8 | LION | JACK | PACKET | TEN | JACK |
| 9 | KING | TURTLE | NINE | PHOENIX | NINE |
| 10 | ACE | NINE | TURTLE | NINE | PACKET |
| 11 | PACKET | PACKET | KING | PACKET | TEN |
| 12 | NINE | ACE | TEN | ACE | KING |
| 13 | ACE | QUEEN | LION | FEATURE | TURTLE |
| 14 | LION | FEATURE | QUEEN | QUEEN | JACK |
| 15 | KING | KING | NINE | FISH | NINE |
| 16 | FISH | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | TURTLE | WILD | KING | FISH |
| 20 | NINE | TEN | QUEEN | TURTLE | JACK |
| 21 | PACKET | FEATURE | TEN | ACE | ACE |
| 22 | JACK | QUEEN | PACKET | JACK | NINE |
| 23 | TEN | PACKET | ACE | FEATURE | TURTLE |
| 24 | TURTLE | NINE | PHOENIX | TEN | TEN |
| 25 | QUEEN | PHOENIX | QUEEN | PACKET | ACE |

| NO. | REEL 1 | REEL 2 | REEL 3 | REEL 4 | REEL 5 |
|---|---|---|---|---|---|
| 26 | FEATURE | TEN | FISH | KING | PACKET |
| 27 | NINE | KING | NINE | | QUEEN |
| 28 | PACKET | FISH | | | ACE |
| 29 | JACK | ACE | | | LION |
| 30 | TEN | QUEEN | | | TEN |
| 31 | FEATURE | FEATURE | | | FISH |
| 32 | NINE | KING | | | ACE |
| 33 | PACKET | LION | | | KING |
| 34 | JACK | ACE | | | |
| 35 | TEN | QUEEN | | | |
| 36 | FEATURE | FEATURE | | | |
| 37 | NINE | KING | | | |
| 38 | PACKET | LION | | | |
| 39 | JACK | ACE | | | |
| 40 | TEN | QUEEN | | | |
| 41 | FEATURE | FEATURE | | | |
| 42 | NINE | KING | | | |
| 43 | PACKET | LION | | | |
| 44 | JACK | ACE | | | |
| 45 | TEN | QUEEN | | | |
| 46 | FEATURE | FEATURE | | | |
| 47 | NINE | KING | | | |
| 48 | PACKET | LION | | | |
| 49 | JACK | ACE | | | |
| 50 | TEN | QUEEN | | | |

FIG.26

CHANCE MODE VIDEO REELS(WAYS BET4:81WAYS) NO. 2

| NO. | REEL 1 | REEL 2 | REEL 3 | REEL 4 | REEL 5 |
|---|---|---|---|---|---|
| 51 | FEATURE | FEATURE | | | |
| 52 | NINE | KING | | | |
| 53 | PACKET | LION | | | |
| 54 | JACK | ACE | | | |
| 55 | TEN | QUEEN | | | |
| 56 | FEATURE | FEATURE | | | |
| 57 | NINE | KING | | | |
| 58 | PACKET | LION | | | |
| 59 | JACK | ACE | | | |
| 60 | TEN | QUEEN | | | |
| 61 | FEATURE | FEATURE | | | |
| 62 | NINE | KING | | | |
| 63 | PACKET | LION | | | |
| 64 | JACK | ACE | | | |
| 65 | TEN | QUEEN | | | |
| 66 | FEATURE | FEATURE | | | |
| 67 | NINE | KING | | | |
| 68 | PACKET | LION | | | |
| 69 | JACK | ACE | | | |
| 70 | TEN | QUEEN | | | |
| 71 | FEATURE | FEATURE | | | |
| 72 | NINE | KING | | | |
| 73 | PACKET | LION | | | |
| 74 | JACK | ACE | | | |
| 75 | TEN | QUEEN | | | |

| NO. | REEL 1 | REEL 2 | REEL 3 | REEL 4 | REEL 5 |
|---|---|---|---|---|---|
| 76 | FEATURE | FEATURE | | | |
| 77 | NINE | KING | | | |
| 78 | PACKET | LION | | | |
| 79 | JACK | ACE | | | |
| 80 | TEN | QUEEN | | | |
| 81 | FEATURE | FEATURE | | | |
| 82 | NINE | KING | | | |
| 83 | PACKET | LION | | | |
| 84 | JACK | ACE | | | |
| 85 | TEN | QUEEN | | | |
| 86 | FEATURE | FEATURE | | | |
| 87 | NINE | KING | | | |
| 88 | PACKET | LION | | | |
| 89 | JACK | ACE | | | |
| 90 | TEN | QUEEN | | | |
| 91 | FEATURE | FEATURE | | | |
| 92 | NINE | KING | | | |
| 93 | PACKET | LION | | | |
| 94 | JACK | ACE | | | |
| 95 | TEN | QUEEN | | | |
| 96 | FEATURE | FEATURE | | | |
| 97 | NINE | KING | | | |
| 98 | PACKET | LION | | | |
| 99 | JACK | ACE | | | |
| 100 | TEN | QUEEN | | | |

FIG.27

CHANCE MODE VIDEO REELS(WAYS BET4:81WAYS) NO. 3

| NO. | REEL 1 | REEL 2 | REEL 3 | REEL 4 | REEL 5 |
|---|---|---|---|---|---|
| 101 | FEATURE | FEATURE | | | |
| 102 | NINE | KING | | | |
| 103 | PACKET | LION | | | |
| 104 | JACK | ACE | | | |
| 105 | TEN | QUEEN | | | |
| 106 | FEATURE | FEATURE | | | |
| 107 | NINE | KING | | | |
| 108 | PACKET | LION | | | |
| 109 | JACK | ACE | | | |
| 110 | TEN | QUEEN | | | |
| 111 | FEATURE | FEATURE | | | |
| 112 | NINE | KING | | | |
| 113 | PACKET | LION | | | |
| 114 | JACK | ACE | | | |
| 115 | TEN | QUEEN | | | |
| 116 | FEATURE | FEATURE | | | |
| 117 | NINE | KING | | | |
| 118 | PACKET | LION | | | |
| 119 | JACK | ACE | | | |
| 120 | TEN | QUEEN | | | |
| 121 | FEATURE | FEATURE | | | |
| 122 | NINE | KING | | | |
| 123 | PACKET | LION | | | |
| 124 | JACK | ACE | | | |
| 125 | TEN | QUEEN | | | |

| NO. | REEL 1 | REEL 2 | REEL 3 | REEL 4 | REEL 5 |
|---|---|---|---|---|---|
| 126 | FEATURE | FEATURE | | | |
| 127 | NINE | KING | | | |
| 128 | PACKET | LION | | | |
| 129 | JACK | ACE | | | |
| 130 | TEN | QUEEN | | | |
| 131 | FEATURE | FEATURE | | | |
| 132 | NINE | KING | | | |
| 133 | PACKET | LION | | | |
| 134 | JACK | ACE | | | |
| 135 | TEN | QUEEN | | | |
| 136 | FEATURE | FEATURE | | | |
| 137 | NINE | KING | | | |
| 138 | PACKET | LION | | | |
| 139 | JACK | ACE | | | |
| 140 | TEN | QUEEN | | | |
| 141 | FEATURE | FEATURE | | | |
| 142 | NINE | KING | | | |
| 143 | PACKET | LION | | | |
| 144 | JACK | ACE | | | |
| 145 | TEN | QUEEN | | | |
| 146 | FEATURE | FEATURE | | | |
| 147 | NINE | KING | | | |
| 148 | PACKET | LION | | | |
| 149 | JACK | ACE | | | |
| 150 | TEN | QUEEN | | | |

FIG.28

CHANCE MODE VIDEO REELS(WAYS BET4:81WAYS) NO. 4

| NO. | REEL 1 | REEL 2 | REEL 3 | REEL 4 | REEL 5 |
|---|---|---|---|---|---|
| 151 | FEATURE | FEATURE | | | |
| 152 | NINE | KING | | | |
| 153 | PACKET | LION | | | |
| 154 | JACK | ACE | | | |
| 155 | TEN | QUEEN | | | |
| 156 | FEATURE | FEATURE | | | |
| 157 | NINE | KING | | | |
| 158 | PACKET | LION | | | |
| 159 | JACK | ACE | | | |
| 160 | TEN | QUEEN | | | |
| 161 | FEATURE | FEATURE | | | |
| 162 | NINE | KING | | | |
| 163 | PACKET | LION | | | |
| 164 | JACK | ACE | | | |
| 165 | TEN | QUEEN | | | |
| 166 | FEATURE | FEATURE | | | |
| 167 | NINE | KING | | | |
| 168 | PACKET | LION | | | |
| 169 | JACK | ACE | | | |
| 170 | TEN | QUEEN | | | |
| 171 | FEATURE | FEATURE | | | |
| 172 | NINE | KING | | | |
| 173 | PACKET | LION | | | |
| 174 | JACK | ACE | | | |
| 175 | TEN | QUEEN | | | |

| NO. | REEL 1 | REEL 2 | REEL 3 | REEL 4 | REEL 5 |
|---|---|---|---|---|---|
| 176 | FEATURE | FEATURE | | | |
| 177 | NINE | KING | | | |
| 178 | PACKET | LION | | | |
| 179 | JACK | ACE | | | |
| 180 | TEN | QUEEN | | | |
| 181 | FEATURE | FEATURE | | | |
| 182 | NINE | KING | | | |
| 183 | PACKET | LION | | | |
| 184 | JACK | ACE | | | |
| 185 | TEN | QUEEN | | | |
| 186 | FEATURE | FEATURE | | | |
| 187 | NINE | KING | | | |
| 188 | PACKET | LION | | | |
| 189 | JACK | ACE | | | |
| 190 | TEN | QUEEN | | | |
| 191 | FEATURE | FEATURE | | | |
| 192 | NINE | KING | | | |
| 193 | PACKET | LION | | | |
| 194 | JACK | ACE | | | |
| 195 | TEN | QUEEN | | | |
| 196 | | | | | |
| 197 | | | | | |
| 198 | | | | | |
| 199 | | | | | |
| 200 | | | | | |

FIG.29

CHANCE MODE VIDEO REELS(WAYS BET5:243WAYS) NO. 1

| NO. | REEL 1 | REEL 2 | REEL 3 | REEL 4 | REEL 5 |
|---|---|---|---|---|---|
| 0 | FISH | NINE | PACKET | NINE | PHOENIX |
| 1 | ACE | JACK | KING | JACK | ACE |
| 2 | PHOENIX | WILD | FEATURE | WILD | FISH |
| 3 | QUEEN | NINE | ACE | NINE | KING |
| 4 | NINE | TEN | FISH | JACK | TURTLE |
| 5 | FISH | PHOENIX | TEN | LION | ACE |
| 6 | ACE | ACE | TURTLE | KING | QUEEN |
| 7 | KING | FISH | JACK | FISH | LION |
| 8 | PHOENIX | JACK | PACKET | TEN | JACK |
| 9 | ACE | TURTLE | NINE | PHOENIX | NINE |
| 10 | NINE | NINE | TURTLE | NINE | PACKET |
| 11 | LION | PACKET | KING | PACKET | TEN |
| 12 | ACE | ACE | TEN | ACE | KING |
| 13 | JACK | QUEEN | LION | FEATURE | TURTLE |
| 14 | LION | FEATURE | QUEEN | QUEEN | JACK |
| 15 | ACE | KING | NINE | FISH | NINE |
| 16 | PACKET | LION | PHOENIX | TEN | FEATURE |
| 17 | JACK | ACE | QUEEN | LION | QUEEN |
| 18 | TEN | QUEEN | TEN | ACE | ACE |
| 19 | FEATURE | TURTLE | WILD | KING | FISH |
| 20 | NINE | TEN | QUEEN | TURTLE | JACK |
| 21 | PACKET | FEATURE | TEN | ACE | ACE |
| 22 | JACK | QUEEN | PACKET | JACK | NINE |
| 23 | TEN | PACKET | ACE | FEATURE | TURTLE |
| 24 | TURTLE | NINE | PHOENIX | TEN | TEN |
| 25 | QUEEN | PHOENIX | QUEEN | PACKET | ACE |

| NO. | REEL 1 | REEL 2 | REEL 3 | REEL 4 | REEL 5 |
|---|---|---|---|---|---|
| 26 | FEATURE | TEN | FISH | KING | PACKET |
| 27 | NINE | KING | NINE | | QUEEN |
| 28 | PACKET | FISH | | | ACE |
| 29 | JACK | ACE | | | LION |
| 30 | TEN | QUEEN | | | TEN |
| 31 | FEATURE | FEATURE | | | FISH |
| 32 | NINE | KING | | | ACE |
| 33 | PACKET | LION | | | KING |
| 34 | JACK | ACE | | | |
| 35 | TEN | QUEEN | | | |
| 36 | FEATURE | FEATURE | | | |
| 37 | NINE | KING | | | |
| 38 | PACKET | LION | | | |
| 39 | JACK | ACE | | | |
| 40 | TEN | QUEEN | | | |
| 41 | FEATURE | FEATURE | | | |
| 42 | NINE | KING | | | |
| 43 | PACKET | LION | | | |
| 44 | JACK | ACE | | | |
| 45 | TEN | QUEEN | | | |
| 46 | FEATURE | FEATURE | | | |
| 47 | NINE | KING | | | |
| 48 | PACKET | LION | | | |
| 49 | JACK | ACE | | | |
| 50 | TEN | QUEEN | | | |

FIG.30

CHANCE MODE VIDEO REELS(WAYS BET5:243WAYS) NO. 2

| NO. | REEL 1 | REEL 2 | REEL 3 | REEL 4 | REEL 5 |
|---|---|---|---|---|---|
| 51 | FEATURE | FEATURE | | | |
| 52 | NINE | KING | | | |
| 53 | PACKET | LION | | | |
| 54 | JACK | ACE | | | |
| 55 | TEN | QUEEN | | | |
| 56 | FEATURE | FEATURE | | | |
| 57 | NINE | KING | | | |
| 58 | PACKET | LION | | | |
| 59 | JACK | ACE | | | |
| 60 | TEN | QUEEN | | | |
| 61 | FEATURE | FEATURE | | | |
| 62 | NINE | KING | | | |
| 63 | PACKET | LION | | | |
| 64 | JACK | ACE | | | |
| 65 | TEN | QUEEN | | | |
| 66 | FEATURE | FEATURE | | | |
| 67 | NINE | KING | | | |
| 68 | PACKET | LION | | | |
| 69 | JACK | ACE | | | |
| 70 | TEN | QUEEN | | | |
| 71 | FEATURE | FEATURE | | | |
| 72 | NINE | KING | | | |
| 73 | PACKET | LION | | | |
| 74 | JACK | ACE | | | |
| 75 | TEN | QUEEN | | | |

| NO. | REEL 1 | REEL 2 | REEL 3 | REEL 4 | REEL 5 |
|---|---|---|---|---|---|
| 76 | FEATURE | FEATURE | | | |
| 77 | NINE | KING | | | |
| 78 | PACKET | LION | | | |
| 79 | JACK | ACE | | | |
| 80 | TEN | QUEEN | | | |
| 81 | FEATURE | FEATURE | | | |
| 82 | NINE | KING | | | |
| 83 | PACKET | LION | | | |
| 84 | JACK | ACE | | | |
| 85 | TEN | QUEEN | | | |
| 86 | FEATURE | FEATURE | | | |
| 87 | NINE | KING | | | |
| 88 | PACKET | LION | | | |
| 89 | JACK | ACE | | | |
| 90 | TEN | QUEEN | | | |
| 91 | FEATURE | FEATURE | | | |
| 92 | NINE | KING | | | |
| 93 | PACKET | LION | | | |
| 94 | JACK | ACE | | | |
| 95 | TEN | QUEEN | | | |
| 96 | FEATURE | FEATURE | | | |
| 97 | NINE | KING | | | |
| 98 | PACKET | LION | | | |
| 99 | JACK | ACE | | | |
| 100 | TEN | QUEEN | | | |

FIG.31

CHANCE MODE VIDEO REELS(WAYS BET5:243WAYS) NO. 3

| NO. | REEL 1 | REEL 2 | REEL 3 | REEL 4 | REEL 5 |
|---|---|---|---|---|---|
| 101 | FEATURE | FEATURE | | | |
| 102 | NINE | KING | | | |
| 103 | PACKET | LION | | | |
| 104 | JACK | ACE | | | |
| 105 | TEN | QUEEN | | | |
| 106 | FEATURE | FEATURE | | | |
| 107 | NINE | KING | | | |
| 108 | PACKET | LION | | | |
| 109 | JACK | ACE | | | |
| 110 | TEN | QUEEN | | | |
| 111 | FEATURE | FEATURE | | | |
| 112 | NINE | KING | | | |
| 113 | PACKET | LION | | | |
| 114 | JACK | ACE | | | |
| 115 | TEN | QUEEN | | | |
| 116 | FEATURE | FEATURE | | | |
| 117 | NINE | KING | | | |
| 118 | PACKET | LION | | | |
| 119 | JACK | ACE | | | |
| 120 | TEN | QUEEN | | | |
| 121 | FEATURE | FEATURE | | | |
| 122 | NINE | KING | | | |
| 123 | PACKET | LION | | | |
| 124 | JACK | ACE | | | |
| 125 | TEN | QUEEN | | | |

| NO. | REEL 1 | REEL 2 | REEL 3 | REEL 4 | REEL 5 |
|---|---|---|---|---|---|
| 126 | FEATURE | FEATURE | | | |
| 127 | NINE | KING | | | |
| 128 | PACKET | LION | | | |
| 129 | JACK | ACE | | | |
| 130 | TEN | QUEEN | | | |
| 131 | FEATURE | FEATURE | | | |
| 132 | NINE | KING | | | |
| 133 | PACKET | LION | | | |
| 134 | JACK | ACE | | | |
| 135 | TEN | QUEEN | | | |
| 136 | FEATURE | FEATURE | | | |
| 137 | NINE | KING | | | |
| 138 | PACKET | LION | | | |
| 139 | JACK | ACE | | | |
| 140 | TEN | QUEEN | | | |
| 141 | FEATURE | FEATURE | | | |
| 142 | NINE | KING | | | |
| 143 | PACKET | LION | | | |
| 144 | JACK | ACE | | | |
| 145 | TEN | QUEEN | | | |
| 146 | FEATURE | FEATURE | | | |
| 147 | NINE | KING | | | |
| 148 | PACKET | LION | | | |
| 149 | JACK | ACE | | | |
| 150 | TEN | QUEEN | | | |

FIG.32

CHANCE MODE VIDEO REELS(WAYS BET5:243WAYS) NO. 4

| NO. | REEL 1 | REEL 2 | REEL 3 | REEL 4 | REEL 5 |
|---|---|---|---|---|---|
| 151 | FEATURE | FEATURE | | | |
| 152 | NINE | KING | | | |
| 153 | PACKET | LION | | | |
| 154 | JACK | ACE | | | |
| 155 | TEN | QUEEN | | | |
| 156 | FEATURE | FEATURE | | | |
| 157 | NINE | KING | | | |
| 158 | PACKET | LION | | | |
| 159 | JACK | ACE | | | |
| 160 | TEN | QUEEN | | | |
| 161 | FEATURE | FEATURE | | | |
| 162 | NINE | KING | | | |
| 163 | PACKET | LION | | | |
| 164 | JACK | ACE | | | |
| 165 | TEN | QUEEN | | | |
| 166 | FEATURE | FEATURE | | | |
| 167 | NINE | KING | | | |
| 168 | PACKET | LION | | | |
| 169 | JACK | ACE | | | |
| 170 | TEN | QUEEN | | | |
| 171 | FEATURE | FEATURE | | | |
| 172 | NINE | KING | | | |
| 173 | PACKET | LION | | | |
| 174 | JACK | ACE | | | |
| 175 | TEN | QUEEN | | | |

| NO. | REEL 1 | REEL 2 | REEL 3 | REEL 4 | REEL 5 |
|---|---|---|---|---|---|
| 176 | FEATURE | FEATURE | | | |
| 177 | NINE | KING | | | |
| 178 | PACKET | LION | | | |
| 179 | JACK | ACE | | | |
| 180 | TEN | QUEEN | | | |
| 181 | FEATURE | FEATURE | | | |
| 182 | NINE | KING | | | |
| 183 | PACKET | LION | | | |
| 184 | JACK | ACE | | | |
| 185 | TEN | QUEEN | | | |
| 186 | FEATURE | FEATURE | | | |
| 187 | NINE | KING | | | |
| 188 | PACKET | LION | | | |
| 189 | JACK | ACE | | | |
| 190 | TEN | QUEEN | | | |
| 191 | FEATURE | FEATURE | | | |
| 192 | NINE | KING | | | |
| 193 | PACKET | LION | | | |
| 194 | JACK | ACE | | | |
| 195 | TEN | QUEEN | | | |
| 196 | | | | | |
| 197 | | | | | |
| 198 | | | | | |
| 199 | | | | | |
| 200 | | | | | |

FIG.34

SYMBOL COMBINATION TABLE

| Symbol | Graphics | 1 | 2 | 3 | 4 | 5 |
|---|---|---|---|---|---|---|
| WILD | | 0 | 0 | 0 | 0 | 0 |
| PHOENIX | | 0 | 0 | 50 | 100 | 800 |
| LION | | 0 | 0 | 35 | 100 | 800 |
| FISH | | 0 | 0 | 30 | 100 | 800 |
| TURTLE | | 0 | 0 | 20 | 50 | 300 |
| PACKET | | 0 | 0 | 15 | 35 | 300 |
| ACE | A | 0 | 0 | 10 | 30 | 200 |
| KING | K | 0 | 0 | 10 | 20 | 200 |
| QUEEN | Q | 0 | 0 | 10 | 15 | 100 |
| JACK | J | 0 | 0 | 10 | 15 | 100 |
| TEN | 10 | 0 | 0 | 5 | 15 | 100 |
| NINE | 9 | 0 | 0 | 5 | 10 | 100 |
| FEATURE※ | | 0 | 0 | 5 | 10 | 50 |

※ PAYOUT + FREE GAME ARE AWARDED WHEN THREE OR MORE FEATURE SYMBOLS SUCCESSIVELY STOP FROM FIRST ARRAY AREA TO FIFTH ARRAY AREA, IRRESPECTIVE OF AREA ACTIVATED BY WAYS BET

FIG.35

(NORMAL MODE SHIFTING RANDOM DETERMINATION TABLE)

| No. | SHIFTING TARGET | CONDITION 1 | CONDITION 2 | CONDITION 3 | CONDITION 4 |
|---|---|---|---|---|---|
| 0 | NORMAL MODE IS MAINTAINED | 0/1000 | 200/1000 | 620/1000 | 999/1000 |
| 1 | SHIFTING TO CHANCE MODE | 1000/1000 | 800/1000 | 380/1000 | 1/1000 |
| | TOTAL | 1000/1000 | 1000/1000 | 1000/1000 | 1000/1000 |

(CHANCE MODE SHIFTING RANDOM DETERMINATION TABLE)

| No. | SHIFTING TARGET | CONDITION 1 | CONDITION 2 | CONDITION 3 | CONDITION 4 |
|---|---|---|---|---|---|
| 0 | SHIFTING TO NORMAL MODE | 0/1000 | 0/1000 | 0/1000 | 80/1000 |
| 1 | CHANCE MODE IS MAINTAINED | 1000/1000 | 1000/1000 | 1000/1000 | 920/1000 |
| | TOTAL | 1000/1000 | 1000/1000 | 1000/1000 | 1000/1000 |

FIG.36

(FREE GAME TYPE TABLE)

| TYPES OF FREE GAME | NUMBER OF GAME PLAY | WILD MULTIPLYING FACTORS | | |
|---|---|---|---|---|
| Free Game A | 30 | ID | MULTIPLYING FACTORS | RANDOM DETERMINATION PROBABILITIES |
| | | 0 | 1 | 244/1000 |
| | | 1 | 2 | 256/1000 |
| | | 2 | 3 | 500/1000 |
| Free Game B | 20 | ID | MULTIPLYING FACTORS | RANDOM DETERMINATION PROBABILITIES |
| | | 1 | 2 | 205/1000 |
| | | 2 | 3 | 251/1000 |
| | | 3 | 5 | 544/1000 |
| Free Game C | 15 | ID | MULTIPLYING FACTORS | RANDOM DETERMINATION PROBABILITIES |
| | | 2 | 3 | 300/1000 |
| | | 3 | 5 | 330/1000 |
| | | 4 | 8 | 370/1000 |
| Free Game D | 10 | ID | MULTIPLYING FACTORS | RANDOM DETERMINATION PROBABILITIES |
| | | 3 | 5 | 152/1000 |
| | | 4 | 8 | 238/1000 |
| | | 5 | 10 | 610/1000 |
| Free Game E | 8 | ID | MULTIPLYING FACTORS | RANDOM DETERMINATION PROBABILITIES |
| | | 4 | 8 | 310/1000 |
| | | 5 | 10 | 325/1000 |
| | | 6 | 15 | 365/1000 |
| Free Game F | 5 | ID | MULTIPLYING FACTORS | RANDOM DETERMINATION PROBABILITIES |
| | | 5 | 10 | 345/1000 |
| | | 6 | 15 | 305/1000 |
| | | 7 | 30 | 350/1000 |
| Free Game G (MYSTERY) | RANDOM DETERMINATION OF COMBINATION OF NUMBER OF GAME PLAY AND MULTIPLYING FACTOR | | | |

FIG.37

FREE GAME NUMBER – MULTIPLYING FACTOR DETERMINATION TABLE

| ID | NUMBER OF GAME PLAY | SETS OF MULTIPLYING FACTORS | WEIGHT | |
|---|---|---|---|---|
| | | | NORMAL | F_BOOST |
| 0 | 30 | IDENTICAL WITH FG A | 25 | 25 |
| 1 | 30 | IDENTICAL WITH FG B | 1 | 1 |
| 2 | 30 | IDENTICAL WITH FG C | 1 | 1 |
| 3 | 30 | IDENTICAL WITH FG D | 1 | 1 |
| 4 | 30 | IDENTICAL WITH FG E | 1 | 1 |
| 5 | 30 | IDENTICAL WITH FG F | 1 | 1 |
| 6 | 20 | IDENTICAL WITH FG A | 9 | 9 |
| 7 | 20 | IDENTICAL WITH FG B | 1 | 1 |
| 8 | 20 | IDENTICAL WITH FG C | 17 | 14 |
| 9 | 20 | IDENTICAL WITH FG D | 1 | 4 |
| 10 | 20 | IDENTICAL WITH FG E | 1 | 1 |
| 11 | 20 | IDENTICAL WITH FG F | 1 | 1 |
| 12 | 15 | IDENTICAL WITH FG A | 12 | 12 |
| 13 | 15 | IDENTICAL WITH FG B | 1 | 1 |
| 14 | 15 | IDENTICAL WITH FG C | 1 | 1 |
| 15 | 15 | IDENTICAL WITH FG D | 14 | 10 |
| 16 | 15 | IDENTICAL WITH FG E | 1 | 5 |
| 17 | 15 | IDENTICAL WITH FG F | 1 | 1 |
| 18 | 10 | IDENTICAL WITH FG A | 5 | 5 |
| 19 | 10 | IDENTICAL WITH FG B | 1 | 1 |
| 20 | 10 | IDENTICAL WITH FG C | 1 | 1 |
| 21 | 10 | IDENTICAL WITH FG D | 2 | 2 |
| 22 | 10 | IDENTICAL WITH FG E | 20 | 13 |
| 23 | 10 | IDENTICAL WITH FG F | 1 | 8 |
| 24 | 8 | IDENTICAL WITH FG A | 13 | 10 |
| 25 | 8 | IDENTICAL WITH FG B | 1 | 4 |
| 26 | 8 | IDENTICAL WITH FG C | 1 | 1 |
| 27 | 8 | IDENTICAL WITH FG D | 1 | 1 |
| 28 | 8 | IDENTICAL WITH FG E | 1 | 1 |
| 29 | 8 | IDENTICAL WITH FG F | 13 | 13 |
| 30 | 5 | IDENTICAL WITH FG A | 15 | 7 |
| 31 | 5 | IDENTICAL WITH FG B | 8 | 8 |
| 32 | 5 | IDENTICAL WITH FG C | 3 | 6 |
| 33 | 5 | IDENTICAL WITH FG D | 2 | 7 |
| 34 | 5 | IDENTICAL WITH FG E | 1 | 1 |
| 35 | 5 | IDENTICAL WITH FG F | 1 | 1 |
| | TOTAL | – | 180 | 180 |

FIG.38

(FEATURE BOOST : ADDITIONAL FG NUMBER RANDOM DETERMINATION TABLE)

| ID | add game | WEIGHT | | | | | |
|---|---|---|---|---|---|---|---|
| | | Free Game A | Free Game B | Free Game C | Free Game D | Free Game E | Free Game F |
| 0 | 10 | 7 | 6 | 15 | 30 | 50 | 80 |
| 1 | 15 | 7 | 6 | 20 | 30 | 25 | 3 |
| 2 | 20 | 7 | 14 | 20 | 24 | 10 | 2 |
| 3 | 25 | 7 | 14 | 20 | 2 | 2 | 2 |
| 4 | 30 | 8 | 12 | 8 | 2 | 3 | 2 |
| 5 | 35 | 8 | 6 | 3 | 2 | 2 | 2 |
| 6 | 40 | 8 | 6 | 2 | 2 | 2 | 2 |
| 7 | 45 | 8 | 6 | 2 | 2 | 1 | 2 |
| 8 | 50 | 8 | 6 | 2 | 2 | 1 | 1 |
| 9 | 55 | 8 | 6 | 2 | 1 | 1 | 1 |
| 10 | 60 | 8 | 6 | 2 | 1 | 1 | 1 |
| 11 | 65 | 8 | 6 | 2 | 1 | 1 | 1 |
| 12 | 70 | 8 | 6 | 2 | 1 | 1 | 1 |
| 13 | 75 | 0 | 0 | 0 | 0 | 0 | 0 |
| 14 | 80 | 0 | 0 | 0 | 0 | 0 | 0 |
| | TOTAL | 100 | 100 | 100 | 100 | 100 | 100 |

FIG.39

(PAYOUT RATE TABLE)

| Var | Denomination | PAYOUT RATE (RTP) | |
|---|---|---|---|
| | | MAX | MIN |
| 1 | $0.01 | 87.06% | 87.03% |
| 2 | $0.02 | 88.09% | 88.03% |
| 3 | $0.05 | 90.07% | 90.01% |
| 4 | $0.10 | 91.97% | 91.94% |
| 5 | $0.20 | 94.10% | 94.03% |
| 6 | $0.50 | 96.04% | 96.01% |
| 7 | $1.00 | 97.97% | 97.89% |

FIG.46
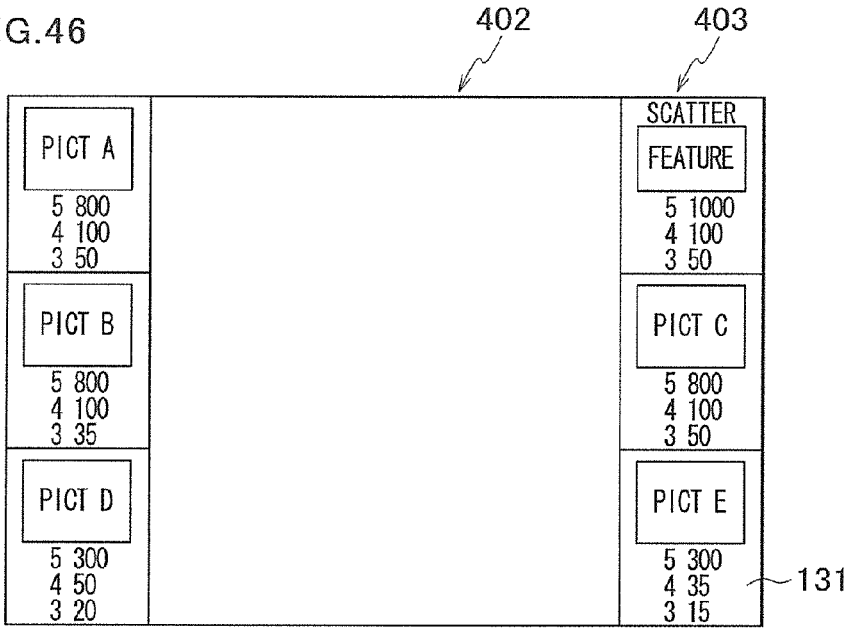
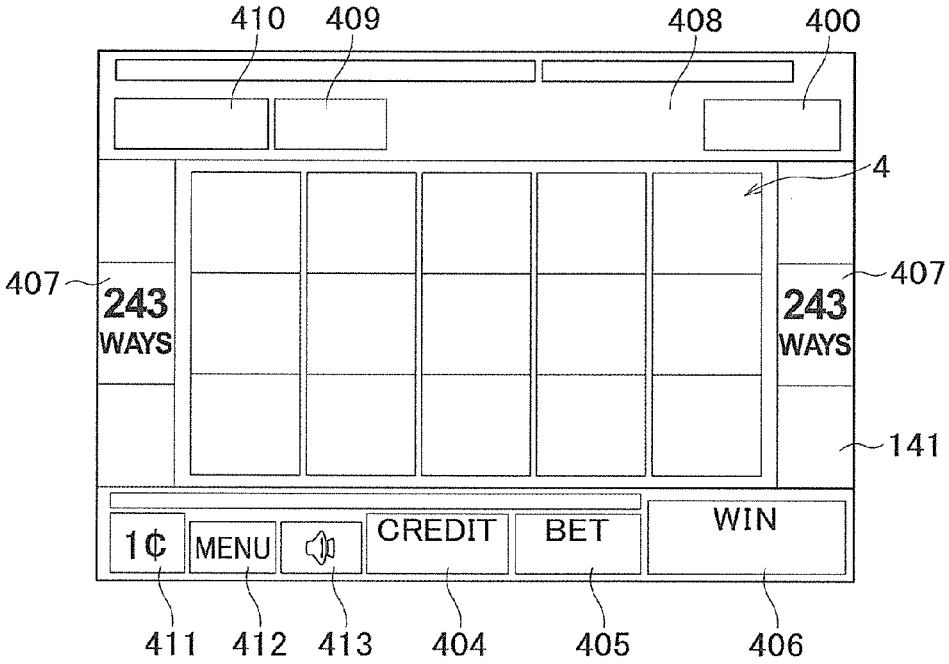

FIG.69
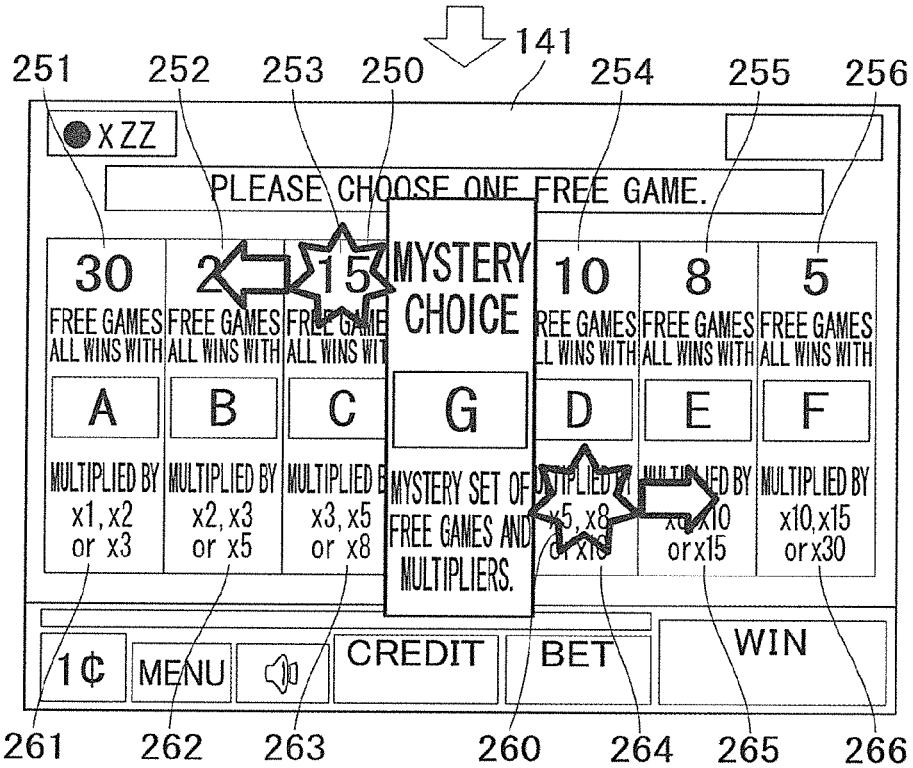
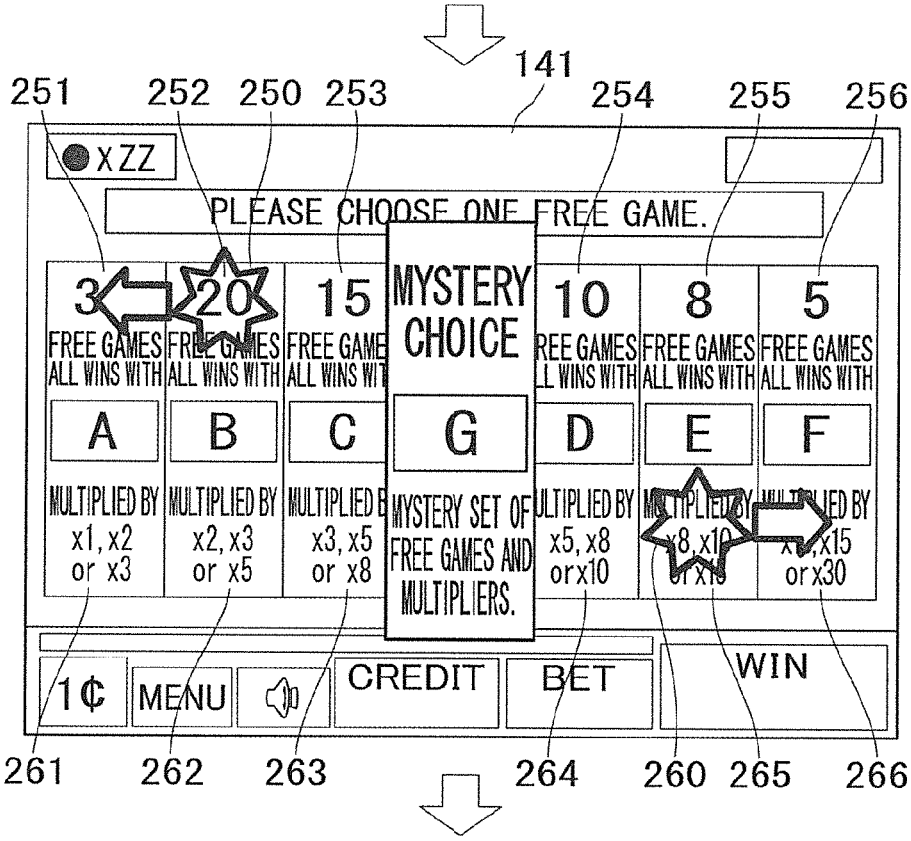

FIG.77

CHANCE MODE VIDEO REELS
(WAYS BET1 : 3WAYS)

| | REEL 1 | REEL 2 |
|---|---|---|
| 0 | FISH | NINE |
| 1 | ACE | JACK |
| 2 | PHOENIX | WILD |
| 3 | JACK | NINE |
| 4 | KING | TEN |
| 5 | TURTLE | PHOENIX |
| 6 | TEN | ACE |
| 7 | LION | FISH |
| 8 | JACK | JACK |
| 9 | NINE | TURTLE |
| 10 | PACKET | NINE |
| 11 | JACK | PACKET |
| 12 | ACE | ACE |
| 13 | FISH | QUEEN |
| 14 | KING | FEATURE |
| 15 | QUEEN | KING |
| 16 | LION | LION |
| 17 | JACK | ACE |
| 18 | TEN | QUEEN |
| 19 | FEATURE | TURTLE |
| 20 | NINE | TEN |
| 21 | PACKET | FEATURE |
| 22 | JACK | QUEEN |
| 23 | TEN | PACKET |
| 24 | TURTLE | NINE |
| 25 | JACK | KING |
| 26 | FEATURE | PHOENIX |
| 27 | NINE | TEN |
| 28 | PACKET | FISH |
| 29 | JACK | ACE |
| 30 | TEN | QUEEN |
| 31 | FEATURE | FEATURE |
| 32 | NINE | KING |
| 33 | PACKET | LION |
| 34 | JACK | ACE |

601

602

NORMAL MODE VIDEO REELS
(WAYS BET1 : 3WAYS)

| | REEL 4 | REEL 5 |
|---|---|---|
| 0 | FISH | NINE |
| 1 | ACE | JACK |
| 2 | PHOENIX | WILD |
| 3 | JACK | NINE |
| 4 | KING | TEN |
| 5 | TURTLE | PHOENIX |
| 6 | TEN | ACE |
| 7 | LION | FISH |
| 8 | JACK | JACK |
| 9 | NINE | TURTLE |
| 10 | PACKET | NINE |
| 11 | JACK | PACKET |
| 12 | ACE | ACE |
| 13 | FISH | QUEEN |
| 14 | KING | FEATURE |
| 15 | QUEEN | KING |
| 16 | LION | LION |
| 17 | JACK | ACE |
| 18 | TEN | QUEEN |
| 19 | FEATURE | TURTLE |
| 20 | NINE | TEN |
| 21 | PACKET | FEATURE |
| 22 | JACK | QUEEN |
| 23 | TEN | PACKET |
| 24 | TURTLE | NINE |
| 25 | JACK | KING |
| 26 | | PHOENIX |
| 27 | | TEN |
| 28 | | FISH |
| 29 | | |
| 30 | | |
| 31 | | |
| 32 | | |
| 33 | | |
| 34 | | |

RANDOM DETERMINATION FOR SWITCHING TO A CHANCE MODE USING A CHANCE MODE VIDEO REEL

CROSS-REFERENCE TO RELATED APPLICATION

This application claims the benefit of Japanese Pat. App. No. 2015-188996, filed on Sep. 25, 2015, which application is incorporated herein by reference in its entirety.

FIELD OF THE INVENTION

Background of the Invention

As a typical gaming machine, a slot machine is arranged such that, as a player presses a button on a control panel, reels on which symbols are provided are scrolled and then stopped, with the result that the symbols are rearranged.

A type of such slot machines is arranged such that, after each reel is rotated and stopped, symbols are rearranged at equal probabilities (see e.g., Patent Literature 1 (Japanese Unexamined Patent Publication No. 2015-051331)). For example, when 22 symbols are arranged on a reel, the probability that each of 22 symbols is rearranged is 1/22.

BRIEF SUMMARY OF THE INVENTION

In such a slot machine, however, because the probability of rearrangement is identical in all symbols, the symbols are rearranged at the same probabilities in each game play, with the result that the game progress may be monotonous.

An object of the present invention is to provide a gaming machine which makes it possible to improve monotonous game play.

The present invention relates to a gaming machine including: a display device configured to display a game result by rearranging symbols arranged on video reels;

a storage device configured to store a normal mode video reel on which the symbols including a predetermined symbol are arranged and a chance mode video reel on which the number of the predetermined symbol is larger than the number of the predetermined symbol on the normal mode video reel; and a controller configured to perform switching between a game in a normal mode using the normal mode video reel and a game in a chance mode using the chance mode video reel, when a predetermined condition is satisfied.

According to the arrangement above, in the game in the normal mode, a game result is displayed by rearranging symbols arranged on the normal mode video reel. After the predetermined condition is satisfied and the shifting from the normal mode to the chance mode occurs, a game result is displayed by rearranging symbols by using the chance mode video reel on which the number of the predetermined symbol is larger than in the normal mode video reel. On this account, when the predetermined condition is satisfied, the switching from the normal mode to the chance mode is performed and hence a probability of rearrangement of the predetermined symbol is increased. With this, the probability of rearrangement of the predetermined symbol on the display device is increased after the switching to the chance mode, with the result that monotonousness in the game play is resolved.

The gaming machine of the present invention is arranged such that, the predetermined condition is a case where a combination of the symbols rearranged on the display device is a predetermined combination of the symbols, and when a combination of the symbols rearranged on the display device is the predetermined combination, the controller executes the switching between the game in the normal mode and the game in the chance mode based on random determination.

According to the arrangement above, the switching between the game in the normal mode and the game in the chance mode is executed based on whether a combination of symbols displayed on the display device is a predetermined combination of symbols and on random determination. Therefore, even if a predetermined combination of symbols is rearranged, the switching between the game in the normal mode and the game in the chance mode is not always carried out in the same way, and hence monotonousness in the game play is avoided.

In the present invention, the above-described gaming machine is arranged such that there are plural predetermined combinations of symbols, the storage device is configured to store a switching random determination table in which probabilities of execution of the switching between the game in the normal mode and the game in the chance mode are associated with the predetermined combinations of the symbols, respectively, when a combination of the symbols rearranged on the display device is a predetermined combination of the symbols, the controller executes the switching between the game in the normal mode and the game in the chance mode based on random determination with reference to the switching random determination table.

According to the arrangement above, because the probability of performing switching between the game in the normal mode and the game in the chance mode is determined based on the type of the predetermined combination of the symbols, interest in a combination of rearranged symbols is enhanced and monotonousness in the game progress may be resolved.

In the present invention, the above-described gaming machine is arranged such that in the switching random determination table, a probability of execution of the switching between the game in the normal mode and the game in the chance mode is high when a probability of rearrangement of the predetermined combination of symbols is low.

According to the arrangement above, when a predetermined combination of symbols which is less probable to be rearranged is rearranged on the display device, the probability of execution of the switching between the game in the normal mode and the game in the chance mode is high. This enhances interest in a predetermined combination of symbols which is less probable to be rearranged, with the result that monotonousness in the game progress is resolved.

In addition to the above, the above-described gaming machine of the present invention is arranged such that in the game in the chance mode, the controller is configured to display the chance mode video reel on the display device so that a part of the predetermined symbol overlaps a symbol adjacent to the predetermined symbol.

According to the arrangement above, because in the game in the chance mode the predetermined symbol is displayed to partially overlap an adjacent symbol, it is easy to distinguish the predetermined symbol from the other symbols when, for example, the video reel is scrolling or stops. This makes it possible to emphasize that the game is in the chance mode in which the probability of rearrangement of the predetermined symbol is high when the predetermined symbol is displayed to partially overlap the adjacent symbol.

In addition to the above, the above-described gaming machine of the present invention is arranged such that the display device is provided with a frame which is capable of encompassing a predetermined number of symbols successively arranged in an up-down direction on a video reel, and in the game in the chance mode, the controller is configured to display the chance mode video reel on the display device so that a part of the predetermined symbol overlaps background of each of symbols immediately above and below the predetermined symbol.

According to the arrangement above, in the game in the chance mode. when the predetermined symbol is not rearranged in the frame of the display device and is rearranged immediately above or below the frame of the display device, a part of the predetermined symbol is displayed in the frame to be behind the symbol which is rearranged in the frame and is immediately above or below the predetermined symbol. On this account, the presence of the predetermined symbol is emphasized even if the predetermined symbol is not rearranged in the frame of the display device.

In addition to the above, the above-described gaming machine of the present invention is arranged such that when the predetermined symbol is rearranged inside the frame of the display device, the controller is configured to display another part of the predetermined symbol to overlap a front surface of the frame of the display device.

According to the arrangement above, when the predetermined symbol is rearranged inside the frame of the display device, another part of the predetermined symbol is displayed to overlap the front surface of the frame of the display device. This makes it possible to emphasize the presence of the predetermined symbol.

A gaming machine which makes it possible to improve monotonous game play is provided.

BRIEF DESCRIPTION OF THE DRAWINGS

The nature and mode of operation of the present invention will now be more fully described in the following detailed description of the invention taken with the accompanying drawing figures, in which:

FIG. 8 shows symbol arrays on normal mode video reels (WAYS BET1) of the slot machine of the embodiment of the present invention.

FIG. 9 shows symbol arrays on normal mode video reels (WAYS BET2) of the slot machine of the embodiment of the present invention.

FIG. 10 shows symbol arrays on normal mode video reels (WAYS BET5) of the slot machine of the embodiment of the present invention.

FIG. 11 shows symbol arrays on normal mode video reels (WAYS BET4) of the slot machine of the embodiment of the present invention.

FIG. 12 shows symbol arrays on normal mode video reels (WAYS BET5) of the slot machine of the embodiment of the present invention.

FIG. 13 shows symbol arrays on chance mode video reels (WAYS BET1) of the slot machine of the embodiment of the present invention.

FIG. 14 shows symbol arrays on chance mode video reels (WAYS BET1) of the slot machine of the embodiment of the present invention.

FIG. 15 shows symbol arrays on chance mode video reels (WAYS BET1) of the slot machine of the embodiment of the present invention.

FIG. 16 shows symbol arrays on chance mode video reels (WAYS BET1) of the slot machine of the embodiment of the present invention.

FIG. 17 shows symbol arrays on chance mode video reels (WAYS BET2) of the slot machine of the embodiment of the present invention.

FIG. 18 shows symbol arrays on chance mode video reels (WAYS BET2) of the slot machine of the embodiment of the present invention.

FIG. 19 shows symbol arrays on chance mode video reels (WAYS BET2) of the slot machine of the embodiment of the present invention.

FIG. 20 shows symbol arrays on chance mode video reels (WAYS BET2) of the slot machine of the embodiment of the present invention.

FIG. 21 shows symbol arrays on chance mode video reels (WAYS BET3) of the slot machine of the embodiment of the present invention.

FIG. 22 shows symbol arrays on chance mode video reels (WAYS BET3) of the slot machine of the embodiment of the present invention.

FIG. 23 shows symbol arrays on chance mode video reels (WAYS BET3) of the slot machine of the embodiment of the present invention.

FIG. 24 shows symbol arrays on chance mode video reels (WAYS BET3) of the slot machine of the embodiment of the present invention.

FIG. 25 shows symbol arrays on chance mode video reels (WAYS BET4) of the slot machine of the embodiment of the present invention.

FIG. 26 shows symbol arrays on chance mode video reels (WAYS BET4) of the slot machine of the embodiment of the present invention.

FIG. 27 shows symbol arrays on chance mode video reels (WAYS BET4) of the slot machine of the embodiment of the present invention.

FIG. 28 shows symbol arrays on chance mode video reels (WAYS BET4) of the slot machine of the embodiment of the present invention.

FIG. 29 shows symbol arrays on chance mode video reels (WAYS BET5) of the slot machine of the embodiment of the present invention.

FIG. 30 shows symbol arrays on chance mode video reels (WAYS BET5) of the slot machine of the embodiment of the present invention.

FIG. 31 shows symbol arrays on chance mode video reels (WAYS BET5) of the slot machine of the embodiment of the present invention.

FIG. 32 shows symbol arrays on chance mode video reels (WAYS BET5) of the slot machine of the embodiment of the present invention.

FIG. 34 shows a symbol combination table of the slot machine of the embodiment of the present invention.

FIG. 35 shows shifting random determination tables in the normal mode and in the chance mode of the slot machine of the embodiment of the present invention.

FIG. 36 shows a free game type table in the slot machine of the embodiment of the present invention.

FIG. 37 shows a free game number-multiplying factor determination table in the slot machine of the embodiment of the present invention.

FIG. 38 shows an additional FG number random determination table of the slot machine of the embodiment of the present invention.

FIG. 39 shows a payout rate table in the slot machine of the embodiment of the present invention.

FIG. 46 shows the screen display specification in the game in the slot machine of the embodiment of the present invention.

FIG. 69 shows an effect in the mystery random determination process in the slot machine of the embodiment of the present invention.

FIG. 77 illustrates a reverse appeal rewriting process in the embodiment of the present invention.

DETAILED DESCRIPTION OF THE PREFERRED EMBODIMENT (Outline of Present Invention)

Figure 1:
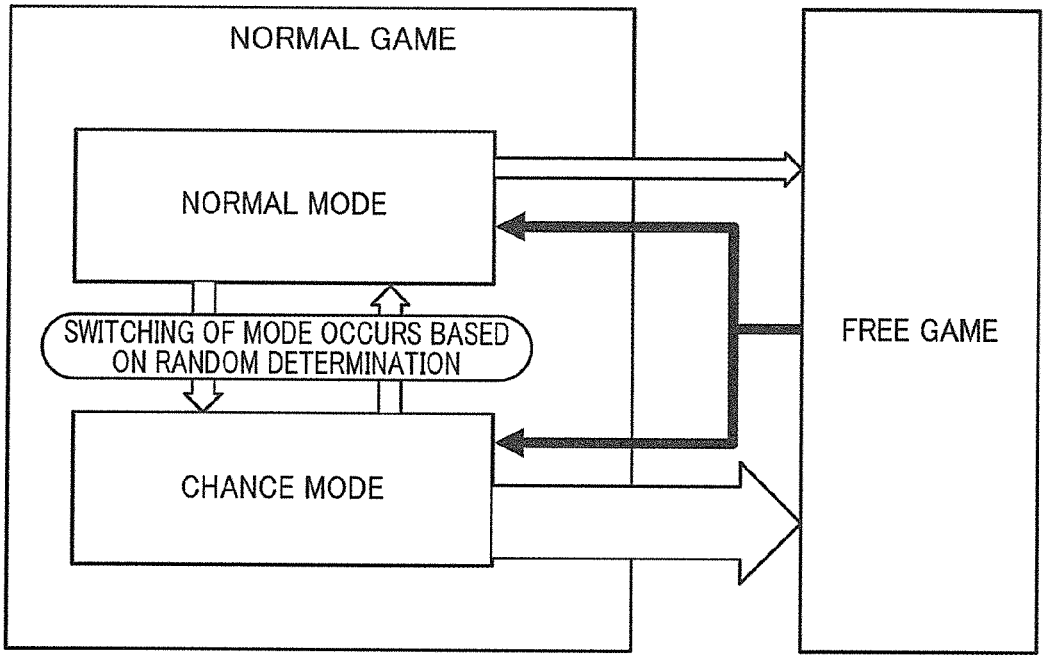
FIG. 1 shows the outline of game content of a slot machine according to an embodiment of the present invention.

The following will describe an embodiment the present invention with reference to figures. FIG. 1 shows the outline of a game flow of a slot machine according to the embodiment of the present invention. As shown in FIG. 1, in the slot machine of the embodiment of the present invention, a normal game (slot game) is run in such a way that a game in a normal mode and a game in a chance mode are shifted (switched) based on random determination. Both in the game in the normal mode and the game in the chance mode, a free game is awarded when a predetermined condition is satisfied. In the chance mode, a probability of shifting to the free game is high as compared to the normal mode.

The slot games employ video reels displayed on a display. On the video reels, images of five reels are displayed. That is to say, the video reels are formed of images of a first reel, a second reel, a third reel, a fourth reel, and a fifth reel. In the present embodiment, "Left to Right" type with a different active area in response to a bet is adopted for determining the winning.

In the normal mode, symbols to be rearranged in a display window are randomly selected from symbols including a predetermined symbol arranged on the normal mode video reels. The selected symbols are rearranged in the display window, result determination is performed, and a benefit is awarded in accordance with a combination of the rearranged symbols. When a combination of the predetermined symbol is established in the result determination, a free game is awarded.

In the chance mode, symbols to be rearranged in a display window are randomly selected from symbols arranged on the chance mode video reels. The selected symbols are rearranged in the display window, result determination is performed, and a benefit is awarded in accordance with a combination of the rearranged symbols. When a combination of the predetermined symbol is established in the result determination, a free game is awarded. On the chance mode video reels, the number of the predetermined symbol is larger than the number on the normal mode video reels. On this account, in the chance mode, a probability of shifting to the free game is high as compared to the normal mode.

Both in the game in the normal mode and the game in the chance mode, switching between the game in the normal mode and the game in the chance mode is randomly performed when rearranged symbols satisfy a predetermined condition in the result determination.

In the free game, a game not requiring further betting is run. The free game is not particularly limited to a specific game. In the present embodiment, a slot game is run in the free game in the same manner as in the normal game.

Definitions

While in the present embodiment the slot machine 1 is an example of the gaming machine, the slot machine 1 is not limited to this. The normal game in the present embodiment is run by the slot machine 1. The normal game is a slot game of rearranging symbols. The rearrangement of the symbols in the slot game is performed by the video reels. In the normal game, on condition that a gaming value is bet, symbols are rearranged in the display window by the video reels, and a payout is awarded according to the rearranged symbols. In the present embodiment, the free game may be any type of game, provided that the free game provides a player with a different gaming state from that of the normal game. The "free game" is a game runnable with a bet of fewer gaming values than the normal game. Note that "bet of fewer gaming values" encompasses a bet of zero (0) gaming value. The "free game" therefore may be a game runnable without a bet of a gaming value, which free game awards an amount of gaming values based on symbols rearranged. In other words, the "free game" may be a game which is started without consumption of a gaming value. To the contrary, the "normal game" is a game runnable on condition that a gaming value is bet, which normal game awards an amount of gaming value based on the symbols rearranged. In other words, the "normal game" is a game which starts with consumption of a gaming value. Further, the "free game" is a game to which transition occurs when a predetermined condition (free game trigger) is satisfied in the normal game.

The symbols encompasses "PHOENIX", "LION", "FISH", "TURTLE", "PACKET", "ACE", "KING", "QUEEN", "JACK", "TEN", "NINE", "WILD", and "FEATURE".

The gaming value is electrically valuable information such as electronic money and the like. It is to be noted that the gaming value in the disclosure is not limited to these, and for example a gaming medium such as a medal, a token, a coin, a ticket or the like can be adopted. The ticket is not particularly limited, and for example, a ticket having data of credit amount and the like in the form of bar code. Alternatively, the gaming value may be a game point not including valuable information.

The term "rearrangement" indicates that the symbols are rearranged after the arrangement of the symbols is dismissed. Arrangement means a state where the symbols can be visually confirmed by a player. More specifically, "rearrangement" is a state in which, after the symbols on the reels are variably displayed as the reels rotate, the variable display of the symbols stops as the rotation of the reels stops, and the symbols stop in the display window.

(Functional Flow)

Figure 2:
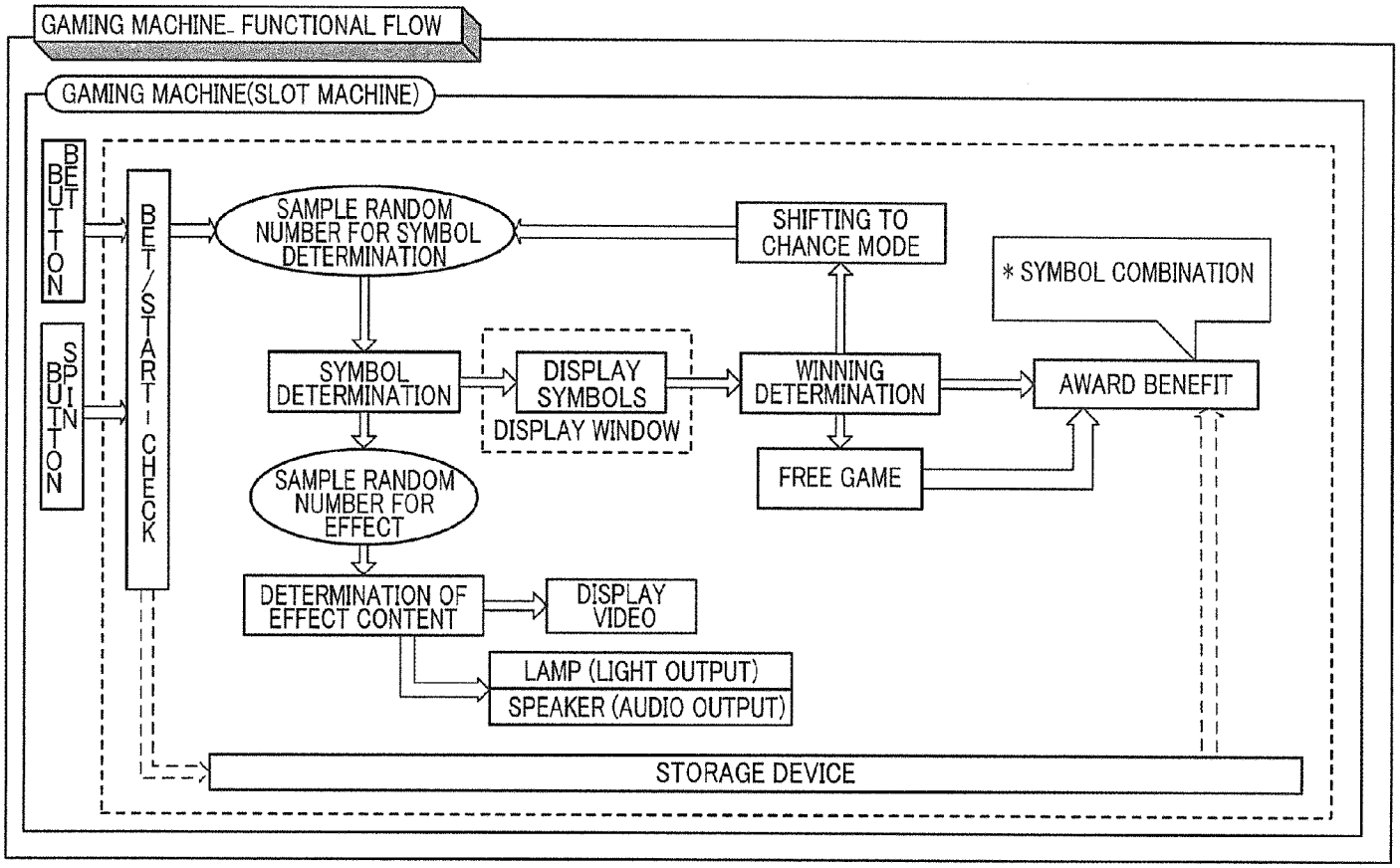
FIG. 2 shows a functional flow of the slot machine of the embodiment of the present invention.

The following describes basic functions of the slot machine related to the embodiment of the present invention, with reference to FIG. 2. FIG. 2 is a diagram showing functional flow of the slot machine related to the embodiment of the present invention.

<Bet/Start-Check>

First, the slot machine checks whether or not a BET button has been pressed by a player, and subsequently checks whether or not a spin button has been pressed by the player.

<Symbol Determination>

Subsequently, in the slot machine, when the spin button is pressed by the player, symbols to be rearranged in the display window are randomly selected from symbols including a predetermined symbol arranged on the normal mode video reels.

<Reel Display Control>

Thereafter, the slot machine starts the rotation of each reel and stops the rotation of each reel so that the determined symbols are displayed for the player through the display window (symbol display).

<Winning Determination>

Subsequently, as the rotation of each reel is stopped, the slot machine determines whether the combination of the symbols displayed for the player is a combination related to winning.

<Awarding Benefit>

When the combination of the symbols displayed for the player is a combination related to winning, the slot machine offers, to the player, benefit according to the type of the combination. For example, when a combination of symbols related to awarding of a credit is displayed, the slot machine awards credits to the player, the amount of which corresponds to the combination of the symbols. In the normal mode, when a combination of a predetermined symbol is established, a free game is awarded.

When a predetermined condition is satisfied in winning determination, the slot machine is shifted from the normal mode to the chance mode as a result of random determination. In the chance mode, symbols to be rearranged in a display window are randomly selected from symbols arranged on the chance mode video reels. In the chance mode, when a combination of a predetermined symbol is established, a free game is awarded.

The slot machine may have other benefits such as a mystery bonus and insurance. In the mystery bonus, a predetermined number of coins are paid out when a winning is achieved in dedicated random determination. When a spin button is pressed, the slot machine samples a random number for the mystery bonus, and whether a mystery bonus trigger is established is randomly determined.

The insurance is a function for saving the player when the free game is not executed for a long period of time. Whether the insurance is activated or not is freely determined by an administrator of the slot machine. When the insurance is activated, a predetermined insurance activation amount must be paid. When the insurance is activated, the slot machine starts to count the number of plays of the game. When the counted number of plays reaches a predetermined number without a large amount of payout, the slot machine pays out coins, the amount of which has been set for the insurance.

<Determination of Effect>

The slot machine produces an effect by displaying an image on a display, outputting light from a lamp, and outputting sound from a speaker. The slot machine samples an effect-use random number and determines the content of an effect based on randomly determined symbols or the like.

[Overall Structure of Game System]

Figure 3:
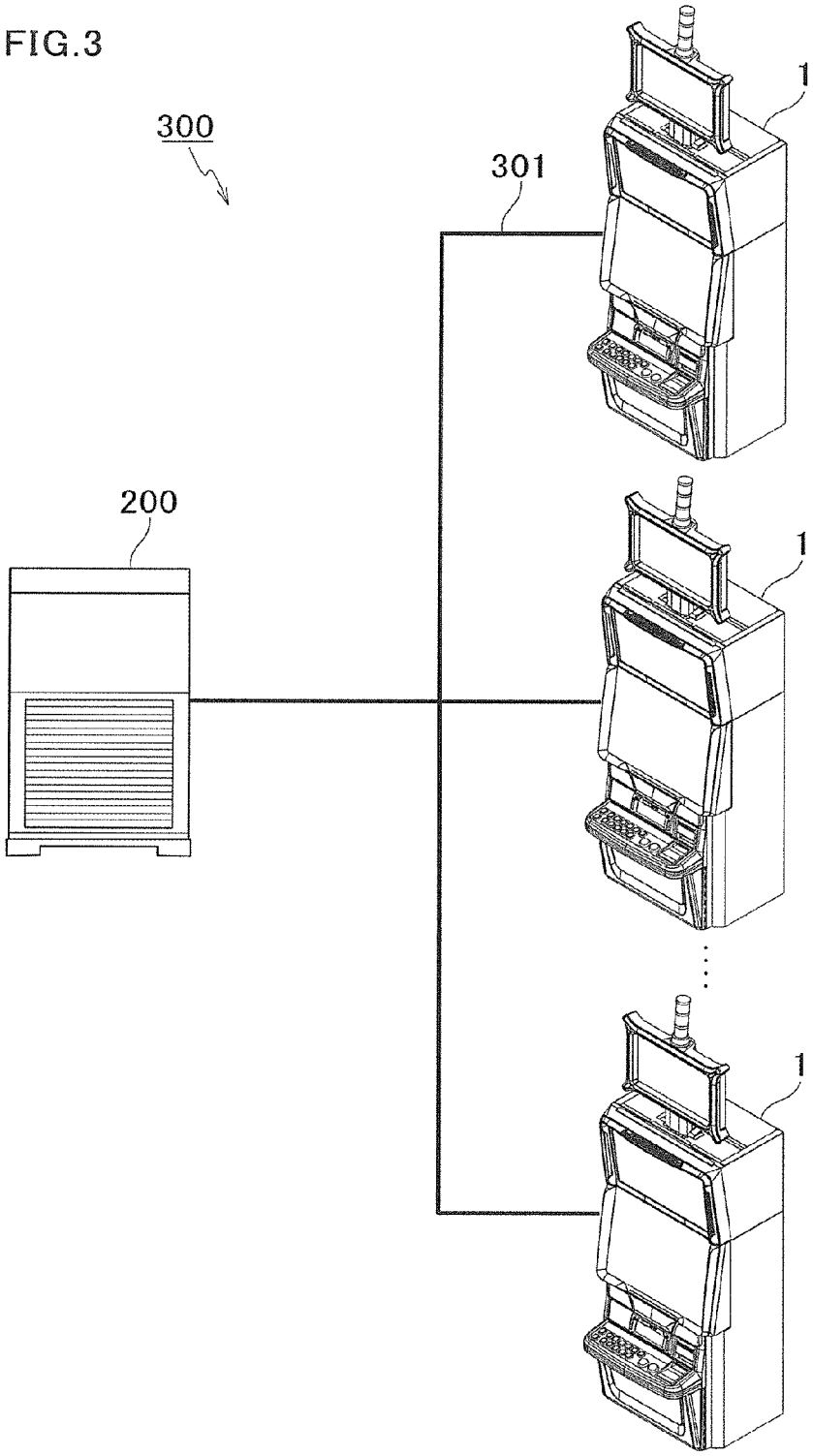
FIG. 3 shows a game system including the slot machine of the embodiment of the present invention.

The basic functions of the slot machine have been described as above. Now, referring to FIG. 3, a game system including the slot machine will be described. FIG. 3 shows a game system including the slot machine of the embodiment of the present invention.

A game system 300 includes a plurality of slot machines 1 and an external controller 200 connected with the slot machines 1 via a communication line 301.

The external controller 200 is for controlling the plurality of slot machines 1. In the embodiment of the present invention, the external controller 200 is a so-called hall server installed in a gaming facility where the plurality of slot machines 1 are provided. Each of the slot machines 1 has a unique identification number, and the external controller 200 identifies which one of the slot machines 1 transmitted data, by referring to the identification number. Further, the external controller 200 determines transmission target of data with the identification number when transmitting data to a slot machine 1.

It is to be noted that the game system 300 may be constructed within a single gaming facility where various games can be performed, such as a casino, or may be constructed among a plurality of gaming facilities. Further, when the game system 300 is constructed in a single gaming facility, the gaming system may be constructed in each floor or section of the gaming facility. The communication line 301 may be a wired or wireless line, and can adopt a dedicated line, an exchange line or the like.

The game system 300 is of a network type in which the slot machines 1 are connected with the external controller 200 by a communication line 301, but the game system 300 may be of a standalone type in which each slot machine 1 independently executes a game.

[Overall Structure of Slot Machine]

Figure 4:
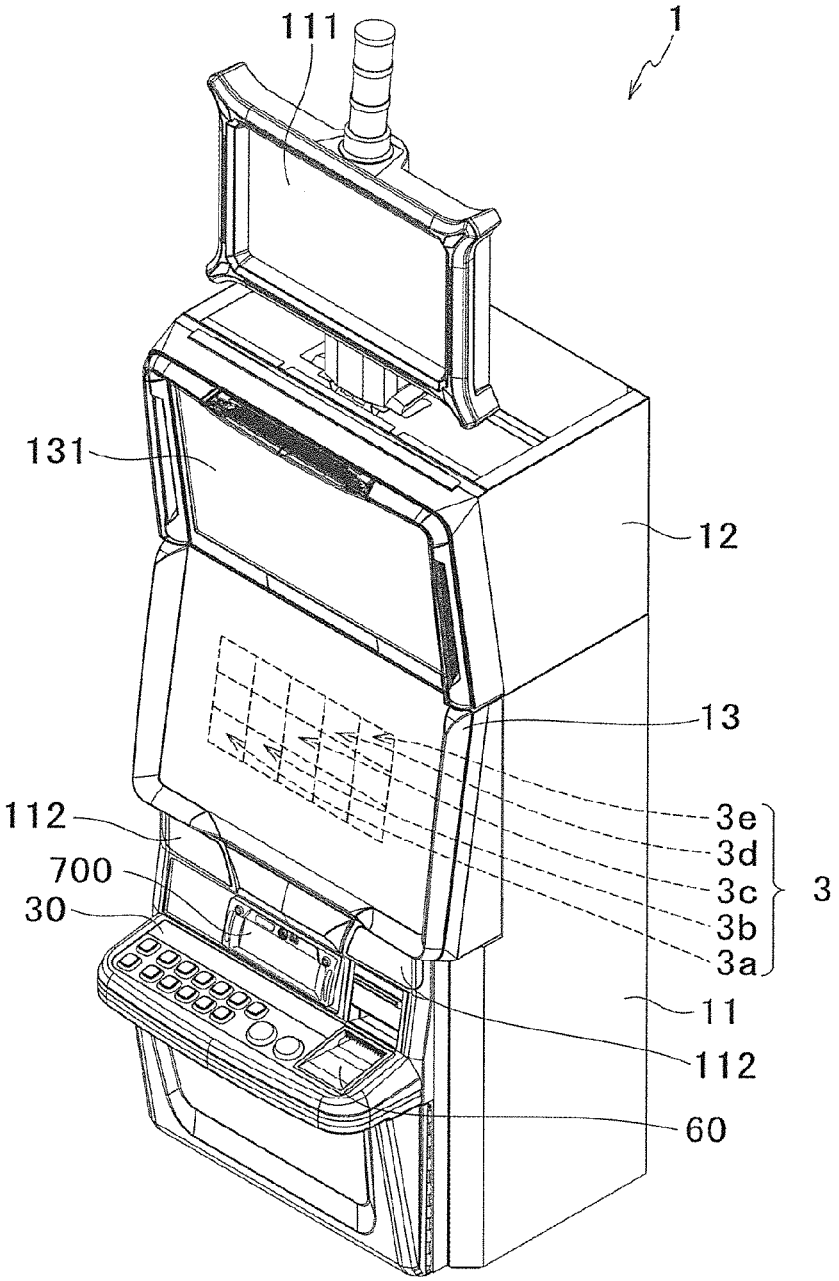
FIG. 4 shows the overall structure of the slot machine of the embodiment of the present invention.
Figure 5:
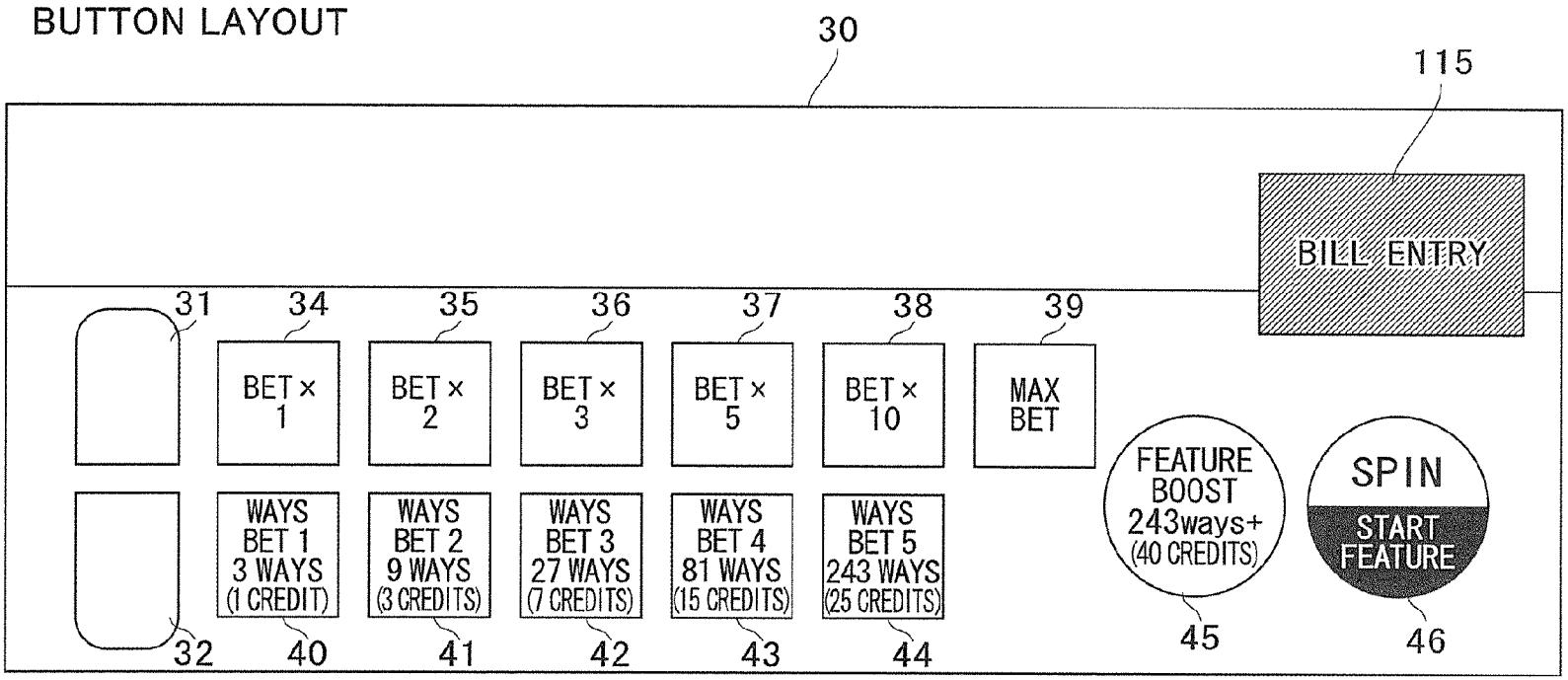
FIG. 5 shows a control panel of the slot machine of the embodiment of the present invention.

Now, referring to FIG. 4, the overall structure of the slot machine 1 will be described. FIG. 4 shows the overall structure of the slot machine of the embodiment of the present invention.

Electrically valuable information such as electronic money is used as a gaming value in the slot machine 1. It is to be noted that the gaming value is not limited to these, and for example a coin, a medal, a token, a ticket with a bar code and the like can be adopted.

The slot machine 1 includes a cabinet 11, a top box 12 installed on the upper side of the cabinet 11, and a main door 13 provided at the front surface of the cabinet 11. Above the top box 12, a digital signage 111 is provided.

Figure 6:
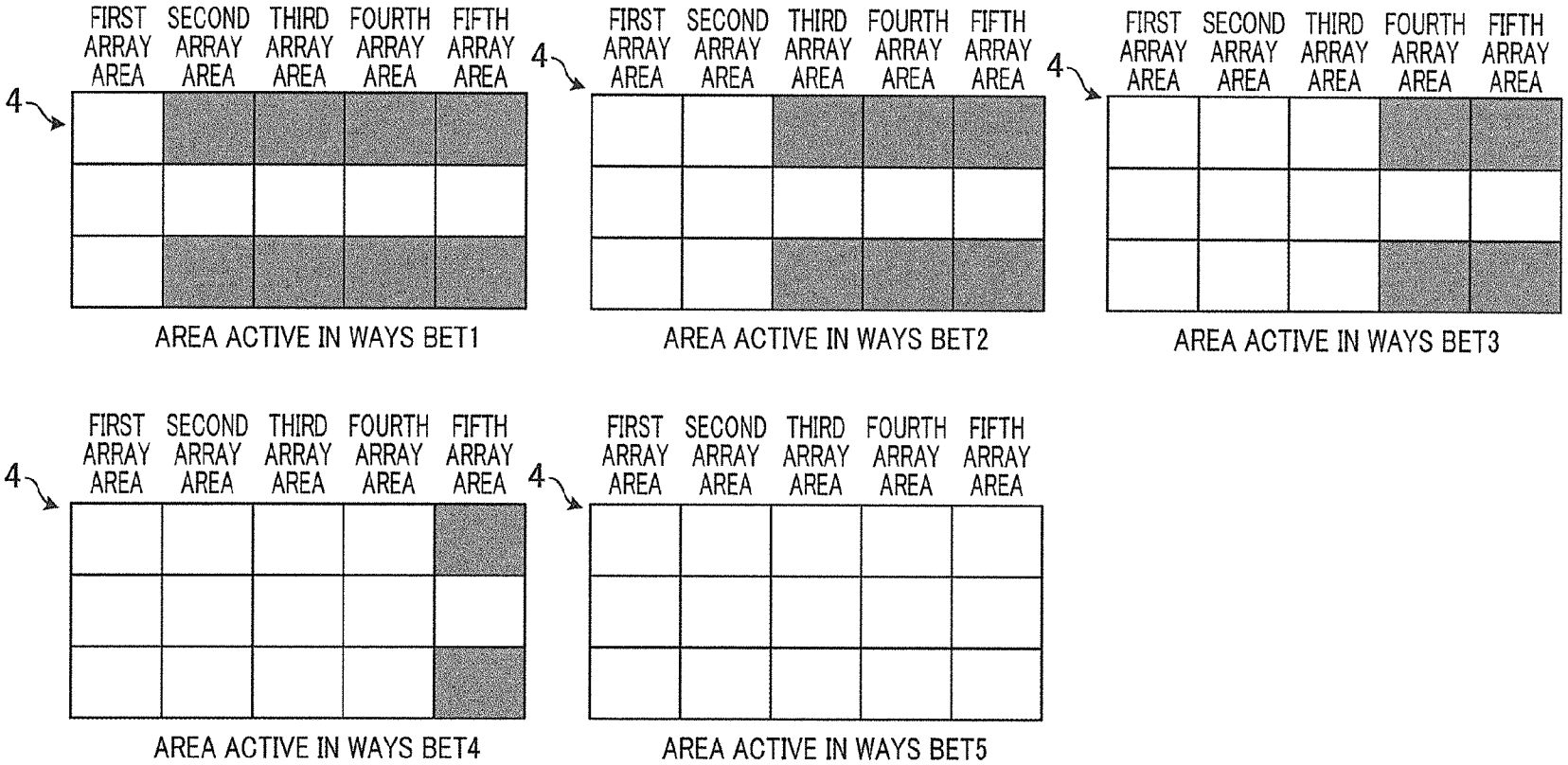
FIG. 6 illustrates active areas in "WAYS BET" in the slot machine of the embodiment of the present invention.
Figure 7:
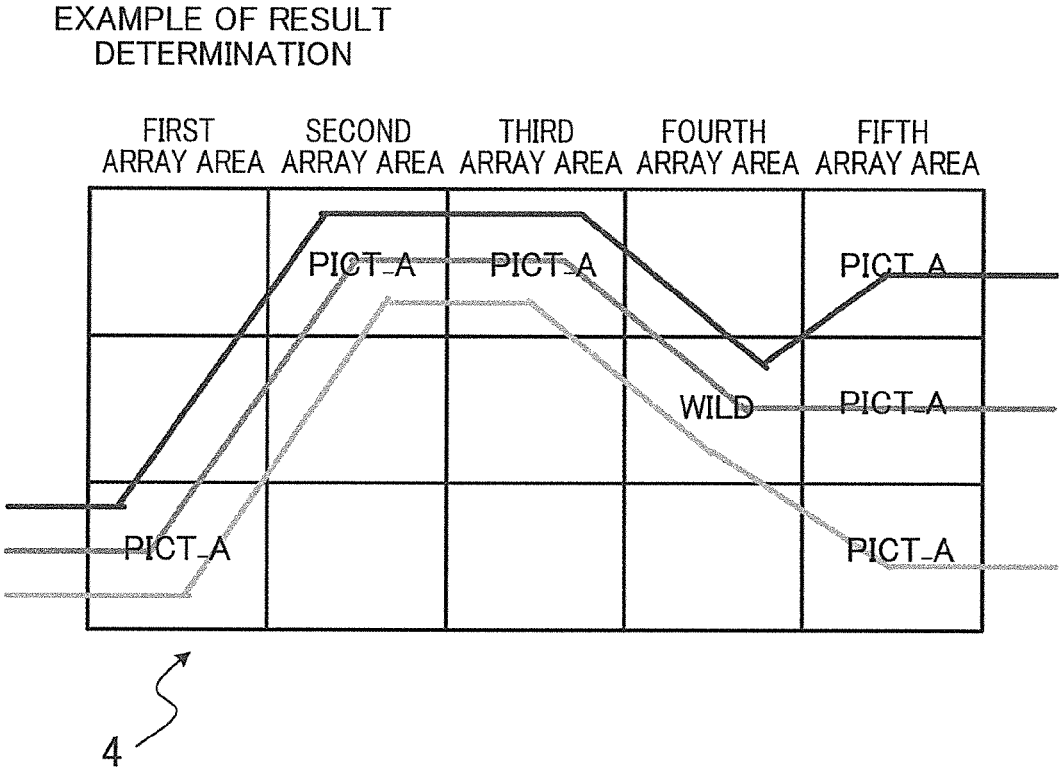
FIG. 7 illustrates examples of result determination of "WAYS BET" in the slot machine of the embodiment of the present invention.

At the center of the main door 13, a lower image display panel 141 is provided. The lower image display panel 141 is a liquid crystal panel and constitute a display. The lower image display panel 141 has a symbol display area 4. The symbol display area 4 includes five column areas (first array area to fifth array area) each of which is divided into three areas: the upper stage, the middle stage, and the lower stage, as shown in FIG. 6 and FIG. 7. In the first array area to fifth array area, five video reels 3 (3*a*, 3*b*, 3*c*, 3*d*, and 3*e*) are displayed, respectively. In the embodiment of the present invention, the video reels are for expressing in the form of a video rotation and stop of symbols depicted on the circumferential surfaces of mechanical reels. To each of the video reels 3 is allocated a symbol array formed of plural symbols (see, e.g., FIG. 8 to FIG. 32 which will be described later).

In the symbol display area 4, the symbol array allocated to video reels 3 (3*a*, 3*b*, 3*c*, 3*d*, 3*e*) scrolls and stops after elapse of a predetermined time. As a result, parts of the respective symbol arrays (three successive symbols in the embodiment of the present invention) are displayed in the symbol display area 4. In the first to fifth array areas of the symbol display area 4, symbols are displayed respectively in the three areas (the upper stage area, the middle stage area, and the lower stage area) to correspond to each video reel 3 3*a*, 3*b*, 3*c*, 3*d*, 3*e*. To put it differently, 15 symbols forming a 5 by 3 matrix are displayed in the symbol display area 4.

In the embodiment of the present invention, "LEFT TO RIGHT" type is adopted for determining the winning. That is, by selecting one of five stages of WAYS BET (WAYS BET1, WAYS BET2, WAYS BET3, WAYS BET4, and WAYS BET5), there are determined result determination areas to be subjected to result determination, out of 15 areas (the 5 by 3 matrix) of the symbol display area 4 (determination of active area). Then a winning occurs when a predetermined number of symbols stopped in the areas of first array area to fifth array area, which areas are subjected to result determination, are linked (see FIG. 7).

Specifically, as shown in FIG. 6, when "WAYS BET1" is selected, the areas out of the symbol display area 4 subjected to result determination (areas activated) are: the upper stage, the middle stage, and the lower stage of the first array area; the middle stage of the second array area; the middle stage of the third array area; the middle stage of the fourth array area; and the middle stage of the fifth array area. When "WAYS BET2" is selected, the areas out of the symbol display area 4 subjected to result determination (areas activated) are: the upper stage, the middle stage, and the lower stage of the first array area; the upper stage, the middle stage, and the lower stage of the second array area; the middle stage of the third array area; the middle stage of the fourth array area; and the middle stage of the fifth array area. When "WAYS BET3" is selected, the areas out of the symbol display area 4 subjected to result determination (areas activated) are: the upper stage, the middle stage, and the lower stage of the first array area; the middle stage of the second array area; the upper stage, the middle stage, and the lower stage of the third array area; the middle stage of the fourth array area; and the middle stage of the fifth array area. When "WAYS BET4" is selected, the areas out of the symbol display area 4 subjected to result determination (areas activated) are: the upper stage, the middle stage, and the lower stage of the first array area; the middle stage of the second array area; the upper stage, the middle stage, and the lower stage of the third array area; the upper stage, the middle stage, and the lower stage of the fourth array area; and the middle stage of the fifth array area. When "WAYS BET5" is selected, the areas out of the symbol display area 4 subjected to result determination (areas activated) are: the upper stage, the middle stage, and the lower stage of the first array area; the middle stage of the second array area; the upper stage, the middle stage, and the lower stage of the third array area; the upper stage, the middle stage, and the lower stage of the fourth array area; and the upper stage, the middle stage, and the lower stage of the fifth array area.

For example, as shown in FIG. 7, when the "WAYS BET5" is selected, all the areas out of the symbol display area 4 are subjected to result determination (activated). As shown in FIG. 7, when a certain symbol (PICT_A, encompassing WILD symbol) occurs in the lower stage of the first array area, the upper stage of the second array area, the upper stage of the third array area, the middle stage of the fourth array area, and the upper stage, the middle stage, and the lower stage of the fifth array area, there are three winnings in which the symbol occurs in five linked positions from the first array area to the fifth array area (LEFT TO RIGHT). In the "LEFT TO RIGHT" type, the symbols may appear to be scattered in the first sight; however, if they are linked throughout the first array area to the fifth array area, it is determined as winning. Although the present embodiment adopts the "LEFT TO RIGHT" type, it is possible to adopt a line type which regards as a winning line a line connecting any of three areas out of each symbol array of the video reel.

The lower image display panel 141 includes a touch panel 114. The player is allowed to input instructions by touching the lower image display panel 141.

While in the present embodiment the slot machine 1 adopts video reels that display simulated reels, the slot machine 1 may be provided with a reel unit of a mechanical type, or the video reels and the mechanical type may be concurrently employed.

The upper image display panel 131 is provided at the front face of the top box 12. The upper image display panel 131 includes a liquid crystal panel, and forms the display. The upper image display panel 131 displays images related to effects and images showing introduction of the game contents and explanation of the game rules.

Below the lower image display panel 141 are provided a control panel 30 having various buttons, a PTS device 700, and a bill entry 60 (equivalent to an input device).

The bill entry 60 validate bills and receives genuine bills into the cabinet 11. The bill entry 60 is electrically connected to the PTS device 700, and when a legitimate bill is received, transmits to the PTS device 700 an input signal based on the value of the bill. The input signal includes information on credit data or the like related to the received bill.

The PTS device 700 is a unit in which an LCD (liquid crystal display), a human detection camera, a microphone, and the like are integrated. The human detection camera makes it possible to detect the presence of a player by the camera function. The microphone is used for the player's participation in a game by voice and the authentication of a player by voice recognition. Further, the PTS device 700 has a card insertion slot to which an IC card can be inserted. With this, the player is able to insert an IC card into the card insertion slot and use the credits stored in the IC card in the slot machine 1.

(Control Panel 30)

The control panel 30 includes: a CHANGE button 31 and a CASHOUT/TAKE WIN button 32 arranged in the left side area; and a 1-BET button 34, a 2-BET button 35, a 3-BET button 36, a 5-BET button 37, a 10-BET button 38, a MAX-BET button 39, a WAYS BET1 button 40, a WAYS BET2 button 41, a WAYS BET3 button 42, a WAYS BET4 button 43, and a WAYS BET5 button 44 in the central area. In addition to the above, the bill entry 115 is provided on the upper stage of the right side area, whereas a FEATURE BOOST button 45 and a spin button 46 are provided on the lower stage of the right side area.

The CHANGE button 31 is an operation button to be used when temporarily leaving the seat, or when requesting a staff person of the gaming facility for an exchange. The CASHOUT/TAKE WIN button 32 is an operation button to be used for cashing out coins (credits) stored in the slot machine 10.

The WAYS BET1 button 40, the WAYS BET2 button 41, the WAYS BET3 button 42, the WAYS BET4 button 43, and the WAYS BET5 button 44 are, as described above, buttons for determined result determination areas to be subjected to result determination (to be activated), out of 15 areas (the 5 by 3 matrix) of the symbol display area 4. To determine the areas to be subjected to result determination by the WAYS BET1 button 40, 1 credit is required. To determine the areas to be subjected to result determination by the WAYS BET2 button 41, 3 credits are required. To determine the areas to be subjected to result determination by the WAYS BET3 button 42, 7 credits are required. To determine the areas to be subjected to result determination by the WAYS BET4 button 43, 15 credits are required. To determine the areas to be subjected to result determination by the WAYS BET5 button 44, 25 credits are required.

The FEATURE BOOST button 45 is a button to turn on a FEATURE BOOST function. Specifically, when the FEATURE BOOST button 45 is pressed, the upper stages, the middle stages, and the lower stages of the first array area, the second array area, the third array area, the fourth array area, and the fifth array area of the symbol display area 4 are all subjected to the result determination (activated), as in a case of pressing the WAYS BET5 button 44, and the FEATURE BOOST function is turned on. In the present embodiment, when the FEATURE BOOST function is turned on, a predetermined number of times of execution of the free game may be additionally awarded as a result of random determination when a free game trigger is established (this will be detailed later). To determine the areas to be subjected to result determination by the FEATURE BOOST button 45 and turn on the FEATURE BOOST function, 40 credits are required.

The 1-BET button 34 is a button to determine ×1 as the multiplying factor relative to the payout (1BET). The 2-BET button 35 is a button to determine ×2 as the multiplying factor relative to the payout (2BET). The 3-BET button 36 is a button to determine ×3 as the multiplying factor relative to the payout (3BET). The 5-BET button 37 is a button to determine ×5 as the multiplying factor relative to the payout (5BET). The 10-BET button 38 is a button to determine ×10 as the multiplying factor relative to the payout (10BET). The MAX-BET button 39 is a button to determine ×400 as the multiplying factor relative to the payout (400BET).

In the present embodiment, the credit amount to be placed as a bet is determined by means of selecting any of the 6 stages of WAYS BET (i.e., WAYS BET1, WAYS BET2, WAYS BET3, WAYS BET4, WAYS BET5, and FEATURE BOOST) and any of the 6 types of BET buttons (i.e., 1-BET Button 34, 2-BET button 35, 3-BET button 36, 5-BET button 37, 10-BET button 38, and MAX-BET button 39), and a unit game is started thereafter.

Specifically, the credit amount bet for starting the unit game is a product resulting from multiplication of the number of credits required by the selected WAYS BET by the credit value corresponding to the selected BET button. The number of credits required for the WAYS BET is 1 credit for WAYS BET1, 3 credits for WAYS BET2, 7 credits for WAYS BET3, 15 credits for WAYS BET4, 25 credits for WAYS BET5, and 40 credits are required for FEATURE BOOST. For example, when the WAYS BET1 button 40 and 2-BET button 35 are selected, 2 credits, which is a product of 1×2, are placed as the bet. Further, when the WAYS BET3 button 42 and 3-BET button 36 are selected, 21 credits, which is a product of 7×3, are placed as the bet. Further, when the WAYS BET5 button 44 and 10-BET button 38 are selected, 250 credits, which is a product of 25×10, are placed as the bet.

The spin button 46 is a button for starting scroll of the video reels 3 (3*a*, 3*b*, 3*c*, 3*d*, and 3*e*). The spin button 46 also serves as a button for selecting options displayed on the lower image display panel 141.

The bill entry 115 validates paper money, and accepts genuine paper money and a barcode attached ticket into the cabinet 11.

(Symbol Arrays on Video Reels)

Now, with reference to FIG. 8 to FIG. 32, the following describes a configuration of the symbol arrays on the video reels 3 of the slot machine 1. In the present embodiment, the normal mode video reels and the chance video reels are used.

As shown in FIGS. 8 to 12, to a first video reel ("Reel 1") 3*a*, a second video reel ("Reel2") 3*b*, a third video reel ("Reel3") 3*c*, a fourth video reel ("Reel4") 3*d*, and a fifth video reel ("Reel5") 3*e* of the normal mode video reels 3, symbol arrays each constituted by symbols corresponding to code numbers "0" to "33" are allocated, respectively. The normal mode video reels 3 having the symbol arrays shown in FIG. 8 are used when WAYS BET1 (3WAYS) is selected in the normal mode. The normal mode video reels 3 having the symbol arrays shown in FIG. 9 are used when WAYS BET2 (9WAYS) is selected in the normal mode. The normal mode video reels 3 having the symbol arrays shown in FIG. 10 are used when WAYS BET3 (27WAYS) is selected in the normal mode. The normal mode video reels 3 having the symbol arrays shown in FIG. 11 are used when WAYS BET4 (81WAYS) is selected in the normal mode. The normal mode video reels 3 having the symbol arrays shown in FIG. 12 are used when WAYS BET5 (243WAYS) or FEATURE BOOST is selected in the normal mode.

As shown in FIGS. 13 to 32, to a first video reel ("Reel 1") 3*a*, a second video reel ("Reel2") 3*b*, a third video reel ("Reel3") 3*c*, a fourth video reel ("Reel4") 3*d*, and a fifth video reel ("Reel5") 3*e* of the chance mode video reels 3, symbol arrays each constituted by symbols corresponding to code numbers "0" to "195" are allocated, respectively. The chance mode video reels 3 having the symbol arrays shown in FIG. 13 to FIG. 16 are used when WAYS BET1 (3WAYS) is selected in the chance mode. The chance mode video reels 3 having the symbol arrays shown in FIG. 17 to FIG. 20 are used when WAYS BET2 (9WAYS) is selected in the chance mode. The chance mode video reels 3 having the symbol arrays shown in FIG. 21 to FIG. 24 are used when WAYS BET3 (27WAYS) is selected in the chance mode. The chance mode video reels 3 having the symbol arrays shown in FIG. 25 to FIG. 28 are used when WAYS BET4 (81WAYS) is selected in the chance mode. The chance mode video reels 3 having the symbol arrays shown in FIG. 29 to FIG. 32 are used when WAYS BET5 (243WAYS) or FEATURE BOOST is selected in the chance mode.

Further, as shown in FIG. 8 to FIG. 32, the types of symbols arrayed on each video reel 3 include: normal symbols, a WILD symbol which is an almighty symbol that could substitute for any other symbol, and a feature symbol that constitutes a condition for a winning (FEATURE WIN) which awards the right to play the free game. The normal symbols are for example "PHOENIX", "LION", "FISH", "TURTLE", "PACKET", "ACE", "KING", "QUEEN", "JACK", "TEN", and "NINE".

As indicated by the symbol arrays on the video reels shown in FIG. 8 to FIG. 32, in the present embodiment, the number of the "FEATURE" symbol is larger on the chance mode video reels than on the normal mode video reels. In the game in the normal mode, a game result is displayed by rearranging the symbols on the normal mode video reels in the symbol display area 4. After the shifting from the normal mode to the chance mode, a game result is displayed by rearranging symbols on the symbol display area 4 by using the chance mode video reels on which the number of the "FEATURE" symbol is larger than in the normal mode video reels. On this account, after the shifting from the normal mode to the chance mode, the probability of rearrangement of the "FEATURE" symbol is increased. As such, the probability of rearrangement of the "FEATURE" symbol in the symbol display area 4 is increased after the shifting from the normal mode to the chance mode, with the result that monotonousness in the game play is resolved.

[Structures of Circuits Provided to Slot Machine]

Figure 33:
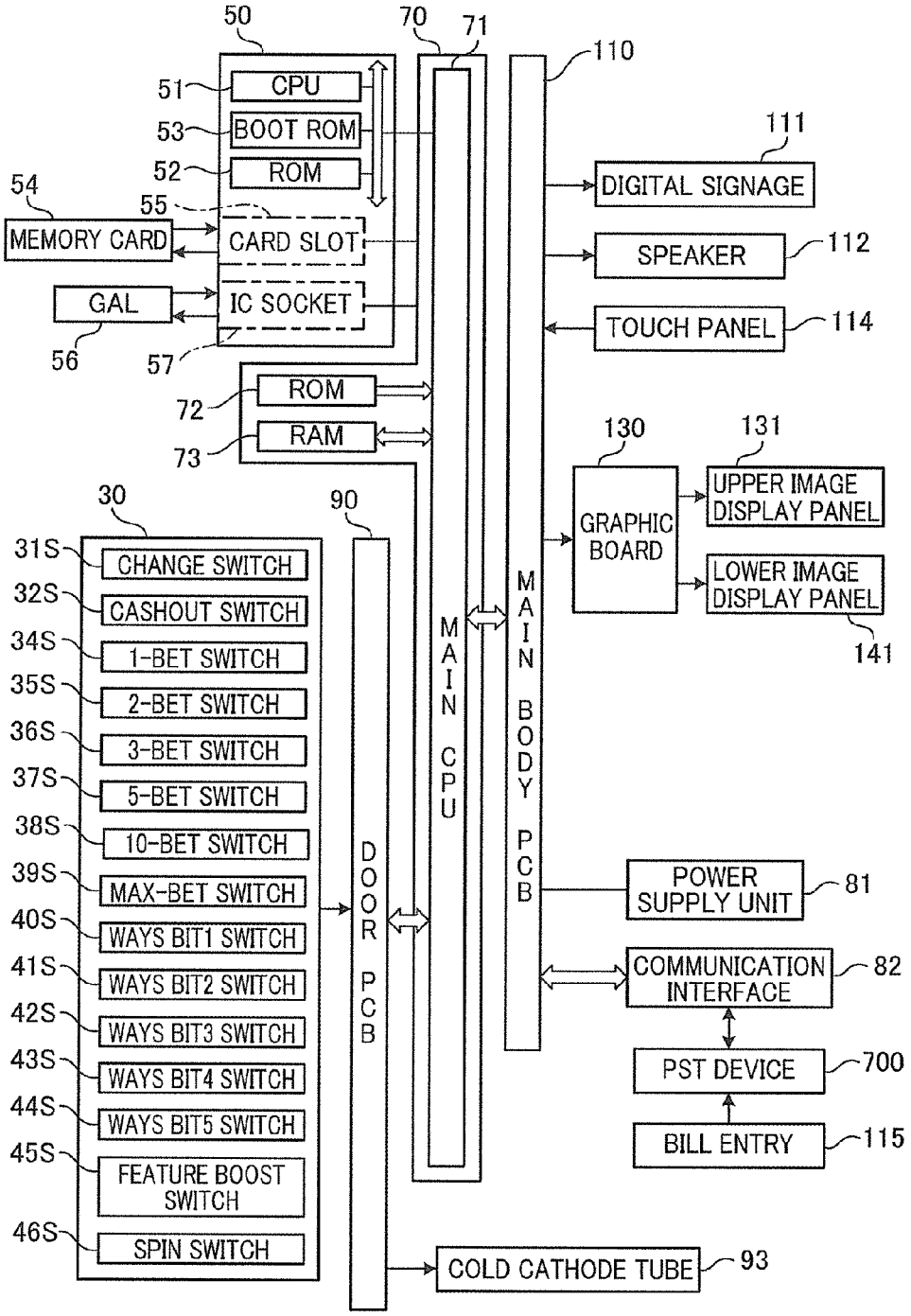
FIG. 33 is a block diagram showing an internal structure of the slot machine of the embodiment of the present invention.

Now, referring to FIG. 33, the configuration of a circuit in the slot machine 1 will be described. FIG. 33 is a block diagram showing an internal structure of the slot machine related to the embodiment of the present invention.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a nonvolatile memory, and stores a game program and a game system program. The game program includes a program related to game progression, a random determination program, and a program for producing effects by images and sounds. Furthermore, the game program includes data (see FIG. 8 to FIG. 32) defining the arrangement of the symbol array allocated to each video reel 3.

The random determination program is a program for randomly determining to-be-stopped symbol on the video reels 3*a*, 3*b*, 3*c*, 3*d*, and 3*e*. The to-be-stopped symbol is data for determining 3 symbols to be displayed to the symbol display area 4 out of plural symbols forming each symbol array. The slot machine 1 of the embodiment of the present invention determines, as the to-be-stopped symbols, the symbols to be displayed in a predetermined area (e.g. the middle stage) out of the three areas provided for each of the video reels 3*a*, 3*b*, 3*c*, 3*d*, and 3*e* of the symbol display area 4. This way symbols to be displayed in the three areas (the upper stage area, the middle stage area, and the lower stage area) corresponding to each video reel 3*a*, 3*b*, 3*c*, 3*d*, and 3*e* of the symbol display area 4 are determined.

The aforementioned random determination program includes symbol determination data. The symbol determination data is data that specifies random numbers so that each of the symbols forming the symbol array is determined at an equal probability for each of the video reels 3*a*, 3*b*, 3*c*, 3*d*, and 3*e*. For example, for the first video reel ("Reel 1") 3*a* of the normal mode video reel 3, the data specifies the random numbers such that 26 symbols (with the code numbers "0" to "25") constituting the symbol array are determined at the same probability (i.e., 1/26). However, because the number of the symbols in 26 symbols is different between the types, the probability of the selection is different between the types of the symbols. For example, in FIG. 8, the symbol array of the first reel 3*a* ("Reel 1") of the normal mode video reel 3 includes one "PHOENIX" and six "JACK". Therefore the former is selected at the probability of "1/26" whereas the latter is selected at the probability of "6/26".

Further, the card slot 55 is configured so that the memory card 54 can be inserted thereinto and removed therefrom, and is connected to a motherboard 70 by an IDE bus.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents and settings of the game to be played on the slot machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the preliminary authentication program, and the like. The authentication program is a program (falsification check program) for authenticating the game program and the game system program. The preliminary authentication program is a program for authenticating the aforementioned authentication program. The authentication program and the preliminary authentication program are written along a procedure (authentication procedure) for proving that the program to be the subject has not been falsified.

The motherboard 70 is provided with a main CPU 71, a ROM 72, a RAM 73, and a communication interface 82. The ROM 72 and the RAM73 correspond to the storage unit.

The ROM 72 includes a memory device such as a flash memory, and stores a program such as BIOS to be executed by the main CPU 71, and permanent data. When the BIOS is executed by the main CPU 71, processing for initializing predetermined peripheral devices is conducted. Further, through the gaming board 50, a process of loading the game program and the game system program stored in the memory card 54 is started.

The processor of the present invention includes the main CPU 71, the ROM 72, and the RAM 73 above and the memory card 54 storing the game program and the game system program, and controls the slot machine by causing the CPU 71 to execute the game program and the game system program. Needless to say, the processor may alternatively store the game program and the game system program in the ROM 72 instead of the memory card 54.

The RAM 73 stores data and programs which are used in operation of the main CPU 71. For example, when the processing of loading the aforementioned game program, game system program or authentication program is conducted, the RAM 73 can store the program. The RAM 73 is provided with working areas used for operations when these programs are executed. Examples of the areas include: an area that stores counters for the number of games, the bet amount, the payout amount, the credit amount and the like; and an area that stores symbols (code numbers) randomly determined.

Further, the motherboard 70 is connected with a later-described door PCB (Printed Circuit Board) 90 and a main body PCB 110 by respective USBs.

The door PCB 90 and the main body PCB 110 are connected with input devices such as a switch and a sensor, and peripheral devices the operations of which are controlled by the main CPU 71. The door PCB 90 is connected with a control panel 30, and a cold cathode tube 93.

For each of the buttons, the control panel 30 includes: a CHANGE switch 31S, a CASHOUT switch 32S, a 1-BET switch 34S, a 2-BET switch 35S, a 3-BET switch 36S, a 5-BET switch 37S, a 10-BET switch 38S, a MAX-BET switch 39S, a WAYS BET1 switch 40S, a WAYS BET2 switch 41S, a WAYS BET3 switch 42S, a WAYS BET4 switch 43S, a WAYS BET5 switch 44S, a FEATURE BOOST switch 45S, and a spin switch 46S. Each of the switches outputs a signal to the main CPU 71 upon detection of the pressing of the button corresponding thereto by the player.

The cold cathode tube 93 functions as a backlight installed on the rear face side of the upper image display panel 131 and the lower image display panel 141, and turns on based on a control signal outputted from the main CPU 71.

The main body PCB 110 is connected with a digital signage 111, a speaker 112, a touch panel 114, a graphic board 130, a power supply unit 81, and a communication interface 82.

The digital signage 111 turns on based on a control signal outputted from the main CPU 71. The speakers 112 output BGM sound or the like in accordance with a control signal output from the main CPU 71.

The touch panel 114 detects a place on the lower image display panel 141 touched by the player's finger or the like, and outputs to the main CPU 71 a signal corresponding to the detected place.

The graphic board 130 controls image display executed by the respective upper image display panel 131 and lower image display panel 141, based on a control signal outputted from the main CPU 71. The symbol display area 4 of the lower image display panel 141 displays the five video reels 3*a*, 3*b*, 3*c*, 3*d*, and 3*e* by which the scrolling and stop motions of the symbol arrays included in the respective video reels 3*a*, 3*b*, 3*c*, 3*d*, and 3*e* are displayed. The graphic board 130 is provided with a VDP generating image data, a video RAM temporarily storing the image data generated by the VDP, and the like.

The graphic board 130 is provided with the VDP (Video Display Processor) generating image data based on a control signal outputted from the main CPU 71, the video RAM temporarily storing the image data generated by the VDP, and the like. It is to be noted that the image data used for generating image data by the VDP is included in the game program that has been read from the memory card 54 and stored into the RAM 73.

The power supply unit 81 supplies power to the slot machine 1. When the power is supplied from the power supply unit 81 to the motherboard 70, the main CPU 71 of the motherboard 70 is activated, and then power is supplied to the gaming board 50 through the PCI bus so as to activate the CPU 51.

The communication interface 82 is for communicating with the PTS device 700 and the external controller 200. The PTS device 700, upon reception of an input signal from the bill entry 115, transmits credit data contained in the input signal to the main CPU 71 via the communication interface 82. Further, when an IC card is inserted into the card insertion slot, the PTS device 700 transmits credit data stored in the IC card to the main CPU 71 via the communication interface 82. The PTS device 700 also writes credit data into the IC card inserted into the card insertion slot, based on a control signal received from the main CPU 71 via the communication interface 82.

(Symbol Combination Table)

Now, symbol combination tables will be described with reference to FIG. 34. FIG. 34 shows a symbol combination table of the slot machine of the embodiment of the present invention.

The symbol combination tables of the present embodiment define the combinations of symbols (the number of symbols) with which a winning (WIN) is achieved and payout amounts. In the slot machine 1, a winning is achieved when the scroll of the symbol array of each video reel 3 is stopped and symbols displayed in the symbol display area 4 form a line which goes through the first array area to the fifth array area within the area set to be the subject of the result determination by the WAYS BET. In accordance with the type of winning, a benefit such as a payout or the right to play the free game is awarded to the player.

Basically, winning is achieved when a predetermined number of symbols of a single kind are arranged to be linked to one another, as in a 3Kind, a 4Kind, or a 5Kind combination, through the first array area to the fifth array area, within the result determination area set as the subject to result determination, by the WAYS BET button. The above symbols of a single kind are "PHOENIX", "LION", "FISH", "TURTLE", "PACKET", "ACE", "KING", "QUEEN", "JACK", "TEN", and "NINE". The symbol of "WILD" is substituted by any of the above symbols: "PHOENIX", "LION", "FISH", "TURTLE", "PACKET", "ACE", "KING", "QUEEN", "JACK", "TEN", and "NINE". Regarding the "FEATURE" symbol, a payout and the right to play the free game are awarded if "FEATURE" symbol occurs in three or more consecutive positions through the first array area to the fifth array area (when 3Kind or more combination of the "FEATURE" is formed), irrespective of the area turned active by the WAYS BET button.

For example, when the "WAYS BET5" is selected, all the areas out of the symbol display area 4 are subjected to result determination (activated). When the scroll of the symbol arrays on the video reels 3 is stopped and the "PHOENIX" symbol occurs in the lower stage of the first array area, the upper stage of the second array area, the upper stage of the third array area, the middle stage of the fourth array area, and the lower stage of the fifth array area, there is a winning in which the symbol occurs in five linked positions from the first array area to the fifth array area (LEFT TO RIGHT) (5Kind combination of "PHOENIX" is formed). In this case, the symbol combination table shown in FIG. 34 is referred to, and a payout amount of "800" is determined. Based on the determined payout amount, payout is awarded.

In cases of winning by "PHOENIX", "LION", "FISH", "TURTLE", "PACKET", "ACE", "KING", "QUEEN", "JACK", "TEN", and "NINE", an amount calculated by multiplying a payout amount defined in the symbol combination table by a bet amount in the unit game is awarded. For example, when a winning related to five "PHOENIX" symbols is achieved (when 5Kind combination of "PHOENIX" is formed) in a unit game where 10 credits are placed by the 10-BET button 38, the awarded credits will be 10×800=8000. Further, for a winning related to "FEATURE", a product of all the bet amount in the unit game multiplied by the payout amount defined in the symbol combination table is paid out. For example, when a winning related to three "FEATURE" symbols occurs in a case where an area to be subjected to result determination is set by the WAYS BET5 button 44 (which requires 25 credits) and 10 credits are placed as a bet by the 10-bet button 38, 1250 credits (25×10×5=1250) and the right to play the free game are awarded.

(Shifting Random Determination Table)

Now, with reference to FIG. 35, a shifting random determination table in the normal mode and a shifting random determination table in the chance mode will be described (switching random determination tables). The shifting random determination table in the normal mode is referred to in a shifting random determination process in the normal mode in a later-described main control process. The shifting random determination table in the chance mode is referred to in a shifting random determination process in the chance mode of the later-described chance mode process.

As shown in FIG. 35, in the shifting random determination table in the normal mode, a probability of not shifting from the normal mode to the chance mode (the normal mode is maintained) and a probability of shifting from the normal mode to the chance mode are defined to correspond to shifting conditions (conditions 1 to 4) established in the normal mode. In this regard, the condition 1 is successive rearrangement of three or more "FEATURE" symbols from the first reel 3*a* to the fifth reel 3*e* in the symbol display area 4 (3Kind combination of "FEATURE" symbols or higher). The condition 2 is rearrangement of the "FEATURE" symbols of the first reel 3*a* and the second reel 3*b* in the middle stage of the symbol display area 4 (2Kind combination of "FEATURE" symbols). The condition 3 is rearrangement of the "FEATURE" symbols of the first reel 3*a* and the second reel 3*b* in the symbol display area 4 (except the condition 2) (2Kind combination of "FEATURE" symbols). One case of the condition 4 is rearrangement of the "FEATURE" symbol on the first reel 3*a* in the symbol display area 4 and non-rearrangement of the "FEATURE" symbol of the second reel 3*b* in the symbol display area 4 (1Kind combination of the "FEATURE" symbol). The other case of the condition 4 is non-rearrangement of the "FEATURE" symbol on the first reel 3*a* in the symbol display area 4 (0Kind combination of the "FEATURE" symbol).

To be more specific, the shifting random determination table in the normal mode is referred to in the slot game in the normal mode, and when the condition 1 is satisfied, the normal mode is maintained at a probability of 0/1000 and shifting from the normal mode to the chance mode occurs at a probability of 1000/1000 (i.e., shifting from the normal mode to the chance mode always occurs when the condition 1 is satisfied). When the condition 2 is satisfied, the normal mode is maintained at a probability of 200/1000 whereas shifting from the normal mode to the chance mode occurs at a probability of 800/1000. When the condition 3 is satisfied, the normal mode is maintained at a probability of 620/1000 whereas shifting from the normal mode to the chance mode occurs at a probability of 380/1000. When the condition 4 is satisfied, the normal mode is maintained at a probability of 999/1000 whereas shifting from the normal mode to the chance mode occurs at a probability of 1/1000.

As shown in FIG. 35, in the shifting random determination table in the chance mode, a probability of shifting from the normal mode to the chance mode and a probability of not shifting from the normal mode to the chance mode (the normal mode is maintained) are defined to correspond to the conditions (1 to 4) established in the chance mode.

To be more specific, the shifting random determination table in the chance mode is referred to in the slot game in the chance mode, and when the condition 1 is satisfied, shifting from the chance mode to the normal mode occurs at a probability of 0/1000 and the chance mode is maintained at a probability of 1000/1000 (i.e., the chance mode is always maintained when the condition 1 is satisfied). When the condition 2 is satisfied, shifting from the chance mode to the normal mode occurs at a probability of 0/1000 whereas the chance mode is maintained at a probability of 1000/1000 (i.e., the chance mode is always maintained when the condition 2 is satisfied). When the condition 3 is satisfied, shifting from the chance mode to the normal mode occurs at a probability of 0/1000 whereas the chance mode is maintained at a probability of 1000/1000 (i.e., the chance mode is always maintained when the condition 3 is satisfied). When the condition 4 is satisfied, shifting from the chance mode to the normal mode occurs at a probability of 80/1000 and the chance mode is maintained at a probability of 920/1000.

As described above, switching between the game in the normal mode and the game in the chance mode is performed based on the conditions 1 to 4 of the combinations of the symbols displayed in the symbol display area 4 and the random determination (the shifting random determination process in the normal mode and the shifting random determination process in the chance mode). Therefore, even if a combination of symbols satisfying one of the conditions 1 to 4 appears in the symbol display area 4, the switching between the game in the normal mode and the game in the chance mode is not always carried out in the same way, and hence monotonousness in the game play is avoided.

In addition to the above, because the probability of performing switching between the game in the normal mode and the game in the chance mode is determined based on the conditions 1 to 4 (different predetermined combinations of the symbols), interest in a combination of rearranged symbols is enhanced and monotonousness in the game progress may be resolved.

As a result of the rearrangement of the symbols, a probability of establishment of the combination of symbols satisfying the condition 1 is the lowest, the probability of establishment of the condition 2 is the second lowest, the probability of establishment of the condition 3 is the third lowest, and the probability of establishment of the condition 4 is the highest. In the shifting random determination table, the probability of performing switching between the game in the normal mode and the game in the chance mode is arranged to increase as the probability of establishment of a condition decreases. On this account, shifting to the chance mode is most probable when the condition 1 is satisfied.

According to the arrangement above, when symbols rearranged in the symbol display area 4 form a combination satisfying the condition 1 which is least likely to be established, the probability of shifting from the normal mode to the chance mode is more probable to be performed. This makes it possible to enhance the interest in the combination of symbols satisfying the condition 1 which is less likely to be established, and to resolve the monotonousness in the game progress.

(Free Game Type Table)

Now, the following will describe a free game type table with reference to FIG. 36. The free game type table is stored in the RAM 73 and is read therefrom according to need.

The free game type table shown in FIG. 36 is referred to when the right to run the free game is awarded, in which types of the free game to be selected (Free Games A to G) are associated with the runnable numbers of times of execution the free game (number of game play) and random determination probabilities for determining a set of multiplying factors (WILD multiplying factor) for a payout.

To be more specific, when "Free Game A" is selected in a later-described free game type selection process in the free game process, the free game becomes runnable 30 times, and the multiplying factor for the payout awarded in the free game when a combination including the WILD symbol is established is determined as "×1" at a random determination probability of "244/1000", "×2" at a random determination probability of "256/1000", or "×3" at a random determination probability of "500/1000".

When "Free Game B" is selected in the later-described free game type selection process in the free game process, the free game becomes runnable 20 times, and the multiplying factor for the payout awarded in the free game when a combination including the WILD symbol is established is determined as "×2" at a random determination probability of "205/1000", "×3" at a random determination probability of "251/1000", or "×5" at a random determination probability of "544/1000".

When "Free Game C" is selected in the later-described free game type selection process in the free game process, the free game becomes runnable 15 times, and the multiplying factor for the payout awarded in the free game when a combination including the WILD symbol is established is determined as "×3" at a random determination probability of "300/1000", "×5" at a random determination probability of "330/1000", or "×8" at a random determination probability of "370/1000".

When "Free Game D" is selected in the later-described free game type selection process in the free game process, the free game becomes runnable 10 times, and the multiplying factor for the payout awarded in the free game when a combination including the WILD symbol is established is determined as "×5" at a random determination probability of "152/1000", "×8" at a random determination probability of "238/1000", or "×10" at a random determination probability of "610/1000".

When "Free Game E" is selected in the later-described free game type selection process in the free game process, the free game becomes runnable 8 times, and the multiplying factor for the payout awarded in the free game when a combination including the WILD symbol is established is determined as "×8" at a random determination probability of "310/1000", "×10" at a random determination probability of "325/1000", or "×15" at a random determination probability of "365/1000".

When "Free Game F" is selected in the later-described free game type selection process in the free game process, the free game becomes runnable 5 times, and the multiplying factor for the payout awarded in the free game when a combination including the WILD symbol is established is determined as "×10" at a random determination probability of "345/1000", "×15" at a random determination probability of "305/1000", or "×20" at a random determination probability of "350/1000".

When "Free Game G (Mystery)" is selected in the later-described free game type selection process, the runnable number of times of execution of the free game and a set of a multiplying factor of a payout awarded when a combination including the WILD symbol is established in the free game are randomly determined (later-described mystery random determination) with reference to a later-described free game number-multiplying factor determination table.

(Free Game Number-Multiplying Factor Determination Table)

Now, the following will describe a free game number-multiplying factor determination table with reference to FIG. 37. The free game number-multiplying factor determination table is stored in the RAM 73 and is read therefrom according to need.

The free game number-multiplying factor determination table is referred to in the mystery random determination process which is executed when "Free Game G (Mystery)" is selected in the later-described free game type selection process. In the free game number-multiplying factor determination table, the runnable number of times of execution of the free game (number of game play) and a set of multiplying factors of a payout awarded when a combination including the WILD symbol is established in the free game are associated with a random determination probability. As the random determination probabilities in the free game number-multiplying factor determination table, a random determination probability (F_BOOST) when the FEATURE BOOST function is turned on and a random determination probability (normal) when the FEATURE BOOST function is turned off are defined.

For example, in a state than the FEATURE BOOST function is off (normal), when "Free Game G (Mystery)" is selected in the later-described free game type selection process and ID "3" is achieved at the probability of 1/180 as a result of the mystery random determination process, the free game becomes runnable 30 times, and in the same manner as in the selection of the "Free Game D", the multiplying factor for the payout awarded in the free game when a combination including the WILD symbol is established is determined as "×5" at a random determination probability of "152/1000", "×8" at a random determination probability of "238/1000", or "×10" at a random determination probability of "610/1000".

In the meanwhile, for example, in a state that the FEATURE BOOST function is on (F_BOOST), when "Free Game G (Mystery)" is selected in the later-described free game type selection process and ID "12" is achieved at the probability of 12/180 as a result of the mystery random determination process, the free game becomes runnable 15 times, and in the same manner as in the selection of the "Free Game A", the multiplying factor for the payout awarded in the free game when a combination including the WILD symbol is established is determined as "×1" at a random determination probability of "244/1000", "×2" at a random determination probability of "256/1000", or "×3" at a random determination probability of "500/1000".

When the right to run the free game is awarded and "Free Game G (Mystery)" is selected in the free game type selection process as above, the runnable number of times of execution of the free game and a set of multiplying factors of a payout awarded when a combination including the WILD symbol is established in the free game are determined. Therefore, in a certain state of winning, the awarded number of times of running the free game (number of game play) may be 30 and the payout rate may be determined as ×30 (ID "5"), and the player is allowed to play the free game which is more advantageous than the selection of any one of the "Free Game A" to "Free Game F" in the free game type selection process. In another state of winning, the awarded number of times of execution of the free game (number of game play) may be 5 and the payout rate may be determined as ×1 (ID "30"), and hence the free game which is more disadvantageous for the player than any one of "Free Game A" to "Free Game F" may be awarded in the free game type selection process.

(Additional FG Number Random Determination Table)

Now, referring to FIG. 38, an additional FG number random determination table will be described. The additional FG number random determination table is stored in the RAM 73 and is read therefrom in a later-described additional FG number random determination process.

In the additional FG number random determination table, for each of the free game types (Free Games A to F) selected in the later-described free game type selection process, a winning probability corresponding to an additional number of times of execution of the free game (add game) is defined. When "Free Game G (Mystery)" is selected in the free game type selection process, a free game type (Free Games A to F) corresponding to a set of multiplying factors determined in the mystery random determination process (see FIG. 37) is referred to in the additional FG number random determination table.

For example, when the FEATURE BOOST is on (F_BOOST), "Free Game A" is selected in the later-described free game type selection process, and ID "6" is selected at the random determination probability of 8/100 in the additional FG number random determination process, the right to run the free game 40 times is additionally awarded. In the meanwhile, when the FEATURE BOOST is on (F_BOOST), "Free Game F" is selected in the later-described free game type selection process, and ID "0" is selected at the random determination probability of 80/100 in the additional FG number random determination process, the right to run the free game 10 times is additionally awarded.

(Payout Rate Table)

Now, referring to FIG. 39, a payout rate table (equivalent to a denomination table) will be described. The payout rate table is a table which is referred to in a later-described denomination selection process.

In the payout rate table, payout rates (MAX and MIN) are associated with denomination values. The denomination of the present embodiment is the minimum unit of betting (i.e., a credit value required for 1 bet). The payout rate is a rate of credits awarded as a payout as compared to betted credits (i.e., a restoration rate, an expected value, or RETURN TO PLAYER (RTP)). In the present embodiment, selectable denomination values are $0.01, $0.02, $0.05, $0.10, $0.20, $0.50, and $1.00.

For example, when $0.10 is selected in the denomination selection process, the payout rate is set to fall within a range between MIN91.94% and MAX91.07%. In the meanwhile, when $1.00 is selected in the denomination selection process, the payout rate is set to fall within a range between MIN97.89% and MAX97.97%.

In the payout rate table, the payout rate is high when the selected denomination value is high. This provides an additional value to the game with betting of a high denomination value, so as to avoid monotonousness in the game.

[Contents of Program]

Now, the program to be executed by the slot machine 1 is described with reference to FIG. 40 to FIG. 45.

(Main Control Process)

Figure 40:
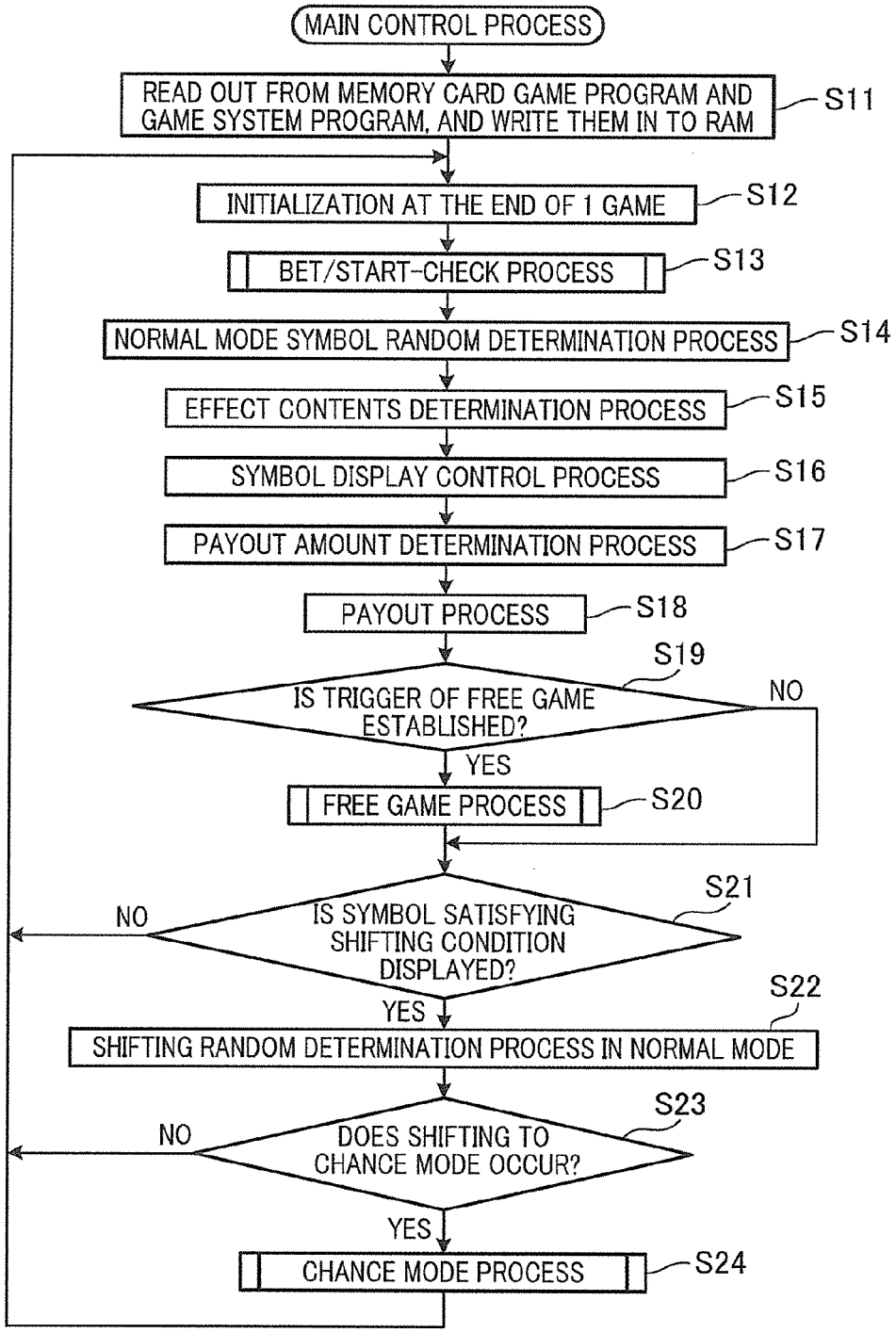
FIG. 40 is a flowchart of a main control process in the slot machine of the embodiment of the present invention.

Referring to FIG. 40, a main control process will be described. In the main control process, a game (normal game) is executed in the normal mode.

First, when the slot machine 1 is powered on, the main CPU 71 reads an authenticated game program and a game system program from a memory card 54 via a gaming board 50, and then write them in the RAM 73 (S11).

Subsequently, the main CPU 71 executes an initializing process at the end of each play of the game, in order to start the game in the normal mode (S12). This process clears data in a working area of the RAM 73, which becomes unnecessary at the end of each play of the game in the normal mode, e.g., the bet amount, symbols randomly determined, and the like.

The main CPU 71 then executes a later-described bet/start-check process (S13). In this process is carried out input checking and the like, to: the 1-BET switch 34S, the 2-BET switch 35S, the 3-BET switch 36S, the 5-BET switch 37S, 10-BET switch 38S, the MAX-BET switch 39S, the WAYS BET1 switch 40S, the WAYS BET2 switch 41S, the WAYS BET3 switch 42S, the WAYS BET4 switch 43S, the WAYS BET5 switch 44S, the FEATURE BOOST switch 45S, the spin switch 46S, and the like.

Subsequently, the main CPU 71 executes a normal mode symbol random determination process (S14). In this normal mode symbol random determination process, normal mode video reels 3 corresponding to one of the six stages of WAYS BET (WAYS BET1, WAYS BET2, WAYS BET3, WAYS BET4, WAYS BET5, and FEATURE BOOST) selected in the bet/start-check process (S13) are used. For example, when the WAYS BET3 is selected, the normal mode video reels 3 shown in FIG. 10 are used. When the WAYS BET5 or the FEATURE BOOST is selected, the normal mode video reels 3 shown in FIG. 12 are used.

Then to-be-stopped symbols are randomly selected from the symbols arranged on the normal mode video reels 3*a*, 3*b*, 3*c*, 3*d*, and 3*e* corresponding to the selected WAYS BET. The to-be-stopped symbol is data for determining 5 symbols to be displayed to the symbol display area 4 out of plural symbols forming each symbol array. In the present embodiment, symbols in the middle stage of the symbol display area 4 are selected as the to-be-stopped symbols from the symbols arranged on the normal mode video reels 3*a*, 3*b*, 3*c*, 3*d*, and 3*e*. In this way, 15 symbols displayed in the symbol display area 4 (the upper stage area, the middle stage area, and the lower stage area) are determined.

For example, in case of the first reel 3*a* of the normal mode video reels 3 (WAYS BET1: 3WAYS), when a code number "2" is randomly selected from 26 symbols (code numbers "0" to "25") forming the symbol array, the "PHOENIX" symbol corresponding to the code number "2" is selected as the to-be-stopped symbol (see FIG. 8). In case of the second reel 3*b*, when a code number "4" is randomly selected from 29 symbols (code numbers "0" to "28") forming the symbol array, the "TEN" symbol corresponding to the code number "4" is selected as the to-be-stopped symbol. In case of the third reel 3*c*, when a code number "19" is randomly selected from 28 symbols (code numbers "0" to "27") forming the symbol array, the "WILD" symbol corresponding to the code number "19" is selected as the to-be-stopped symbol. In case of the fourth reel 3*d*, when a code number "12" is randomly selected from 27 symbols (code numbers "0" to "26") forming the symbol array, the "ACE" symbol corresponding to the code number "12" is selected as the to-be-stopped symbol. In case of the fifth reel 3*e*, when a code number "31" is randomly selected from 34 symbols (code numbers "0" to "33") forming the symbol array, the "FISH" symbol corresponding to the code number "31" is selected as the to-be-stopped symbol.

The main CPU 71 stores the symbols determined as the to-be-stopped symbols on the normal mode video reels 3*a*, 3*b*, 3*c*, 3*d*, and 3*e* in a symbol storing area in the RAM 73.

Subsequently, the main CPU 71 executes an effect contents determination process (S15). The main CPU 71 samples an effect-use random number and randomly determines any of a plurality of predetermined contents of effect.

The main CPU 71 then executes a symbol display control process (S16). In this symbol display control process, the scroll of the normal mode video reels 3*a*, 3*b*, 3*c*, 3*d*, and 3*e* starts, and after a predetermined time elapses, the to-be-stopped symbols corresponding to the normal mode video reels 3*a*, 3*b*, 3*c*, 3*d*, and 3*e* selected in the normal mode symbol random determination process in S14 stop one by one in the middle stage of the symbol display area 4. That is, 15 symbols including the to-be-stopped symbols are rearranged in the symbol display area 4. For example, when the "PHOENIX" symbol is selected as the to-be-stopped symbol on the first reel 3*a* of the normal mode video reels 3, the "TEN" symbol is selected as the to-be-stopped symbol on the second reel 3*b*, the "WILD" symbol is selected as the to-be-stopped symbol on the third reel 3*c*, the "ACE" symbol is selected as the to-be-stopped symbol on the fourth reel 3*d*, and the "FISH" symbol is selected as the to-be-stopped symbol on the fifth reel 3*e*, the "PHOENIX", "TEN", "WILD", "ACE", and "FISH" symbols are rearranged in the middle stage of the symbol display area 4. In the upper stage and the lower stage of the symbol display area 4, symbols having code numbers each of which is one number off the to-be-stopped symbols are rearranged.

The main CPU 71 then executes a payout amount determination process (S17). In this process, a symbol combination table (see FIG. 34) stored in the RAM 73 is referred to, to determine whether the symbols stopped in the symbol display area 4 include symbols linked to one another through the first array area to the fifth array area in the WAYS BET set as the subject of the result determination area, thus achieving a winning. In accordance with the type of winning and the value of the bet counter (the credit type used in betting), a benefit such as the payout or the right to play the free game is awarded. The payout awarded is stored in a payout amount storage area of the RAM 73. For example, when the value of the bet counter is "3" and the symbol combination displayed on the payline is three "PHOENIX", "3"×"50"="150" credits are determined as the payout with reference to the symbol combination table shown in FIG. 34, and stored in the payout amount storage area in the RAM 73.

Then a payout process is executed (S18). The main CPU 71 adds the value stored in the payout amount storage area to the value of the credit counter in the RAM 73.

Figure 51:
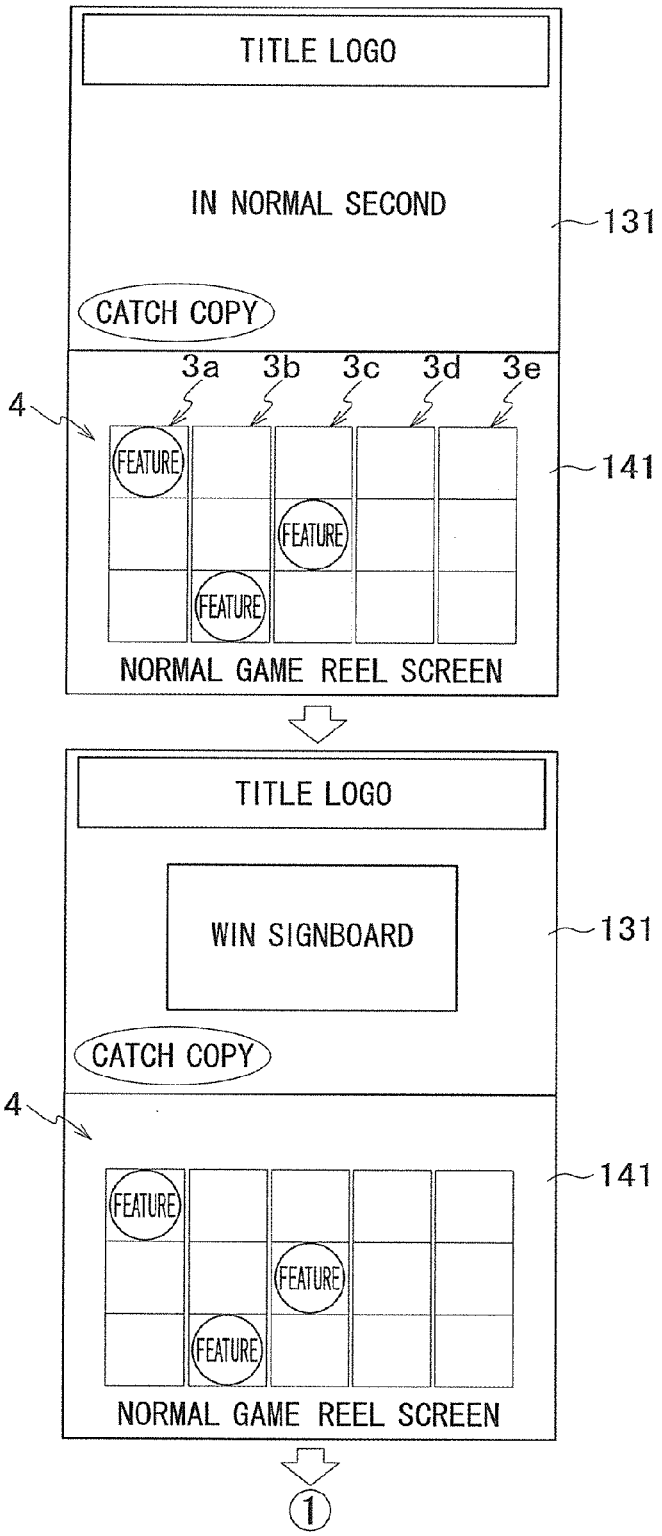
FIG. 51 shows an effect in the free game in the slot machine of the embodiment of the present invention.

Next, the main CPU 71 determines whether or not a free game trigger has been established (S19). In the present embodiment, the trigger for shifting to the free game is the appearance of the "FEATURE" symbol in three or more consecutive positions through the first array area to the fifth array area, irrespective of the area activated by WAYS BET. For example, as shown in FIG. 51, when the "FEATURE" symbol of the first reel 3*a* is rearranged in the upper stage of the first array area, the "FEATURE" symbol of the second reel 3*b* is rearranged in the lower stage of the second array area, and the "FEATURE" symbol of the third reel 3*c* is rearranged in the middle stage of the third array area, i.e., when three "FEATURE" symbols are successively rearranged from the first array area to the third array area, the free game trigger is established.

The main CPU 71, when determining that the free game trigger has been established (S19: YES), executes a later described free game process (S20).

In the meanwhile, when determining in S19 that the free game trigger is not established (S19: NO) or after S20, the main CPU 71 determines whether rearranged symbols on the symbol display area 4 form a combination satisfying a shifting condition (conditions 1 to 4) (S21). The shifting condition is one of the conditions 1 to 4 described above. To be more specific, the condition 1 is successive rearrangement of three or more "FEATURE" symbols from the first reel 3*a* to the fifth reel 3*e* in the symbol display area 4 (3Kind combination of "FEATURE" symbols or higher). The condition 2 is rearrangement of the "FEATURE" symbols of the first reel 3*a* and the second reel 3*b* in the middle stage of the symbol display area 4 (2Kind combination of "FEATURE" symbols). The condition 3 is rearrangement of the "FEATURE" symbols of the first reel 3*a* and the second reel 3*b* in the symbol display area 4 (except the condition 2) (2Kind combination of "FEATURE" symbols). One case of the condition 4 is rearrangement of the "FEATURE" symbol on the first reel 3*a* in the symbol display area 4 and non-rearrangement of the "FEATURE" symbol of the second reel 3*b* in the symbol display area 4 (1Kind combination of the "FEATURE" symbol). The other case of the condition 4 is non-rearrangement of the "FEATURE" symbol on the first reel 3*a* in the symbol display area 4 (0Kind combination of the "FEATURE" symbol).

When the symbols rearranged in the symbol display area 4 do not form a combination satisfying the shifting condition (conditions 1 to 4) (S21: NO), the routine proceeds to S12.

In the meanwhile, when the symbols rearranged in the symbol display area 4 form a combination satisfying the shifting condition (conditions 1 to 4) (S21: YES), the shifting random determination process in the normal mode is executed (S22). In this shifting random determination process in the normal mode, with reference to the shifting random determination table in the normal mode (FIG. 35) and the shifting condition (conditions 1 to 4) determined in S21, whether the shifting from the normal mode to the chance mode is not performed (the normal mode is maintained) or the shifting from the normal mode to the chance mode is performed is randomly determined.

To be more specific, when the condition 1 is satisfied, the normal mode is maintained at a probability of 0/1000 and shifting from the normal mode to the chance mode occurs at a probability of 1000/1000 (i.e., shifting from the normal mode to the chance mode always occurs when the condition 1 is satisfied). When the condition 2 is satisfied, the normal mode is maintained at a probability of 200/1000 whereas shifting from the normal mode to the chance mode occurs at a probability of 800/1000. When the condition 3 is satisfied, the normal mode is maintained at a probability of 620/1000 whereas shifting from the normal mode to the chance mode occurs at a probability of 380/1000. When the condition 4 is satisfied, the normal mode is maintained at a probability of 999/1000 whereas shifting from the normal mode to the chance mode occurs at a probability of 1/1000.

Subsequently, whether the shifting from the normal mode to the chance mode is to be performed as a result of the shifting random determination process in the normal mode in S22 is determined (S23). When not shifting from the normal mode to the chance mode (S23: NO), the normal mode is maintained and the routine proceeds to S12.

When shifting from the normal mode to the chance mode (S23: YES), a later-described chance mode process is executed (S24). After the chance mode process, the routine proceeds to S12.

(Bet/Start-Check Process)

Figure 41:
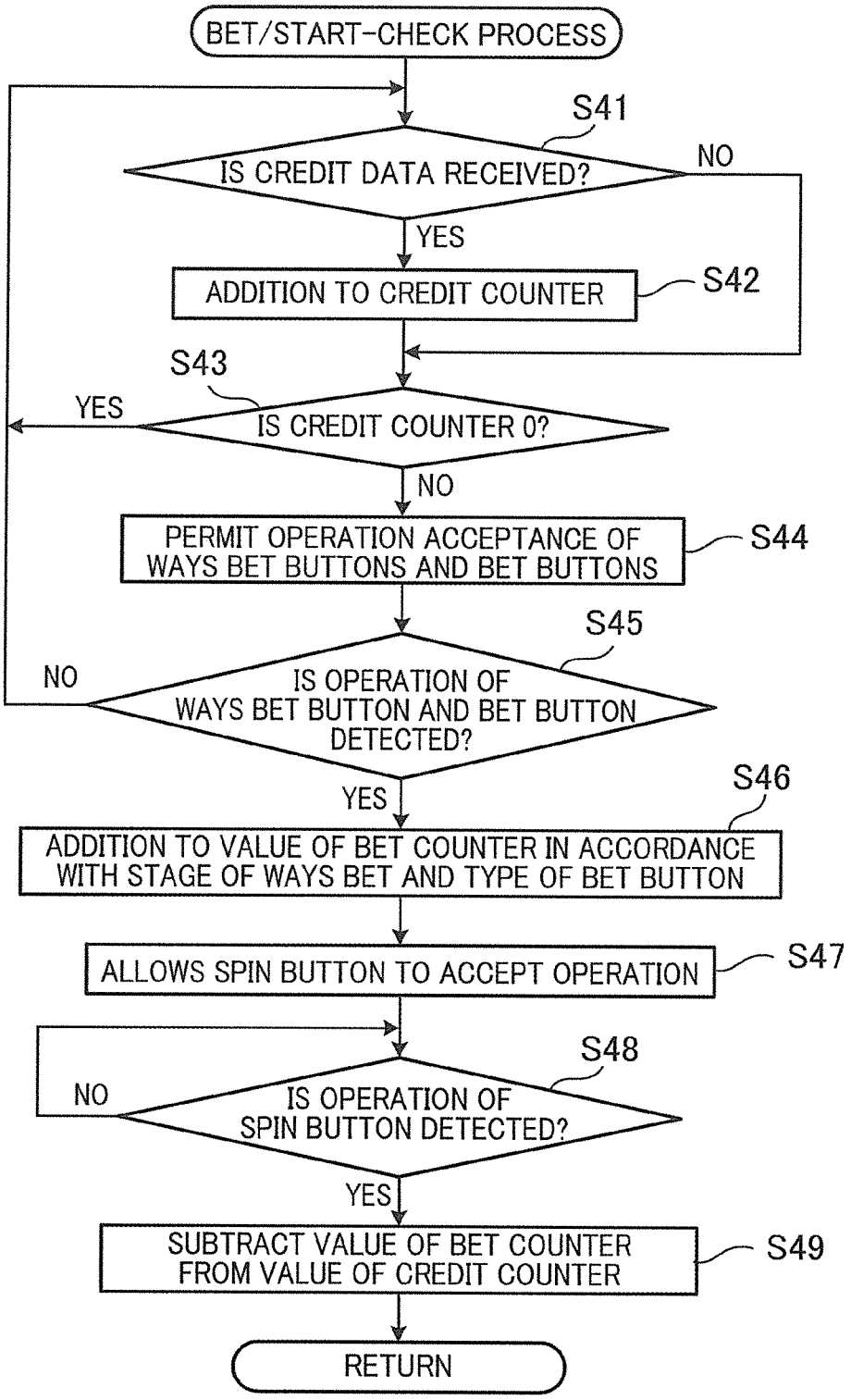
FIG. 41 is a flowchart of a bet/start-check process of the slot machine of the embodiment of the present invention.

Now the bet/start-check process will be described with reference to FIG. 41.

To begin with, the main CPU 71 determines whether credit data has been received from the PTS device 700 (S41). The credit data is sent from the PTS device 700 to the main CPU 71, for example, when the IC card is inserted into the card insertion slot and when the bill entry 60 receives a genuine bill.

When the credit data is received (S41: YES), the main CPU 71 adds the amount indicated by the received credit data to the value of the credit counter (S42).

After the step S42 or when determining in S41 that no credit data is received (S41: NO), the main CPU 71 determines whether or not the value stored in the credit counter is 0 (S43). When determining that the value of the credit counter is 0 (S43: YES), the main CPU 71 goes back to S41.

On the other hand, when the main CPU 71 determines that the value stored in the credit counter is not 0 (S43: NO), the main CPU 71 enables operation of the WAYS BET buttons (WAYS BET1 button 40, WAYS BET2 button 41, WAYS BET3 button 42, WAYS BET4 button 43, WAYS BET5 button 44, FEATURE BOOST button 45) and the bet buttons (1-BET button 34, 2-BET button 35, 3-BET button 36, 5-BET button 37, 10-BET button 38, and MAX-BET button 39) (S44). By selecting any of the five stages of WAYS BET buttons, an area to be subjected to result determination is selected out of 15 areas of the 5 by 3 matrix of the symbol display area 4 (see FIG. 6).

Next, the main CPU 71 determines if an operation of the WAYS BET button or the bet button is detected (S45). When the operation of the WAYS BET button or the BET button is not detected (S45: NO), the routine proceeds to S41. When the main CPU 71 detects pressing of the WAYS BET button by the player through the WAYS BET switch (WAYS BET1 switch 40S, WAYS BET2 switch 41S, WAYS BET3 switch 42S, WAYS BET4 switch 43S, WAYS BET5 switch 44S, and FEATURE BOOST switch 45S) and detects pressing of the BET button by the player through the BET switch (1-BET switch 34S, 2-BET switch 35S, 3-BET switch 36S, 5-BET switch 37S, 10-BET switch 38S, and MAX-BET switch 39S) (S45: YES), the main CPU 71 adds, to the bet counter provided in the RAM73, a value which is the product of the amount of credit necessary for the selected WAYS BET (1 credit for WAYS BET1, 3 credits for WAYS BET2, 7 credits for WAYS BET3, 15 credits for WAYS BET 4, 25 credits for WAYS BET5, and 40 credits for FEATURE BOOST) multiplied by the amount of credit corresponding to the BET button operated (S46). When the pressing of the FEATURE BOOST button 45 is detected by the FEATURE BOOST switch 45S, the FEATURE BOOST function is turned on.

For example, when the WAYS BET1 button 40 and 2-BET button 35 are selected, 2 credits, which is a product of 1×2, are added to the bet counter. Further, when the WAYS BET3 button 42 and 3-BET button 36 are selected, 21 credits, which is a product of 7×3, are added to the bet counter. Further, when the WAYS BET5 button 44 and 10-BET button 38 are selected, 250 credits, which is a product of 25×10, are added to the bet counter.

After the step S46, the main CPU 71 allows the spin button 46 to accept an operation (S47).

After S47, the main CPU 71 determines whether or not an operation of the spin button 46 is detected (S48). When the main CPU 71 determines that an operation of the spin button 46 is not detected (S48: NO), an operation of the spin button 46 is waited for.

In the meanwhile, when the main CPU 71 determines that operation of the spin button 46 is detected (S48: YES), the main CPU 71 subtracts the value of the bet counter calculated in S46 from the value of the credit counter (S49).

Then the bet/start-check process is terminated.

(Chance Mode Process)

Figure 42:
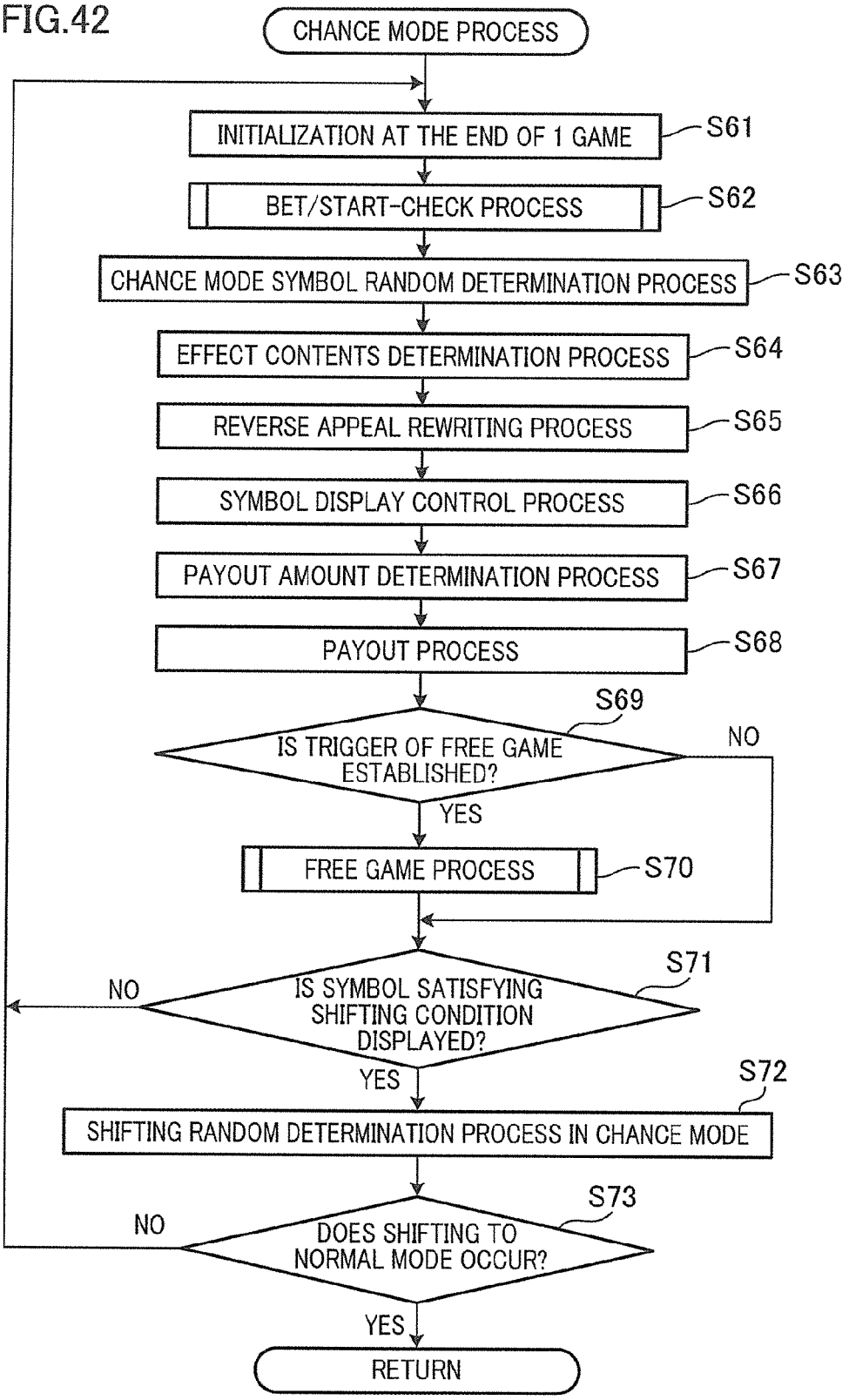
FIG. 42 is a flowchart of a chance mode process in the slot machine of the embodiment of the present invention.

Now, the chance mode process will be described with reference to FIG. 42.

To begin with, the main CPU 71 executes an initializing process at the end of each play of the game, in order to start the game in the chance mode (S61). This process clears data in a working area of the RAM 73, which becomes unnecessary at the end of each play of the game, e.g., the bet amount, symbols randomly determined, and the like.

The main CPU 71 then executes a later-described bet/start-check process (S62). In this process is carried out input checking and the like, to: the 1-BET switch 34S, the 2-BET switch 35S, the 3-BET switch 36S, the 5-BET switch 37S, 10-BET switch 38S, the MAX-BET switch 39S, the WAYS BET1 switch 40S, the WAYS BET2 switch 41S, the WAYS BET3 switch 42S, the WAYS BET4 switch 43S, the WAYS BET5 switch 44S, the FEATURE BOOST switch 45S, the spin switch 46S, and the like.

Then the main CPU 71 executes the chance mode symbol random determination process (S63). In this chance mode symbol random determination process, chance mode video reels 3 corresponding to one of the six stages of WAYS BET (WAYS BET1, WAYS BET2, WAYS BET3, WAYS BET4, WAYS BET5, and FEATURE BOOST) selected in the bet/start-check process (S62) are used. For example, when the WAYS BET3 is selected, the chance mode video reels 3 shown in FIG. 21 to FIG. 24 are used. When the WAYS BET5 or the FEATURE BOOST is selected, the chance mode video reels 3 shown in FIG. 29 to FIG. 32 are used.

Then to-be-stopped symbols are randomly selected from the symbols arranged on the chance mode video reels 3*a*, 3*b*, 3*c*, 3*d*, and 3*e* corresponding to the selected WAYS BET. The to-be-stopped symbol is data for determining 5 symbols to be displayed to the symbol display area 4 out of plural symbols forming each symbol array. In the present embodiment, symbols in the middle stage of the symbol display area 4 are selected as the to-be-stopped symbols from the symbols arranged on the chance mode video reels 3*a*, 3*b*, 3*c*, 3*d*, and 3*e*. In this way, 15 symbols displayed in the symbol display area 4 (the upper stage area, the middle stage area, and the lower stage area) are determined.

For example, in case of the first reel 3*a* of the chance mode video reels 3 (WAYS BET1: 3WAYS), when a code number "2" is randomly selected from 196 symbols (code numbers "0" to "195") forming the symbol array, the "PHOENIX" symbol corresponding to the code number "2" is selected as the to-be-stopped symbol (see FIG. 13 to FIG. 16). In case of the second reel 3*b*, when a code number "191" is randomly selected from 196 symbols (code numbers "0" to "195") forming the symbol array, the "FEATURE" symbol corresponding to the code number "191" is selected as the to-be-stopped symbol. In case of the third reel 3*c*, when a code number "19" is randomly selected from 28 symbols (code numbers "0" to "27") forming the symbol array, the "WILD" symbol corresponding to the code number "19" is selected as the to-be-stopped symbol. In case of the fourth reel 3*d*, when a code number "12" is randomly selected from 27 symbols (code numbers "0" to "26") forming the symbol array, the "ACE" symbol corresponding to the code number "12" is selected as the to-be-stopped symbol. In case of the fifth reel 3*e*, when a code number "31" is randomly selected from 34 symbols (code numbers "0" to "33") forming the symbol array, the "FISH" symbol corresponding to the code number "31" is selected as the to-be-stopped symbol.

The main CPU 71 stores the symbols determined as the to-be-stopped symbols on the chance mode video reels 3*a*, 3*b*, 3*c*, 3*d*, and 3*e* in a symbol storing area in the RAM 73.

Subsequently, the main CPU 71 executes an effect contents determination process (S64). The main CPU 71 samples an effect-use random number and randomly determines any of a plurality of predetermined contents of effect.

The main CPU 71 then executes a reverse appeal rewriting process (S65).

In the present embodiment, as indicated by the symbol arrays on the video reels shown in FIG. 8 to FIG. 32, in the present embodiment, the number of the "FEATURE" symbol is larger on the chance mode video reels than on the normal mode video reels. On this account, in the chance mode, the probability of selection of the "FEATURE" symbol as the to-be-stopped symbol in the chance mode symbol random determination process is higher than the probability of selection of the "FEATURE" symbol as the to-be-stopped symbol in the normal mode symbol random determination process.

As such, in the chance mode, the chance mode video reels on which a lot of "FEATURE" symbols are arranged are used. On this account, when the chance mode video reels 3 are scrolled in the later-described symbol display control process, the arrangement of the "FEATURE" symbols viewed during the scroll (i.e., a larger number of "FEATURE" symbols) allows the player to know if the video reels used are the normal mode video reels or the chance mode video reels. When the type of the video reels is known in this way, the current game state (e.g., the normal mode or the chance mode) is known, with the result that interest in the current game state may be deteriorated as compared to a case where the current game state is known only after the stop of the video reels and rearrangement of the symbols. For this reason, a reverse appeal rewriting process is executed in the present embodiment.

Figure 78:
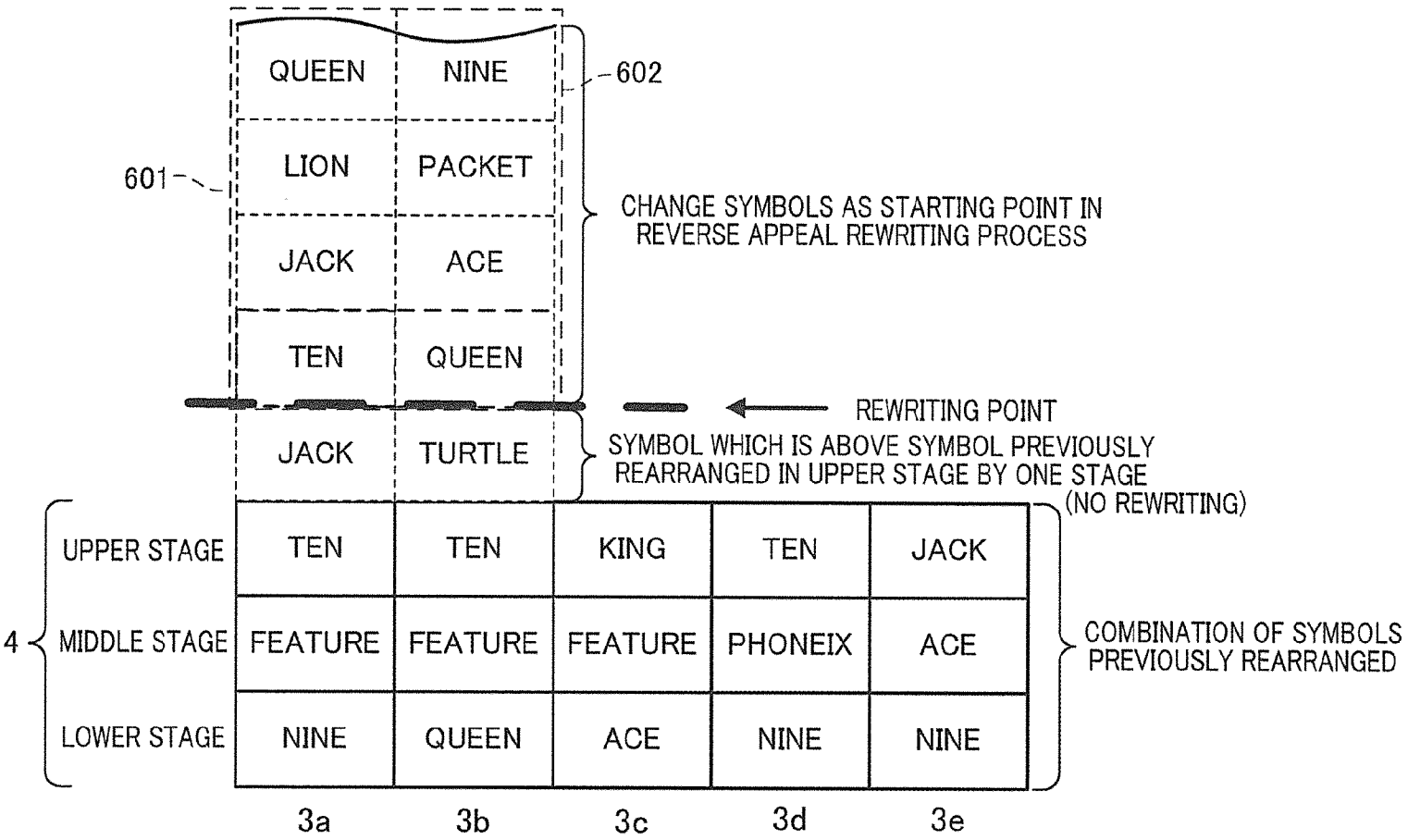
FIG. 78 illustrates the reverse appeal rewriting process in the embodiment of the present invention.

In this reverse appeal rewriting process, an area of each chance mode video reel, in which area no "FEATURE" symbol is provided, is selected as an area which scrolls first when the chance mode video reels 3 are scrolled in the later-described symbol display control process (i.e., the area is set as the starting point of the scroll). For example, when the chance mode video reels 3 (WAYS BET1: 3WAYS) shown in FIG. 13 to FIG. 16 are used, because the "FEATURE" symbol is not provided at the code numbers "0" to "18" of the first reel 3*a*, the code numbers "0" to "18" are set as the starting point of the scroll in the symbol display control process (a rewriting point shown in FIG. 78) as an area 601 where no "FEATURE" symbol is provided (see FIG. 77). To be more specific, as shown in FIG. 78, when the "TEN", "FEATURE". and "NINE" symbols corresponding to the code numbers "18" to "20" are currently rearranged on the first reel 3*a*, the "JACK" symbol corresponding to the code number "17" is provided at the stage immediately above the upper stage of the first reel 3*a* (no rewriting). Furthermore, as shown in FIG. 78, above the rewriting point which is above the upper stage of the first reel 3*a* by two stages, the symbols corresponding to the code numbers "0" to "18" are provided as the area 601 where no "FEATURE" symbol is provided. (FIG. 78 shows a state that only the symbols "QUEEN", "LION", "JACK", and "TEN" corresponding to the code numbers "15" to "18" are provided.) In a similar manner, because the "FEATURE" symbol is not provided at the code numbers "0" to "18" of the second reel 3*b*, the code numbers "0" to "13" are set as the starting point of the scroll in the symbol display control process (a rewriting point shown in FIG. 78) as an area 602 where no "FEATURE" symbol is provided (see FIG. 77). To be more specific, as shown in FIG. 78, when the "TEN", "FEATURE". and "QUEEN" symbols corresponding to the code numbers "20" to "22" are currently rearranged on the second reel 3*b*, the "TURTLE" symbol corresponding to the code number "19" is provided at the stage immediately above the upper stage of the second reel 3*b* (no rewriting). Furthermore, as shown in FIG. 78, above the rewriting point which is above the upper stage of the second reel 3*b* by two stages, the symbols corresponding to the code numbers "0" to "13" are provided as the area 602 where no "FEATURE" symbol is provided. (FIG. 78 shows a state that only the symbols "NINE", "PACKET", "ACE", and "QUEEN" corresponding to the code numbers "10" to "13" are provided.)

The main CPU 71 then executes a symbol display control process (S66). In this symbol display control process, while the areas 601 and 602 in which no "FEATURE" symbol is provided are placed above the rewriting point in the reverse appeal rewriting process, the scroll of the chance mode video reels 3*a*, 3*b*, 3*c*, 3*d*, and 3*e* starts, and after a predetermined time elapses, the to-be-stopped symbols corresponding to the chance mode video reels 3*a*, 3*b*, 3*c*, 3*d*, and 3*e* selected in the chance mode symbol random determination process in S63 stop one by one in the middle stage of the symbol display area 4. That is, 15 symbols including the to-be-stopped symbols are rearranged in the symbol display area 4. For example, when the "PHOENIX" symbol is selected as the to-be-stopped symbol on the first reel 3*a* of the chance mode video reels 3, the "FEATURE" symbol is selected as the to-be-stopped symbol on the second reel 3*b*, the "WILD" symbol is selected as the to-be-stopped symbol on the third reel 3*c*, the "ACE" symbol is selected as the to-be-stopped symbol on the fourth reel 3*d*, and the "FISH" symbol is selected as the to-be-stopped symbol on the fifth reel 3*e*, the "PHOENIX", "FEATURE", "WILD", "ACE", and "FISH" symbols are rearranged in the middle stage of the symbol display area 4. In the upper stage and the lower stage of the symbol display area 4, symbols having code numbers each of which is one number off the to-be-stopped symbols are rearranged.

In the reverse appeal rewriting process, when the chance mode video reels are scrolled in accordance with the symbol display control process in the chance mode, the areas 601 and 602 in which no "FEATURE" symbol is provided are scroll-displayed for a while. Because no "FEATURE" symbol is displayed for a while after the start of the scroll of the chance mode video reels, it is possible to prevent the player from knowing that the game is in the chance mode with which the probability of rearrangement of the "FEATURE" symbol is high.

Figure 73:
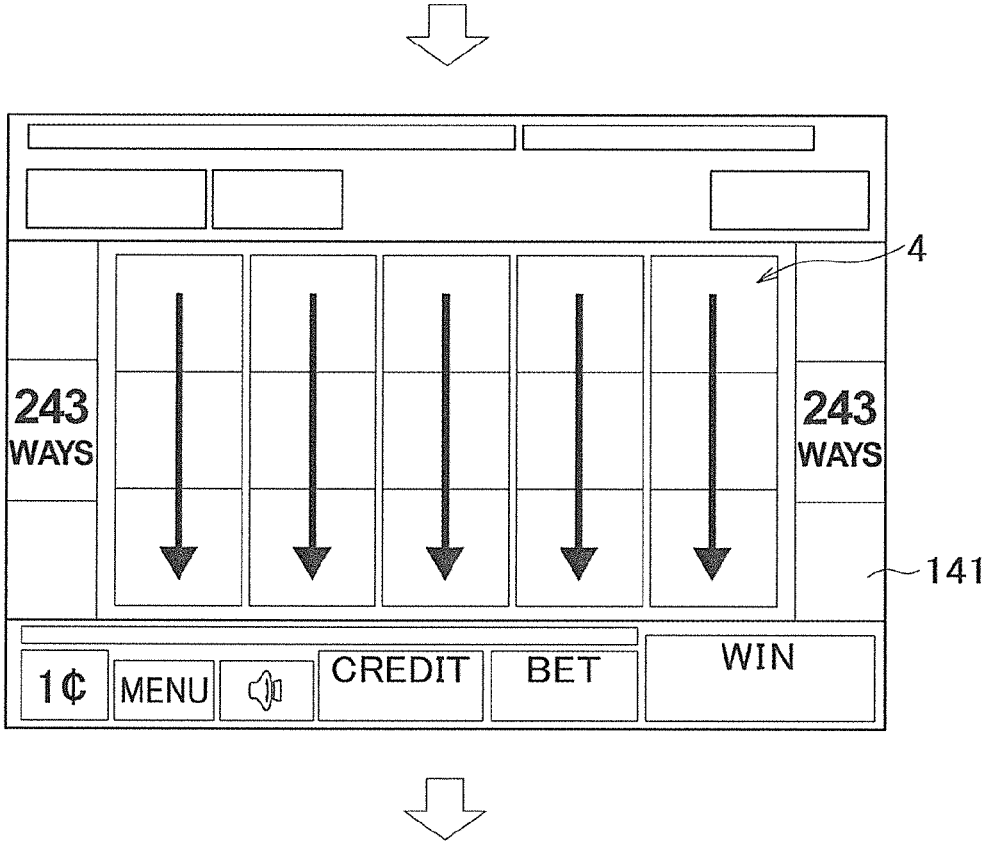
FIG. 73 shows a display state of "FEATURE" symbols in the chance mode related to the embodiment of the present invention.
Figure 74:
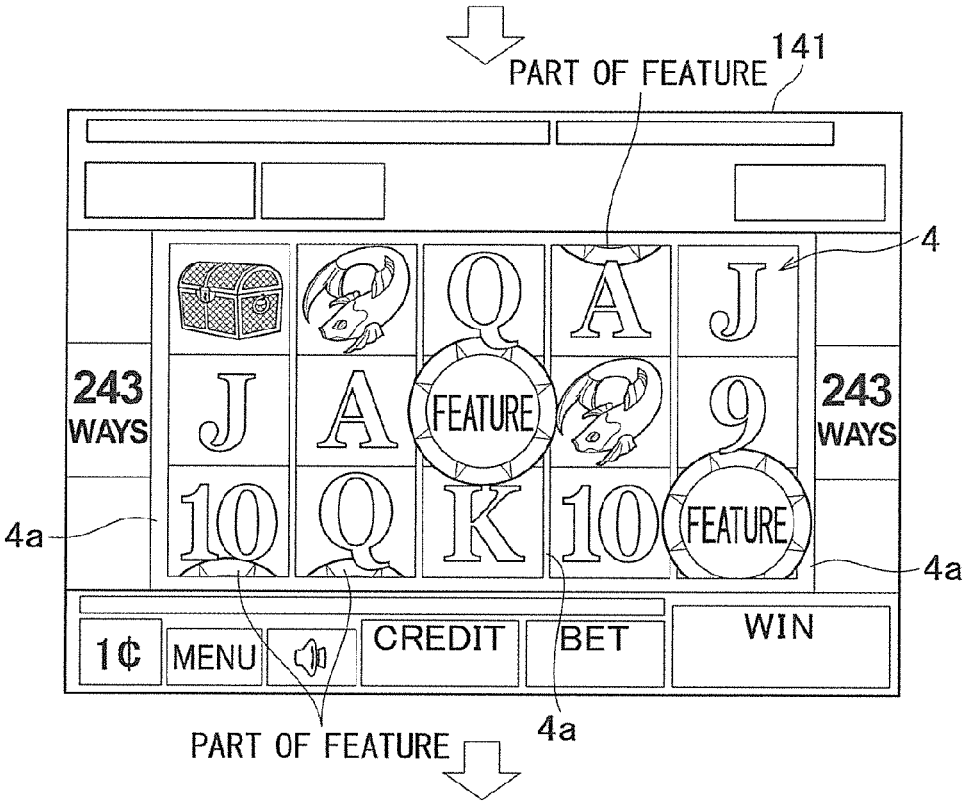
FIG. 74 shows a display state of "FEATURE" symbols in the chance mode related to the embodiment of the present invention.

In addition to the above, in the symbol display control process in the chance mode process in S66, as shown in FIG. 73 and FIG. 74, when the chance mode video reels 3 are scrolled and stopped so that the symbols are rearranged, the "FEATURE" symbol is displayed in the symbol display area 4 to partially overlap the background of the symbols immediately above and below the "FEATURE" symbol.

Furthermore, as shown in FIG. 74, when the "FEATURE" symbol is rearranged in the frame 4*a* of the symbol display area 4, a part of the "FEATURE" symbol overlaps crosswise the front face of the frame 4*a* of the symbol display area 4. When the chance mode video reels 3 are being scrolled, the part of the "FEATURE" symbol does not overlap crosswise the front face of the frame 4*a* of the symbol display area 4. For example, this display is achieved in such a way that, when the chance mode video reels 3 are being scrolled, the layer of the "FEATURE" symbol is arranged to be behind the layer of the frame 4*a* of the symbol display area 4, and when the chance mode video reels 3 stop, the layer of the "FEATURE" symbol is arranged to be in front of the layer of the frame 4*a* of the symbol display area 4.

Because in the chance mode the "FEATURE" symbol is displayed to partially overlap the neighboring symbols, it is easy to distinguish the "FEATURE" symbol from the other symbols when, for example, the chance mode video reels stop. This makes it possible to emphasize that the game is in the chance mode in which the probability of rearrangement of the "FEATURE" symbol is high when the "FEATURE" symbol is displayed to partially overlap the neighboring symbols.

In addition to the above, in the chance mode. when the "FEATURE" symbol is not rearranged in the frame 4*a* of the symbol display area 4 and is rearranged immediately above or below the frame 4*a* of the symbol display area 4, a part of the "FEATURE" symbol is displayed in the frame 4*a* to be behind the symbol which is rearranged in the frame 4*a* and is immediately above or below the "FEATURE" symbol. On this account, the presence of the "FEATURE" symbol is emphasized even if the "FEATURE" symbol is not rearranged in the frame 4*a* of the symbol display area 4.

Furthermore, when the "FEATURE" symbol is rearranged in the frame 4*a* of the symbol display area 4, a part of the "FEATURE" symbol overlaps crosswise the front face of the frame 4*a*. This makes it possible to emphasize the presence of the "FEATURE" symbol.

In addition to the above, because the "FEATURE" symbol is displayed to partially overlap the background of the neighboring symbol, it is easy to distinguish the "FEATURE" symbol from the other symbols when the chance mode video reels stop, without hiding the other symbols.

The main CPU 71 then executes a payout amount determination process (S67). In this process, a symbol combination table (see FIG. 34) stored in the RAM 73 and the bet counter are referred to, to determine whether the symbols stopped in the symbol display area 4 include symbols linked to one another through the first array area to the fifth array area in the WAYS BET set as the subject of the result determination area, thus achieving a winning. In accordance with the type of winning and the value of the bet counter (the credit type used in betting), a benefit such as the payout or the right to play the free game is awarded. The payout awarded is stored in a payout amount storage area of the RAM 73.

Then a payout process is executed (S68). The main CPU 71 adds the value stored in the payout amount storage area to the value of the credit counter in the RAM 73.

Next, the main CPU 71 determines whether or not a free game trigger has been established (S69). In the present embodiment, the trigger for shifting to the free game is the appearance of the "FEATURE" symbol in three or more consecutive positions through the first array area to the fifth array area, irrespective of the area activated by WAYS BET.

The main CPU 71, when determining that the free game trigger has been established (S69: YES), executes a later described free game process (S70).

In the meanwhile, when determining in S69 that the free game trigger is not established (S69: NO) or after S70, the main CPU 71 determines whether rearranged symbols on the symbol display area 4 form a combination satisfying a shifting condition (conditions 1 to 4) (S71). The shifting condition is one of the conditions 1 to 4 described above.

When the symbols rearranged in the symbol display area 4 do not form a combination satisfying the shifting condition (conditions 1 to 4) (S71: NO), the routine proceeds to S61.

In the meanwhile, when the symbols rearranged in the symbol display area 4 form a combination satisfying the shifting condition (conditions 1 to 4) (S71: YES), the shifting random determination process in the chance mode is executed (S72). In this shifting random determination process in the chance mode, with reference to the shifting random determination table in the chance mode (FIG. 35) and the shifting condition (conditions 1 to 4) determined in S71, whether the shifting from the chance mode to the normal mode is performed or the shifting from the chance mode to the normal mode is not performed (i.e., the chance mode is maintained) is randomly determined.

To be more specific, when the condition 1 is satisfied, shifting from the chance mode to the normal mode occurs at a probability of 0/1000 whereas the chance mode is maintained at a probability of 1000/1000 (i.e., the chance mode is always maintained when the condition 1 is satisfied). When the condition 2 is satisfied, shifting from the chance mode to the normal mode occurs at a probability of 0/1000 whereas the chance mode is maintained at a probability of 1000/1000 (i.e., the chance mode is always maintained when the condition 2 is satisfied). When the condition 3 is satisfied, shifting from the chance mode to the normal mode occurs at a probability of 0/1000 whereas the chance mode is maintained at a probability of 1000/1000 (i.e., the chance mode is always maintained when the condition 3 is satisfied). When the condition 4 is satisfied, shifting from the chance mode to the normal mode occurs at a probability of 80/1000 and the chance mode is maintained at a probability of 920/1000.

Subsequently, whether the shifting from the chance mode to the normal mode is to be performed as a result of the shifting random determination process in the chance mode in S72 is determined (S73). When not shifting from the chance mode to the normal mode (S73: NO), the chance mode is maintained and the routine proceeds to S61.

When shifting from the chance mode to the normal mode (S73: YES), the process is terminated and the routine proceeds to the normal mode.

(Free Game Process)

Figure 43:
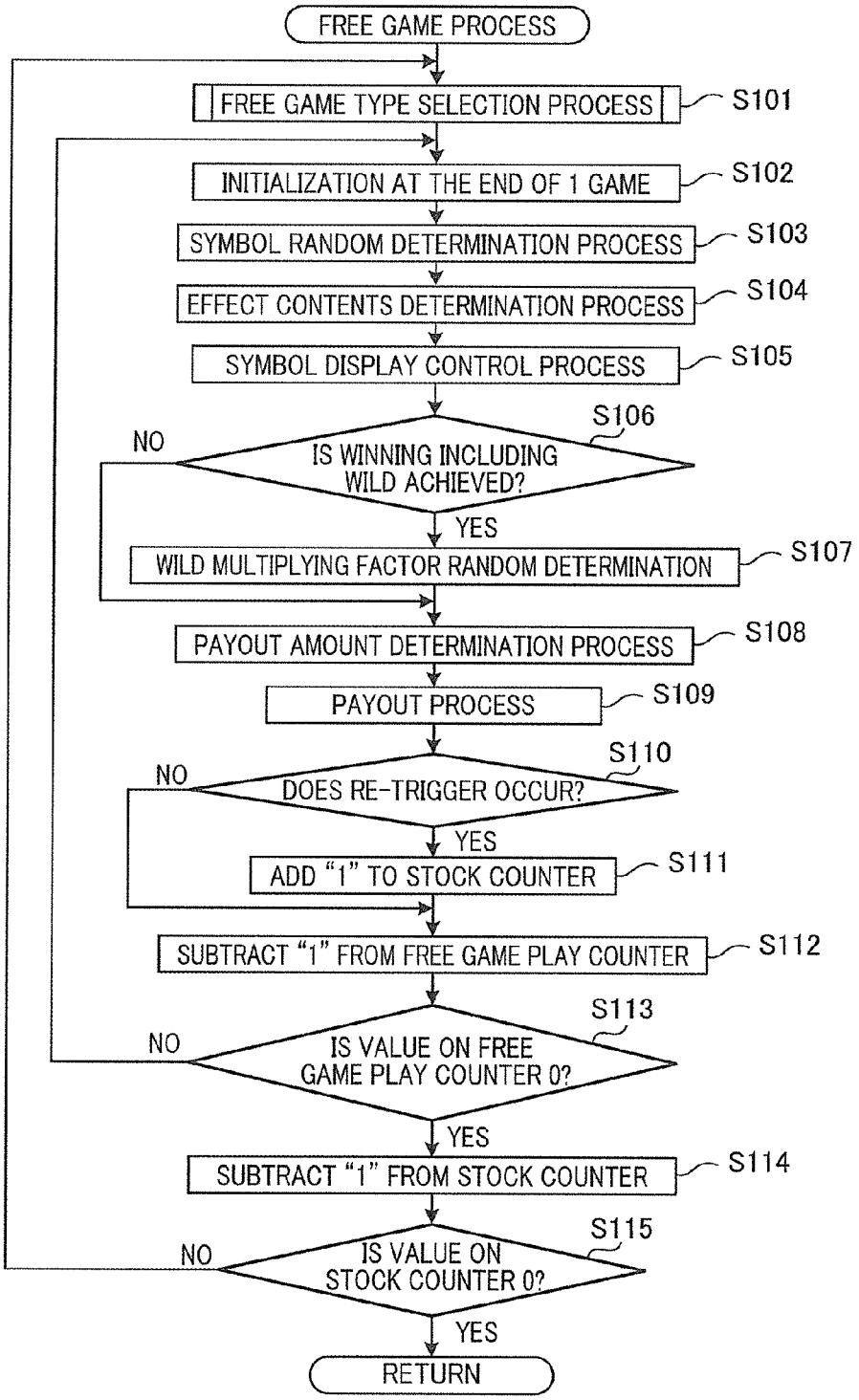
FIG. 43 is a flowchart of a free game process of the slot machine related to the embodiment of the present invention.

The following describes a free game process with reference to FIG. 43. FIG. 43 is a flowchart of a free game process of the slot machine related to the embodiment of the present invention.

First, the main CPU 71 executes a later-described free game type selection process (S101). In this free game type selection process, as one of the options A to G displayed on the lower image display panel 141 is selected, the runnable number of times of execution of the free game (number of game play) and a set of multiplying factors of a payout awarded when a combination including the WILD symbol is established in the free game (WILD multiplying factors) are determined.

Next, the main CPU 71 executes the at-one-game-end initialization process (S102) in the same manner as the step S12.

The main CPU 71 then executes a symbol random determination process in the free game (S103). In this symbol random determination process in the free game process, normal mode video reels 3 corresponding to one of the six stages of WAYS BET (WAYS BET1, WAYS BET2, WAYS BET3, WAYS BET4, WAYS BET5, and FEATURE BOOST) selected in the bet/start-check process in the normal mode (S13) or the bet/start-check process in the chance mode (S62) are used. For example, when the WAYS BET3 is selected, the normal mode video reels 3 shown in FIG. 10 are used. When the WAYS BET5 or the FEATURE BOOST is selected, the normal mode video reels 3 shown in FIG. 12 are used.

Then to-be-stopped symbols are randomly selected from the symbols arranged on the normal mode video reels 3*a*, 3*b*, 3*c*, 3*d*, and 3*e* corresponding to the selected WAYS BET. The to-be-stopped symbol is data for determining 5 symbols to be displayed to the symbol display area 4 out of plural symbols forming each symbol array. In the present embodiment, symbols in the middle stage of the symbol display area 4 are selected as the to-be-stopped symbols from the symbols arranged on the normal mode video reels 3*a*, 3*b*, 3*c*, 3*d*, and 3*e*. In this way, 15 symbols displayed in the symbol display area 4 (the upper stage area, the middle stage area, and the lower stage area) are determined.

The main CPU 71 stores the symbols determined as the to-be-stopped symbols on the normal mode video reels 3*a*, 3*b*, 3*c*, 3*d*, and 3*e* in a symbol storing area in the RAM 73.

Subsequently, the main CPU 71 executes an effect contents determination process (S104). The main CPU 71 samples an effect-use random number and randomly determines any of a plurality of predetermined contents of effect.

The main CPU 71 then executes a symbol display control process (S105). In this symbol display control process, the scroll of the normal mode video reels 3*a*, 3*b*, 3*c*, 3*d*, and 3*e* starts, and after a predetermined time elapses, the to-be-stopped symbols corresponding to the normal mode video reels 3*a*, 3*b*, 3*c*, 3*d*, and 3*e* selected in the symbol random determination process in the free game in S103 stop one by one in the middle stage of the symbol display area 4. That is, 15 symbols including the to-be-stopped symbols are rearranged in the symbol display area 4.

The main CPU 71 then determines whether the symbols rearranged in the symbol display area 4 include a winning combination of symbols including the "WILD" symbol (S106). If a winning combination including the "WILD" symbol is established (S106: YES), WILD multiplying factor random determination is executed (S107). In this WILD multiplying factor random determination, a multiplying factor of a payout is determined based on random determination probabilities (WILD multiplying factor) of the set of the multiplying factors of the payout determined in the free game type selection process in S101 (see FIG. 36).

For example, when "Free Game B" is selected in the free game type selection process in S101, with reference to the free game type table in FIG. 36, the multiplying factor for the payout is determined as "×2" at a random determination probability of "205/1000", "×3" at a random determination probability of "251/1000", or "×5" at a random determination probability of "544/1000".

Figure 60:
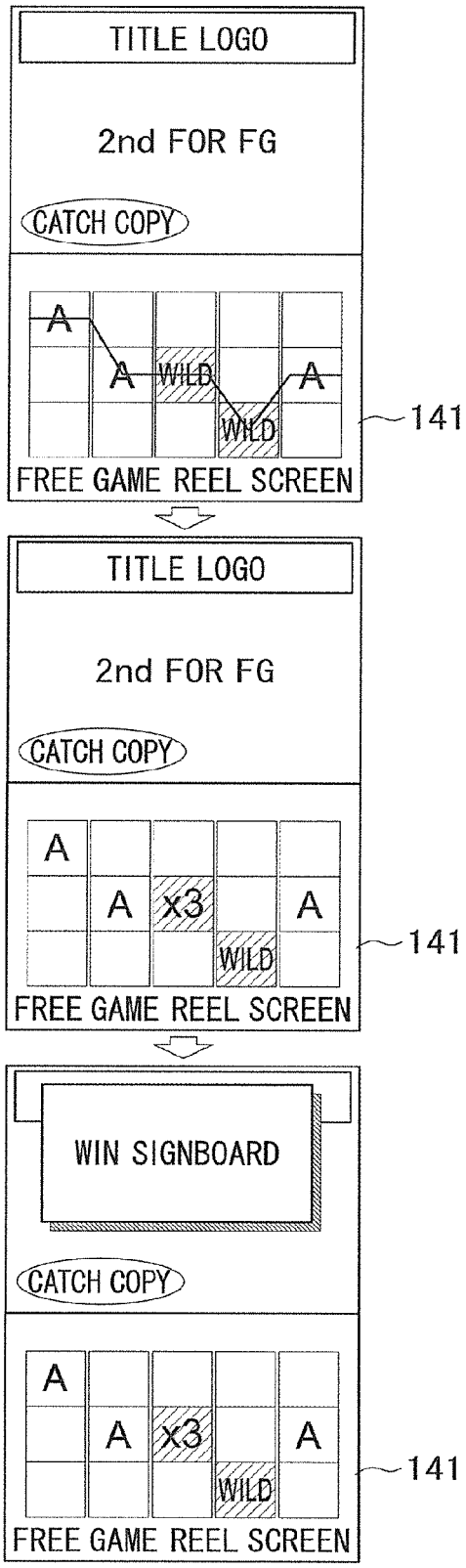
FIG. 60 shows an effect in WILD multiplying factor random determination in the slot machine of the embodiment of the present invention.

Furthermore, as shown in FIG. 60, when the WILD multiplying factor random determination is performed as the winning combination including the "WILD" symbol is established and the multiplying factor of the payout is determined as "×3", the determined multiplying factor "×3" is displayed on the leftmost "WILD" symbol among the rearranged "WILD" symbols.

Subsequently, after S107 or when no winning combination of symbols including the "WILD" symbol is established in S106 (S106: NO), the main CPU 71 executes a payout amount determination process (S108). In this process, a symbol combination table (see FIG. 34) stored in the RAM 73 is referred to, to determine whether the symbols stopped in the symbol display area 4 include symbols linked to one another through the first array area to the fifth array area in the WAYS BET set as the subject of the result determination area, thus achieving a winning. In accordance with the type of winning, the value of the bet counter (the credit type used in betting), and the multiplying factor of the payout determined in the WILD multiplying factor random determination, a benefit such as the payout or the right to play the free game is awarded. The payout awarded is stored in a payout amount storage area of the RAM 73. For example, when a winning is achieved by a combination of three "PHOENIX" including the "WILD" symbol, the value of the bet counter is "5", and the multiplying factor of the payout determined in the WILD multiplying factor random determination is "×3", "50"×"5"×"3"="750" credits are determined as the payout with reference to the symbol combination table shown in FIG. 34, and stored in the payout amount storage area in the RAM 73. It should be noted that, in the free game, the stage of the WAYS BET and the bet amount in the normal mode or the chance mode in which the right to play the free game is awarded are inherited.

Then a payout process is executed (S109). The main CPU 71 adds the value stored in the payout amount storage area to the value of the credit counter in the RAM 73.

Figure 61:
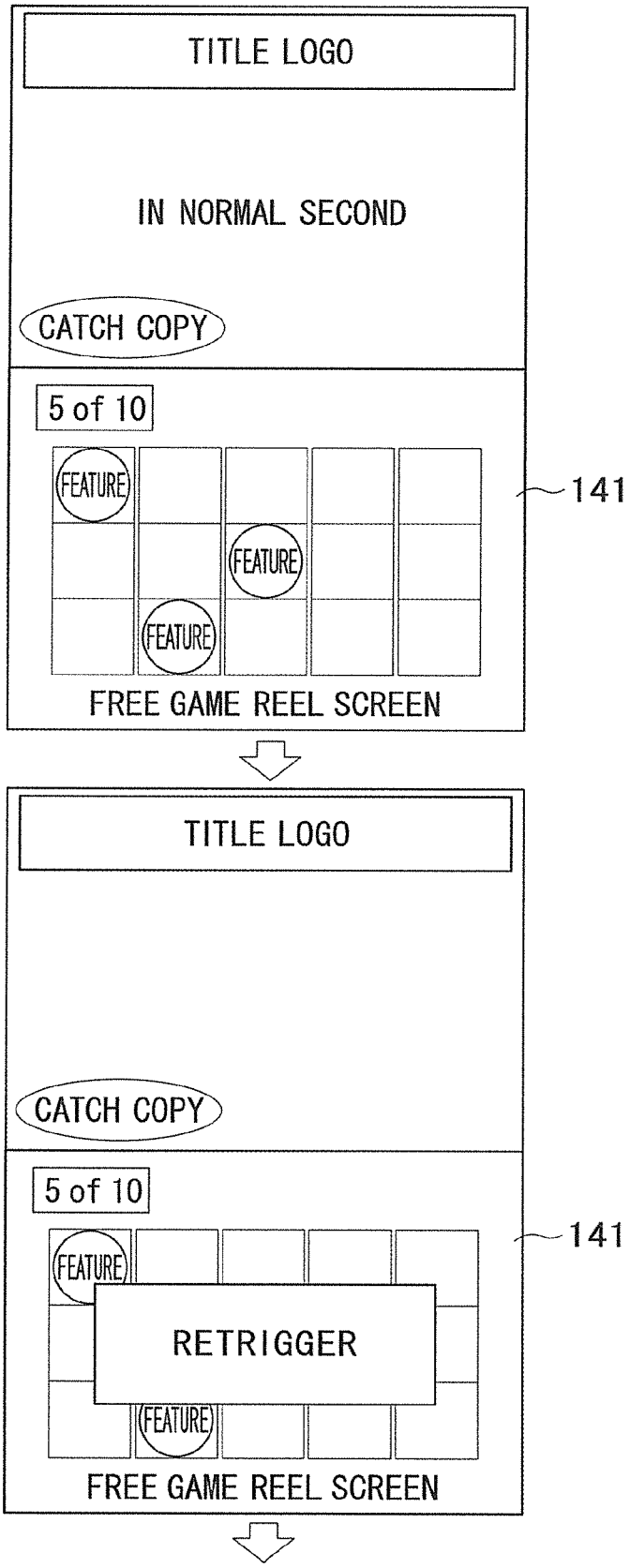
FIG. 61 shows a re-trigger effect in the slot machine related to the embodiment of the present invention.
Figure 62:
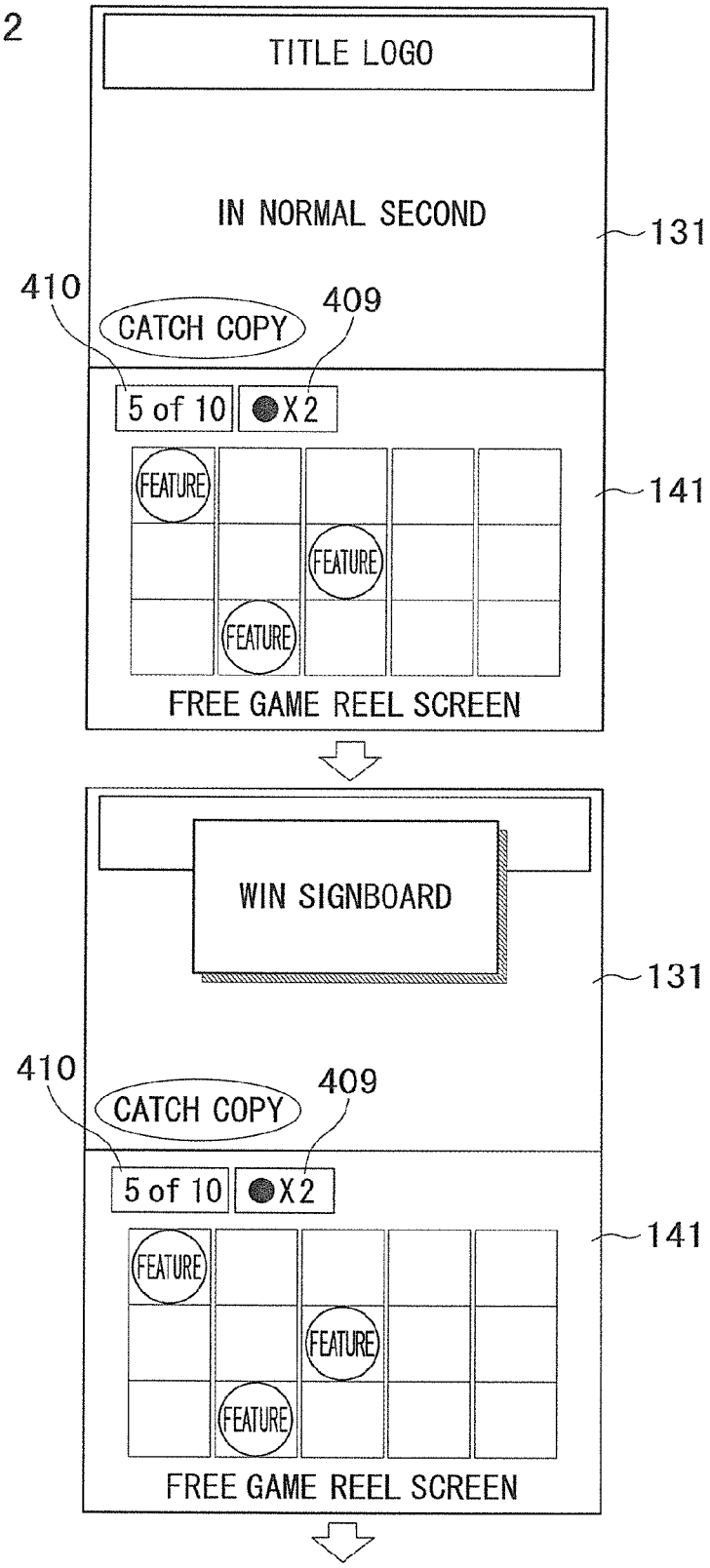
FIG. 62 shows a re-trigger effect in the slot machine related to the embodiment of the present invention.

Next, the main CPU 71 determines whether or not a re-trigger occurred (S110). A condition of the re-trigger in the present embodiment is such that the "FEATURE" symbol occurs in three or more consecutive positions through the first array area to the fifth array area, irrespective of the area activated by WAYS BET. When it is determined that the re-trigger has occurred (S110: YES), the main CPU 71 adds 1 to a value of a stock counter in the RAM 73 and updates the value of the same (S111). Furthermore, when it is determined that the re-trigger has occurred, as shown in FIG. 61, a re-trigger signboard (RETRIGGER) is displayed on the lower image display panel 141 to notify that the re-trigger has occurred. Furthermore, as shown in FIG. 62, addition of 1 to the value of the stock counter 409 is displayed.

When determining that no re-trigger is established (S110: NO) or after S111, the main CPU 71 subtracts 1 from the value stored in the free game play counter (S112).

The main CPU 71 then determines whether the value on the free game play counter is 0 (S113). When determining that the value of the free game play counter is not "0" (S113: NO), the main CPU 71 proceeds to S102.

Figure 63:
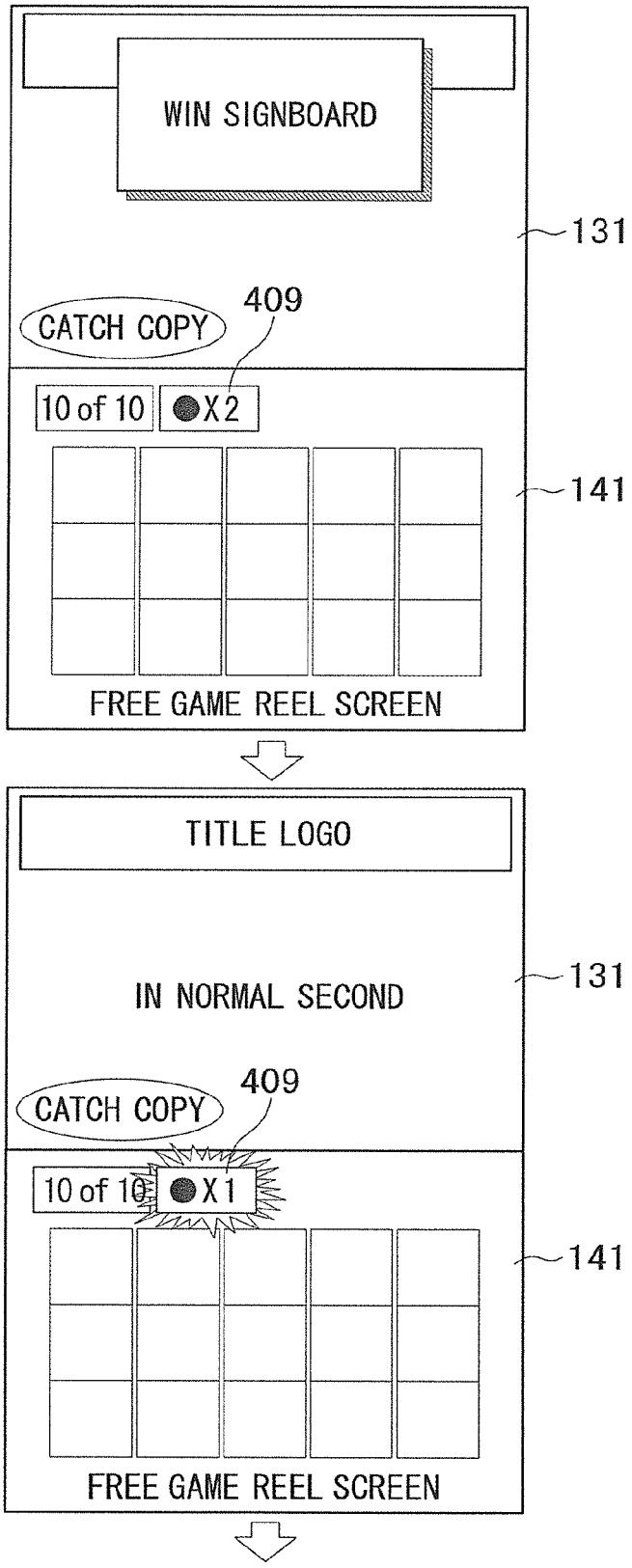
FIG. 63 shows a re-trigger effect in the slot machine related to the embodiment of the present invention.

In the meanwhile, when it is determined that the value of the free game play counter is 0 (S113: YES), the main CPU 71 subtracts "1" from the value of the stock counter (S114). At this stage, as shown in FIG. 63, "1" is subtracted from the value of the stock counter 409 and an effect that the stock counter 409 emits light is carried out.

Figure 64:
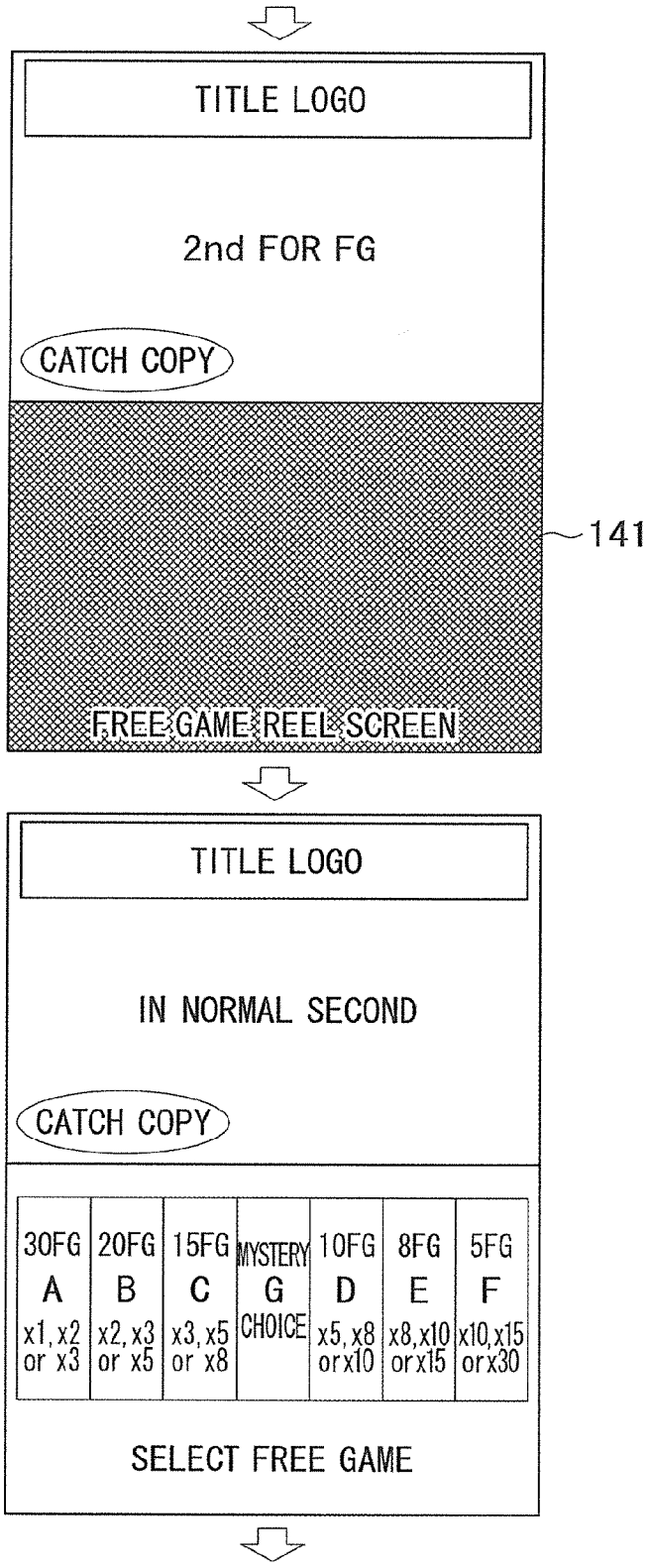
FIG. 64 shows a re-trigger effect in the slot machine related to the embodiment of the present invention.
Figure 65:
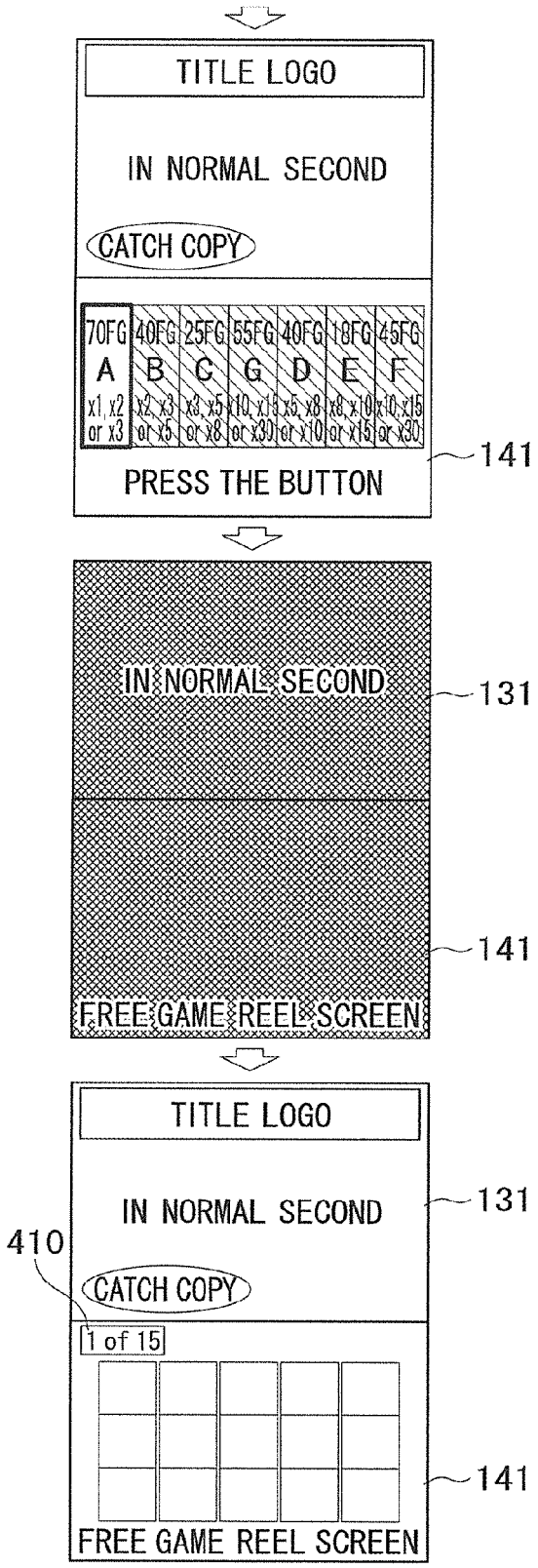
FIG. 65 shows a re-trigger effect in the slot machine related to the embodiment of the present invention.

The main CPU 71 then determines whether the value on the stock counter is 0 (step S115). When determining that the value on the stock counter is not 0 (S115: NO), the main CPU 71 proceeds to the step S101. At this stage, as shown in FIG. 64, dark change is performed on the lower image display panel 141 and seven options A to G are displayed on the lower image display panel 141 again. Thereafter, as shown in FIG. 65, the value of the free game play counter 410 returns to "1" and the free game is continued.

Figure 66:
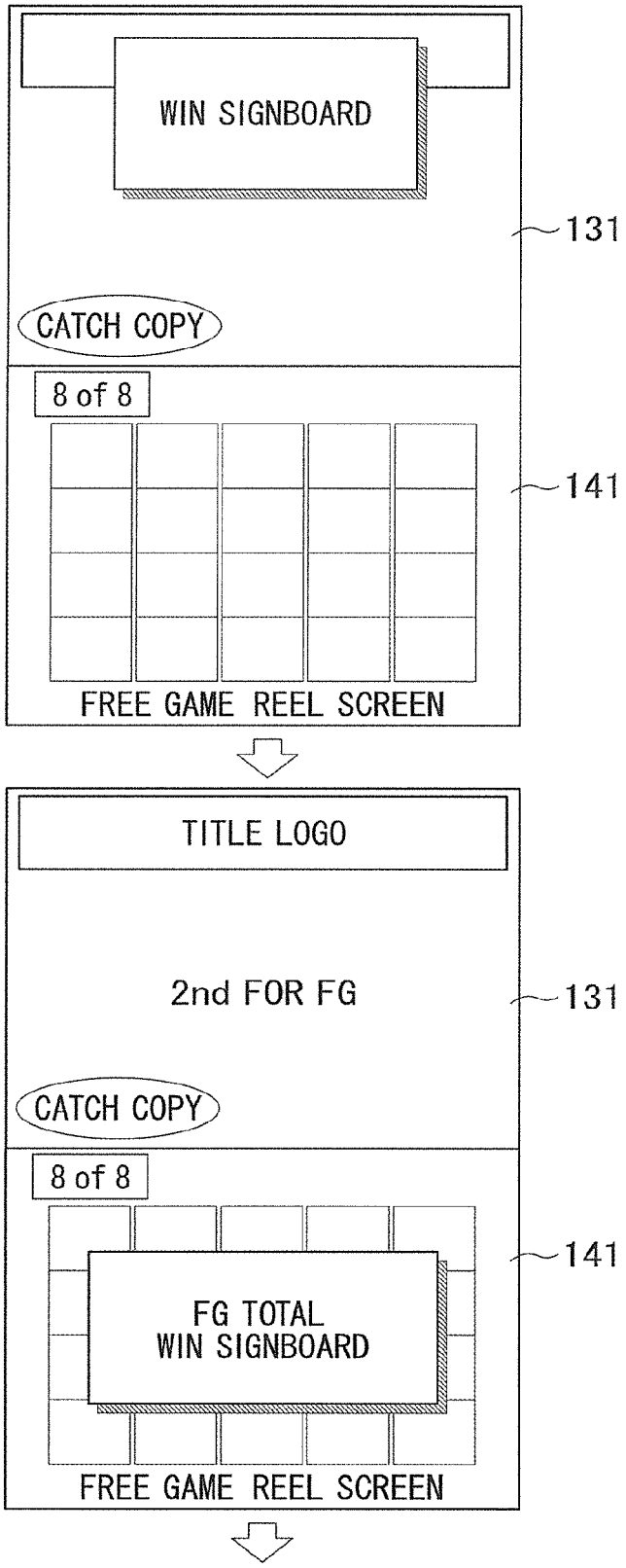
FIG. 66 shows an effect at the end of the free game in the slot machine related to the embodiment of the present invention.
Figure 67:
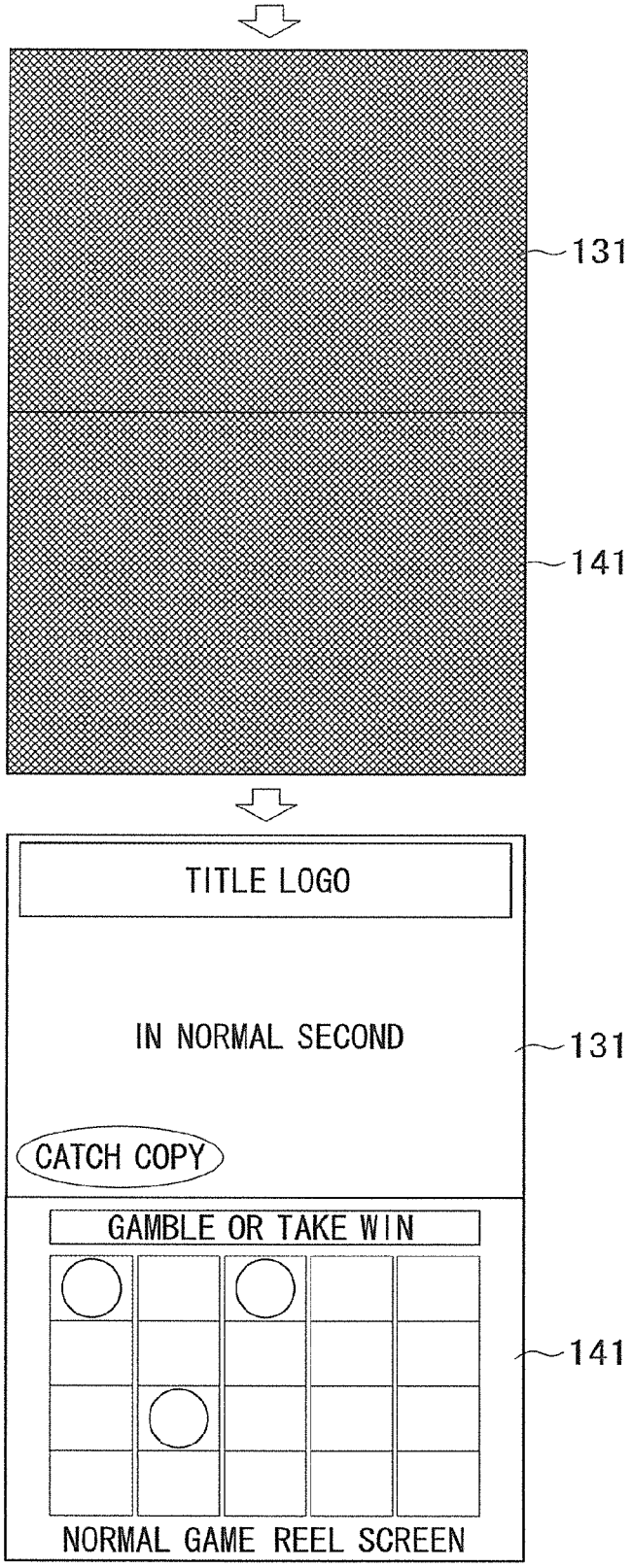
FIG. 67 shows an effect at the end of the free game in the slot machine related to the embodiment of the present invention.

In the meanwhile, when the value on the stock counter is 0 (S115: YES), the free game process is terminated. At this stage, as shown in FIG. 66, "WIN signboard" is displayed on the upper image display panel 131. Then "FG TOTAL WIN signboard" is displayed on the lower image display panel 141 to display the total payout obtained in the free game. Thereafter, as shown in FIG. 67, dark change is performed on the upper image display panel 131 and the lower image display panel 141, and the original game screen returns.

(Free Game Type Selection Process)

Figure 44:
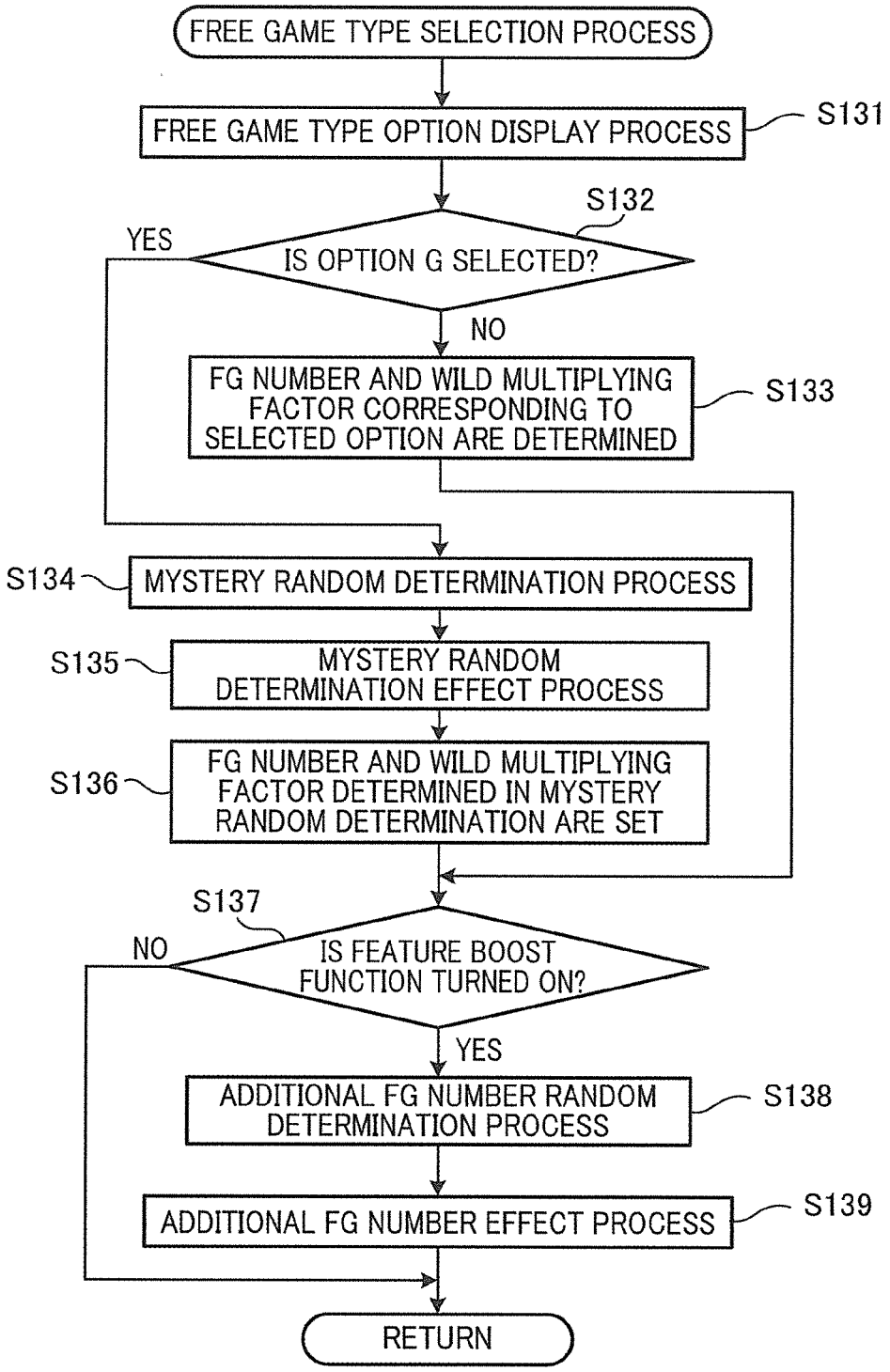
FIG. 44 is a flowchart of a free game type selection process in the slot machine of the embodiment of the present invention.

The following describes a free game type selection process with reference to FIG. 44. The free game type selection process is executed in the free game process shown in FIG. 43.

Figure 52:
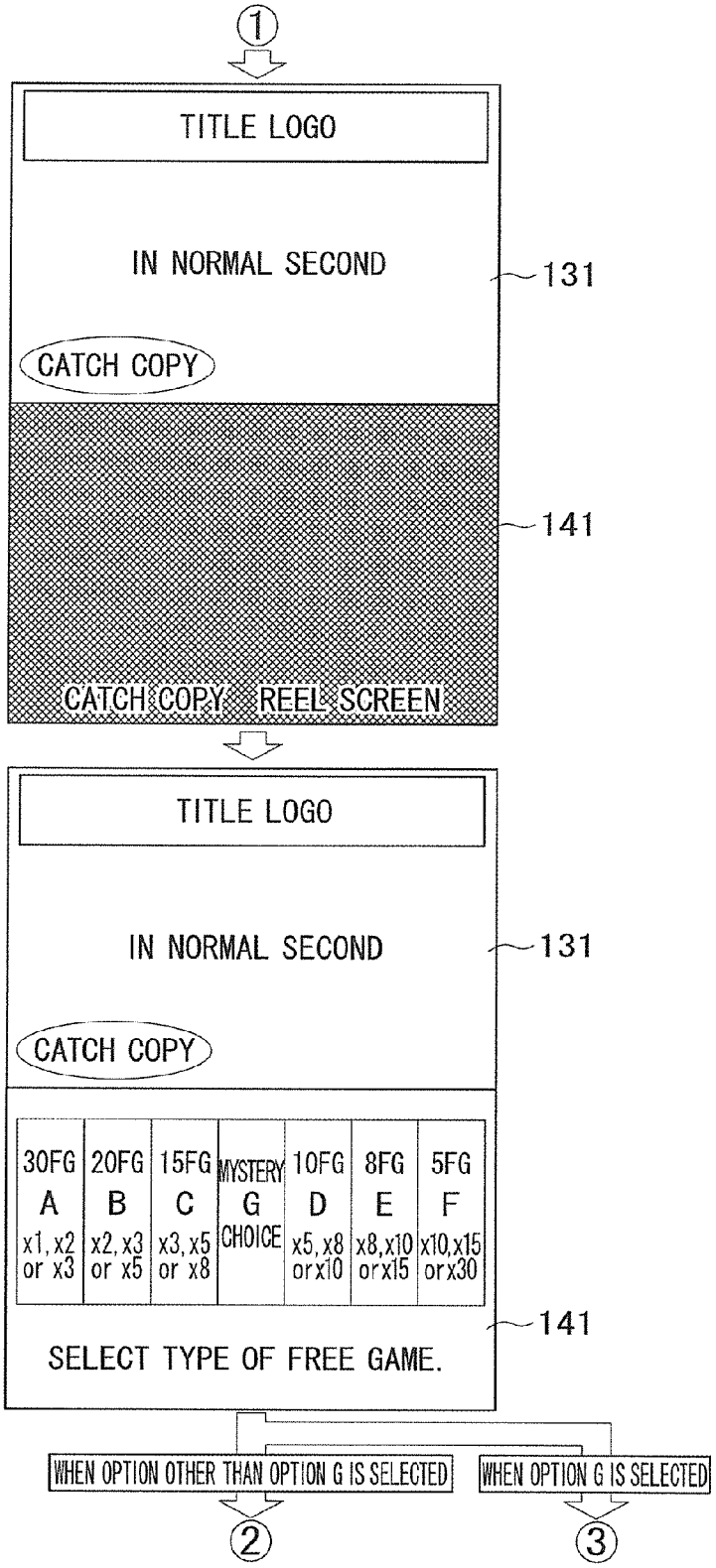
FIG. 52 shows an effect in the free game in the slot machine of the embodiment of the present invention.

To begin with, the main CPU 71 executes a free game type option display process (S131). In this free game type option display process, to begin with, as shown in FIG. 52, seven options A to G are displayed on the lower image display panel 141. The options A to G correspond to the respective types of the free game (Free Game A to Free Game G) indicated in the free game type table shown in FIG. 36.

Subsequently, as shown in FIG. 52, a comment encouraging the player to select one of the options A to G ("Select Type of Free Game") is displayed on the lower image display panel 141.

When one of the options A to G is touched (selected) through the touch panel 114, the main CPU 71 determines if the option G (Free Game G (Mystery)) is selected (S132). When the option G is not selected (S132: NO), it is determined that one of the options A to F is selected, and with reference to the free game type table shown in FIG. 36, the runnable number of times of running the free game (number of game play) and a set of multiplying factors for a payout (WILD multiplying factors) corresponding to the selected one of the options A to F are determined (S133). The determined number of times of execution of the free game (number of game play) is added to the free game play counter (stored in the RAM 73).

Figure 53:
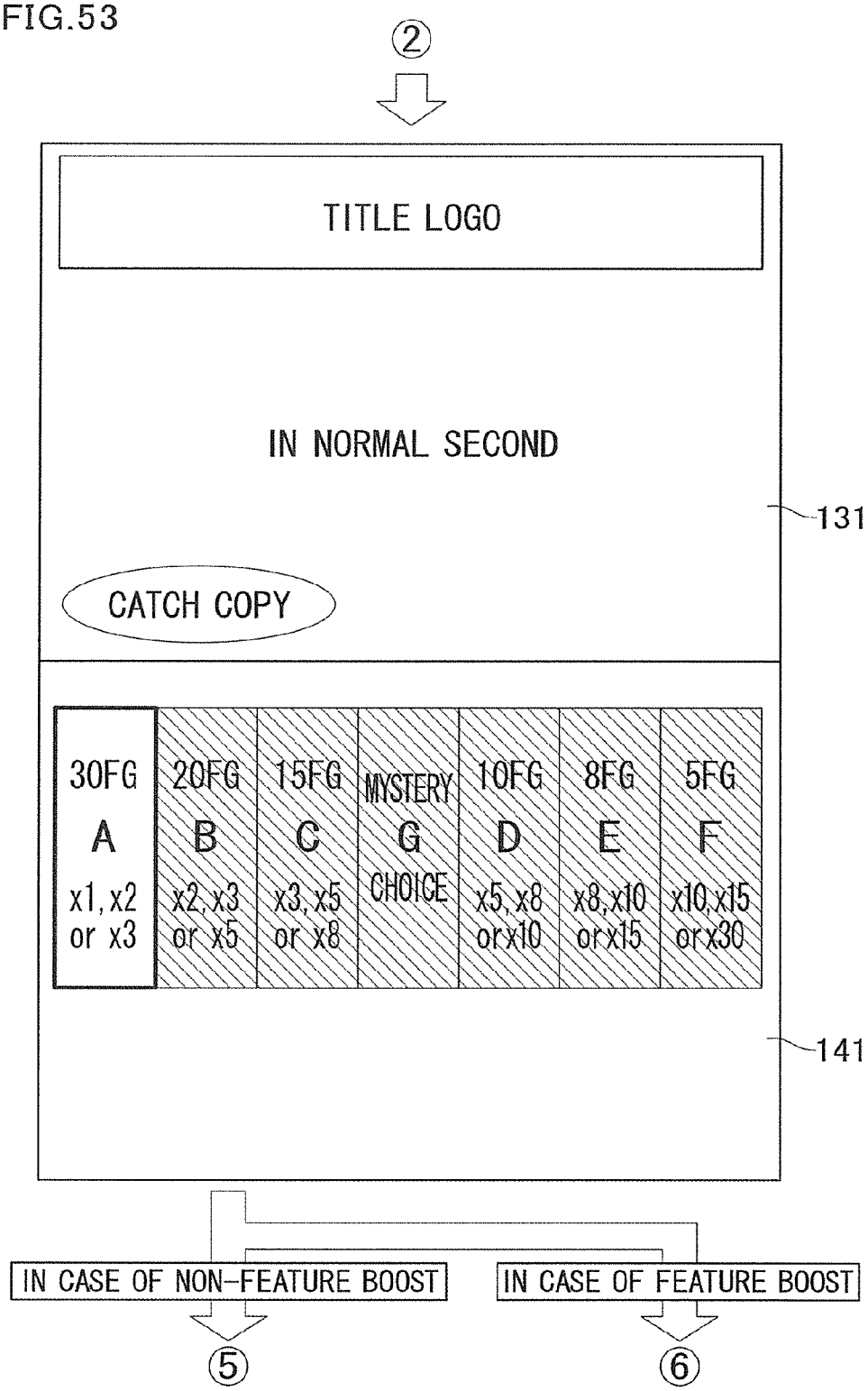
FIG. 53 shows an effect in the free game in the slot machine of the embodiment of the present invention.

For example, when the "Free Game A" which is the option A is selected, as shown in FIG. 53, the free game becomes runnable 30 times and "30" is added to the free game play counter.

In the meanwhile, when the option G is selected (S132: YES), a mystery random determination process is executed (S134). In this mystery random determination process, with reference to the free game number-multiplying factor determination table (see FIG. 37), the runnable number of times of execution of the free game (number of game play) and a set of multiplying factors of a payout awarded when a combination including the WILD symbol is established in the free game are randomly determined. In the mystery random determination process, random determination is performed based on a random determination probability in "F_BOOST" of the free game number-multiplying factor determination table when the FEATURE BOOST function is turned on, or random determination is performed based on a random determination probability in "Normal" in the free game number-multiplying factor determination table when the FEATURE BOOST function is turned off.

For example, in a state that the FEATURE BOOST function is on (F_BOOST), when ID "12" is achieved at the probability of 12/180 as a result of the mystery random determination process, the free game becomes runnable 15 times, a set of multiplying factors of a payout identical with that in the case of the selection of the "Free Game A" is selected, and the multiplying factor for the payout awarded in the free game when a combination including the WILD symbol is established is determined as "×1" at a random determination probability of "244/1000", "×2" at a random determination probability of "256/1000", or "×3" at a random determination probability of "500/1000".

After the mystery random determination process in S134, a mystery random determination effect process is executed (S135). In the mystery random determination effect process, to begin with, as shown in FIG. 68, when the option G is selected from the options A to G, the option G is displayed in close-up.

Figure 68:
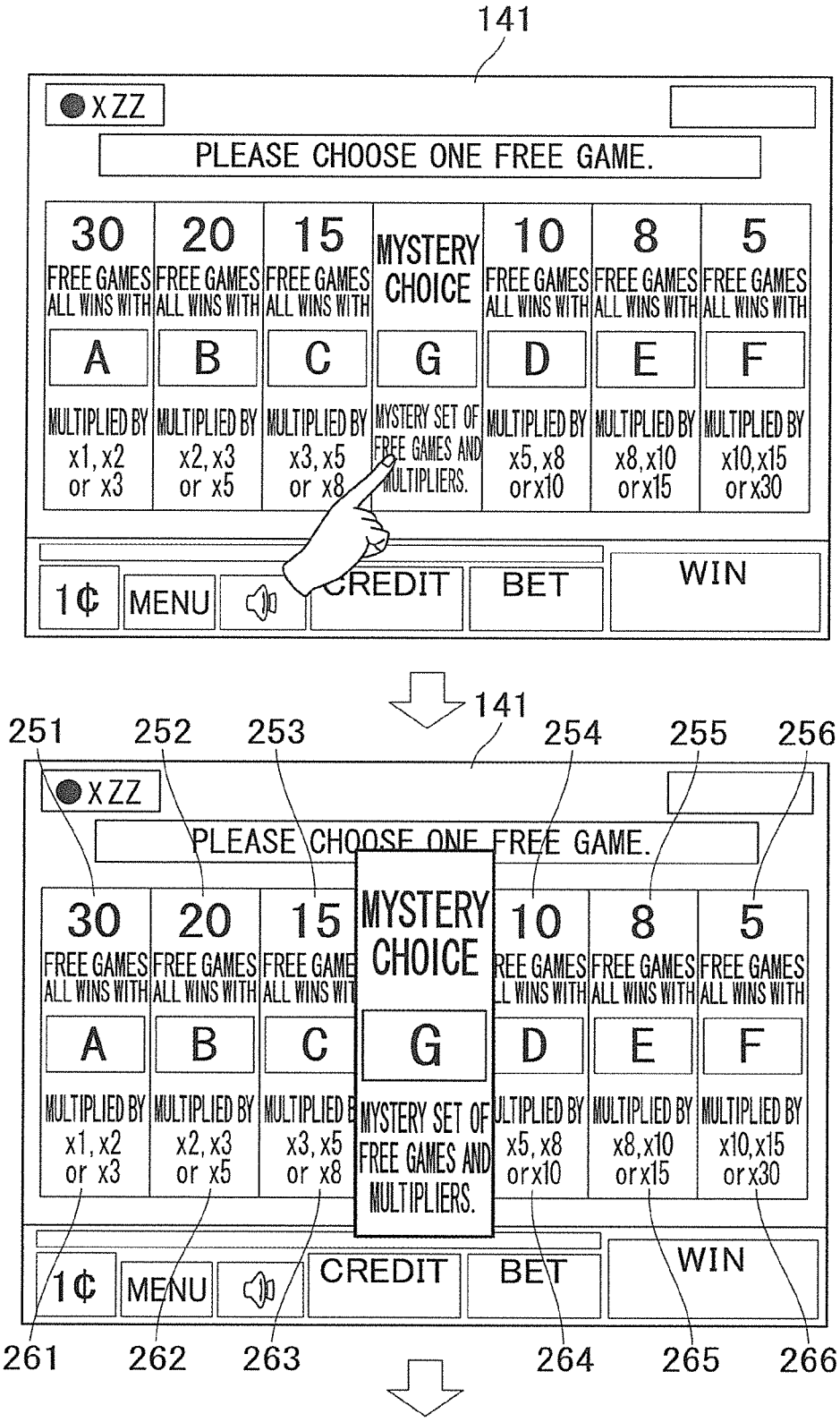
FIG. 68 shows an effect in a mystery random determination process in the slot machine of the embodiment of the present invention.

Subsequently, as shown in FIG. 68, the following areas are displayed above the options A to F: an area 251 corresponding to "30 times" which is the number of times of execution of "Free Game A"; an area 252 corresponding to "20 times" which is the number of times of execution of "Free Game B"; an area 253 corresponding to "15 times" which is the number of times of execution of "Free Game C"; an area 254 corresponding to "10 times" which is the number of times of execution of "Free Game D"; an area 255 corresponding to "8 times" which is the number of times of execution of "Free Game E"; and an area 256 corresponding to "5 times" which is the number of times of execution of "Free Game F". Subsequently, the following areas are displayed below the options A to F: an area 261 corresponding to "×1, ×2, ×3" which is a set of multiplying factors of a payout of "Free Game A"; an area 262 corresponding to "×2, ×3, ×5" which is a set of multiplying factors of a payout of "Free Game B"; an area 263 corresponding to "×3, ×5, ×8" which is a set of multiplying factors of a payout of "Free Game C"; an area 264 corresponding to "×5, ×8, ×10" which is a set of multiplying factors of a payout of "Free Game D"; an area 265 corresponding to "×8, ×10, ×15" which is a set of multiplying factors of a payout of "Free Game E"; and an area 266 corresponding to "×10, ×15, ×30" which is a set of multiplying factors of a payout of "Free Game F".

Figure 54:
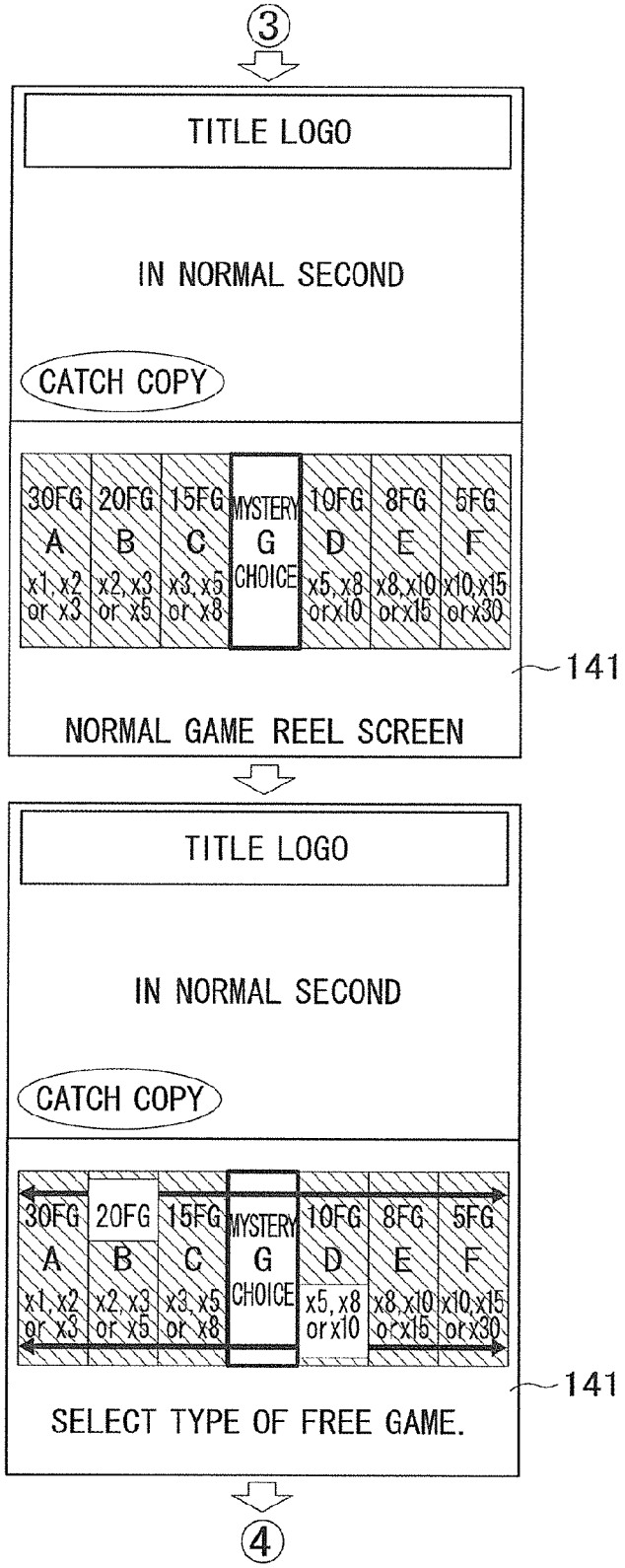
FIG. 54 shows an effect in the free game in the slot machine of the embodiment of the present invention.
Figure 70:
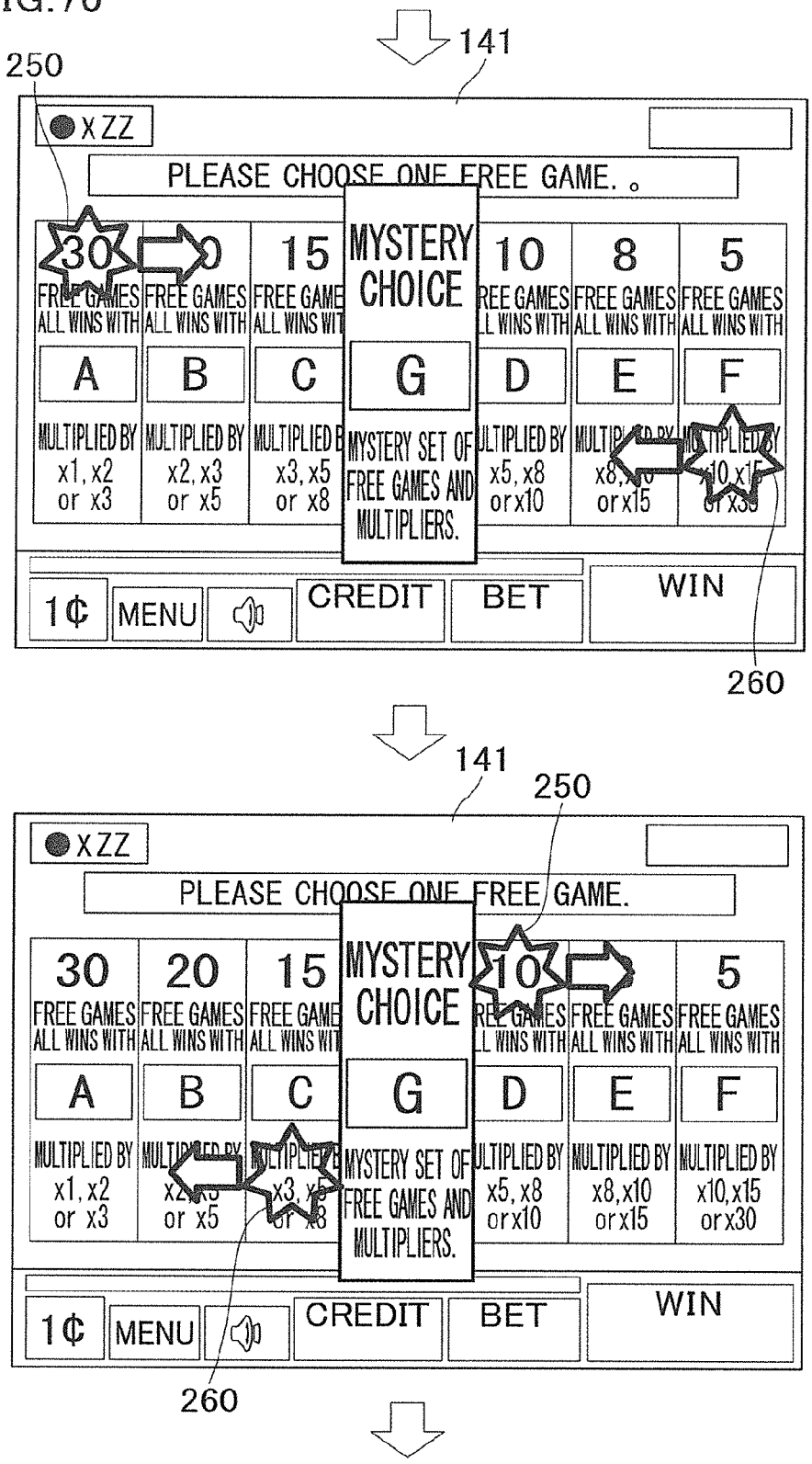
FIG. 70 shows an effect in the mystery random determination process in the slot machine of the embodiment of the present invention.
Figure 71:
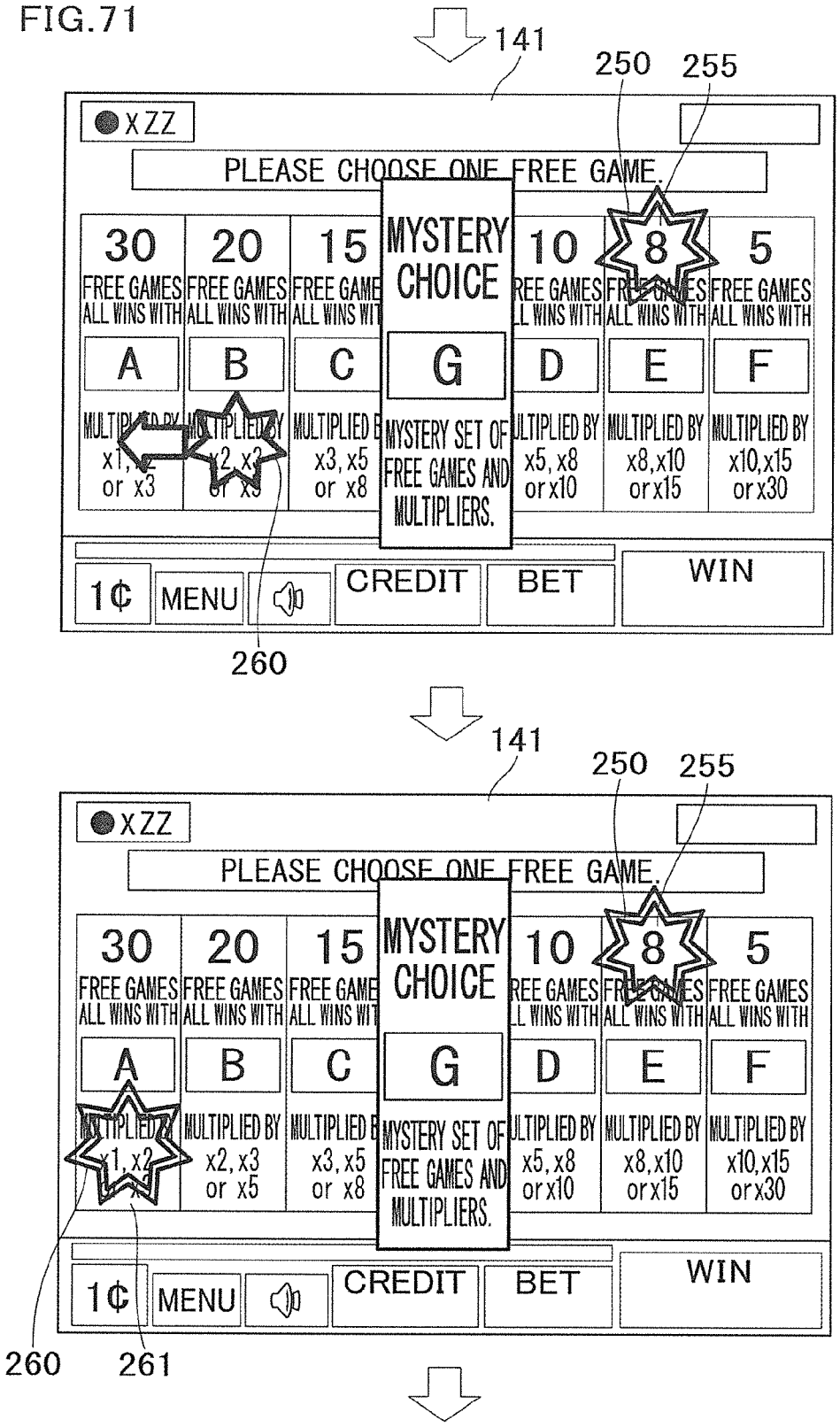
FIG. 71 shows an effect in the mystery random determination process in the slot machine of the embodiment of the present invention.

Subsequently, as shown in FIG. 69 and FIG. 70 (see FIG. 54), the areas 251 to 256 are repeatedly turned on and off in such a way that turning on the area 253→turning off the area 253 and turning on the area 252→turning off the area 252 and turning on the area 251, and so on, with the result that an effect of moving a winning indicator 250 moves left and right in the areas 251 to 256 is carried out. After the effect of movement of the winning indicator 250 left and right in the areas 251 to 256 is displayed, an effect is performed as follows: the winning indicator 250 stops at an area corresponding to the runnable number of times of execution of the free game (number of game play) determined in the mystery random determination process in S134, and the area where the winning indicator 250 stops flickers. For example, when the number of times of execution of the free game is determined to be "8 times" in the mystery random determination process, as shown in FIG. 71, the winning indicator 250 stops at the area 255 corresponding to the "8 times", and this area 255 flickers.

Subsequently, as shown in FIG. 69 and FIG. 70 (see FIG. 54), the areas 261 to 266 are repeatedly turned on and off in such a way that turning on the area 264→turning off the area 264 and turning on the area 265→turning off the area 265 and turning on the area 266, and so on, with the result that an effect of moving a winning indicator 260 moves left and right in the areas 261 to 266 is carried out. After the effect of movement of the winning indicator 260 left and right in the areas 261 to 266 is displayed, an effect is performed as follows: the winning indicator 260 stops at an area corresponding to the set of the multiplying factors of the payout determined in the mystery random determination process in S134 and the area where the winning indicator 260 stops flickers. For example, when the set of the multiplying factors of the payout is determined as "×1, ×2, ×3" in the mystery random determination process, as shown in FIG. 71, the winning indicator 260 stops at the area 261 corresponding to the "×1, ×2, ×3", and this area 261 flickers.

Figure 55:
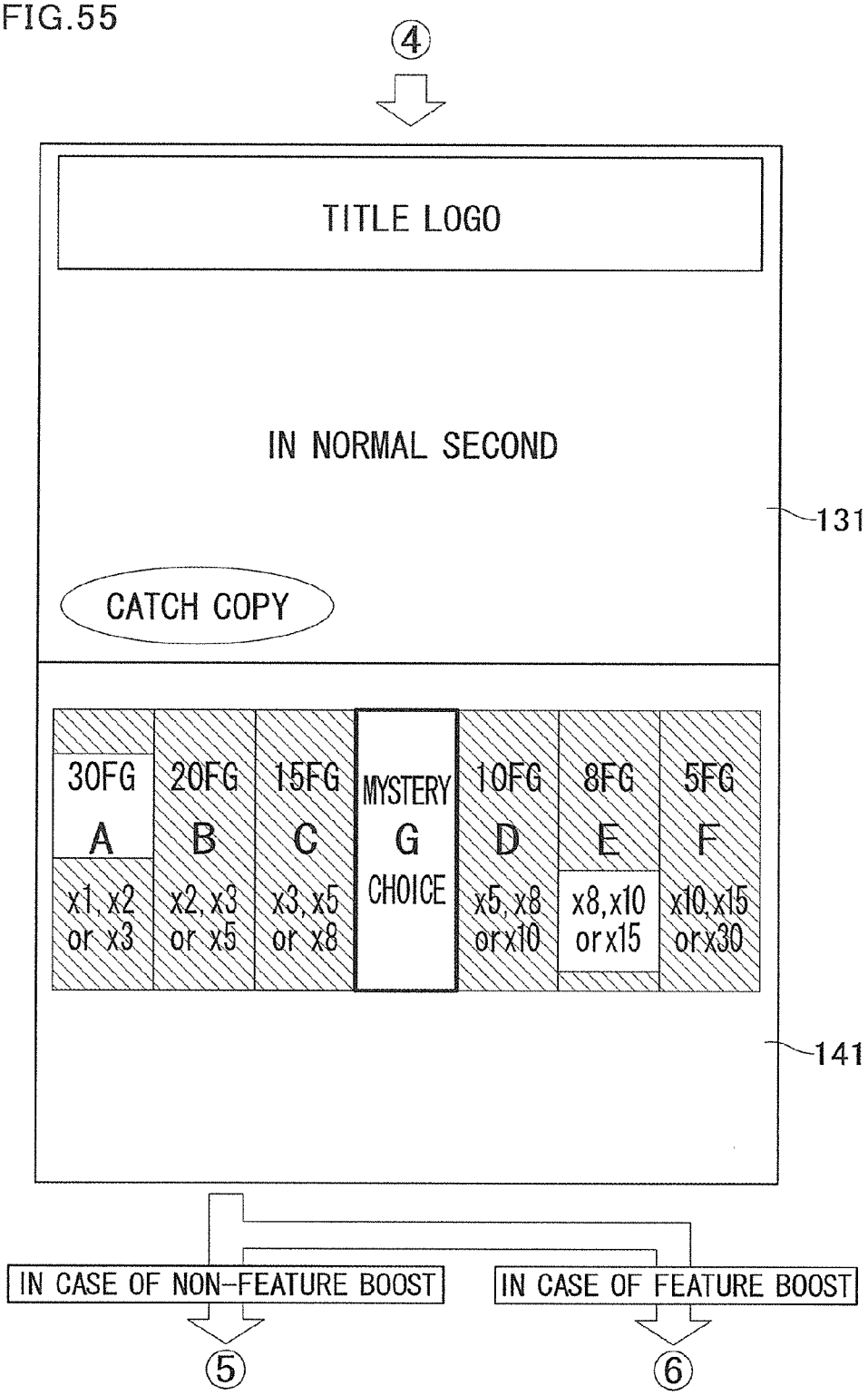
FIG. 55 shows an effect in the free game in the slot machine of the embodiment of the present invention.
Figure 72:
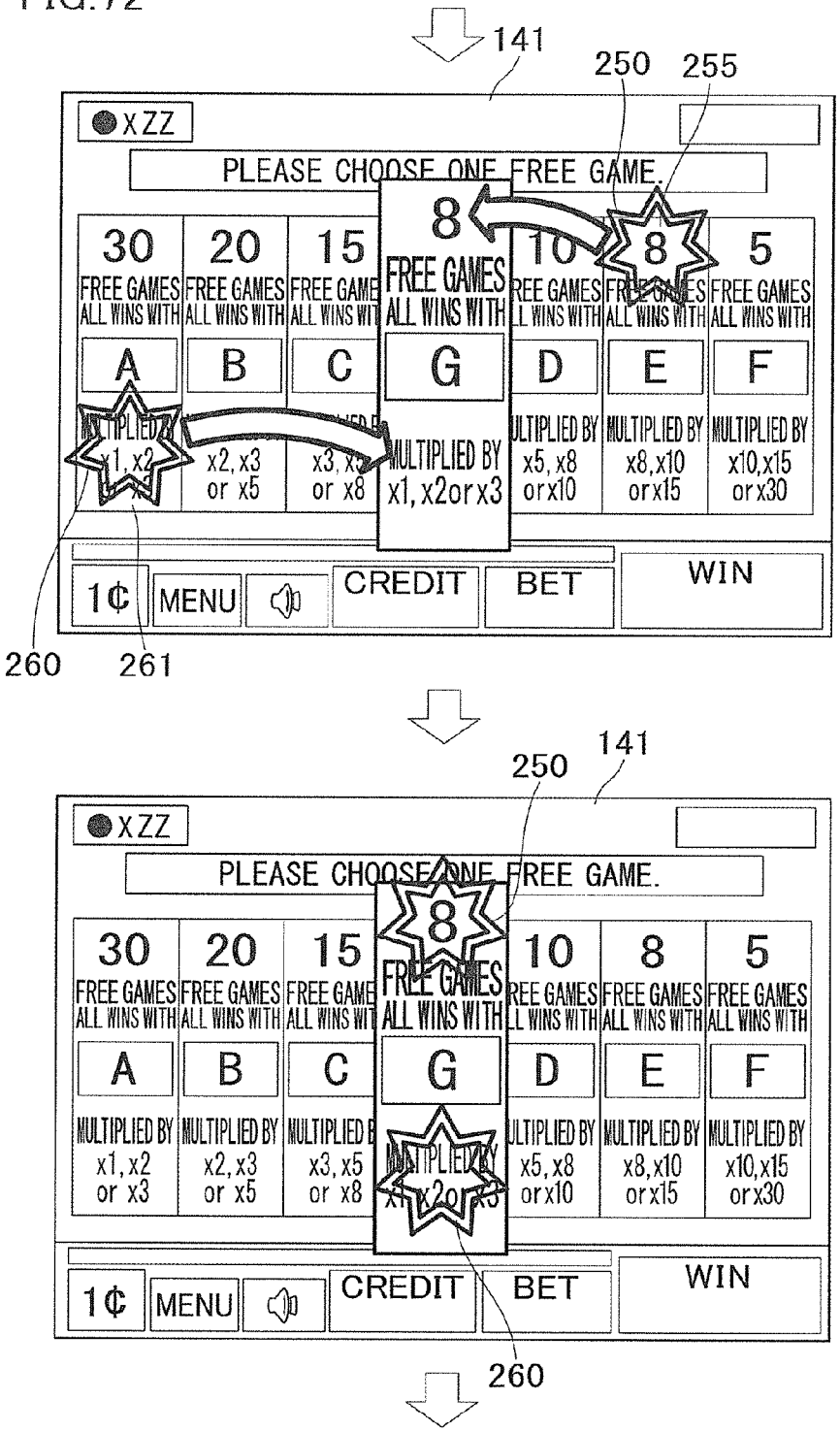
FIG. 72 shows an effect in the mystery random determination process in the slot machine of the embodiment of the present invention.

Thereafter, as shown in FIG. 72 (see FIG. 55), an effect is executed in such a way that the number of times of execution of the free game corresponding to the area where the winning indicator 250 stops moves to a position above the option G and flickers. For example, when the winning indicator 250 stops at the area 255 corresponding to "8 times" which is the number of times of execution of the free game, the "8 times" moves to a position above the option G and flickers. Similarly, as shown in FIG. 72, an effect is executed in such a way that a set of multiplying factors of the payout corresponding to the stopped area moves to a position below the option G and flickers. For example, when the winning indicator 260 stops at the area 261 corresponding to "×1, ×2, ×3" which is the set of the multiplying factors of the payout, the "×1, ×2, ×3" moves to a position below the option G and flickers.

In the mystery random determination effect process, when the option G is selected, the winning indicators 250 and 260 move across the areas 251 to 256 and the areas 261 to 266 and stop like roulette, and the area where the winning indicator stops flickers. As such, the runnable number of times of execution of the free game and the multiplying factor of the payout obtained in the free game are notified. This makes it possible to attract interest in the runnable number of times of execution of the free game and the multiplying factors of the payout obtained in the free game, and avoid monotonousness in the game progress.

After the mystery random determination effect process, the runnable number of times of execution of the free game (number of game play) and the set of the multiplying factors of the payout awarded when a combination of symbols including the WILD symbol is achieved in the free game (WILD multiplying factor) are stored in the RAM 73 (S136).

Subsequently, after S136 or S133, the main CPU 71 determines whether the FEATURE BOOST function is turned on (S137). When the FEATURE BOOST function is turned on (S137: YES), an additional FG number random determination process is executed (S138). In this additional FG number random determination process, the additional number of times of execution of the free game is randomly determined based on the additional FG number random determination table (see FIG. 38) and the selected free game (Free Games A to F). The determined additional number of times of running the free game is added to and stored in the free game play counter (RAM 73).

For example, when the option A (Free Game A) is selected, the additional FG number random determination process is executed by using the random determination table in "Free Game A" in the additional FG number random determination table (see FIG. 38). When the ID "6" is achieved at the random determination probability of 8/100, the free game becomes runnable 40 times and "40" is added to and stored in the free game play counter (RAM 73).

Figure 57:
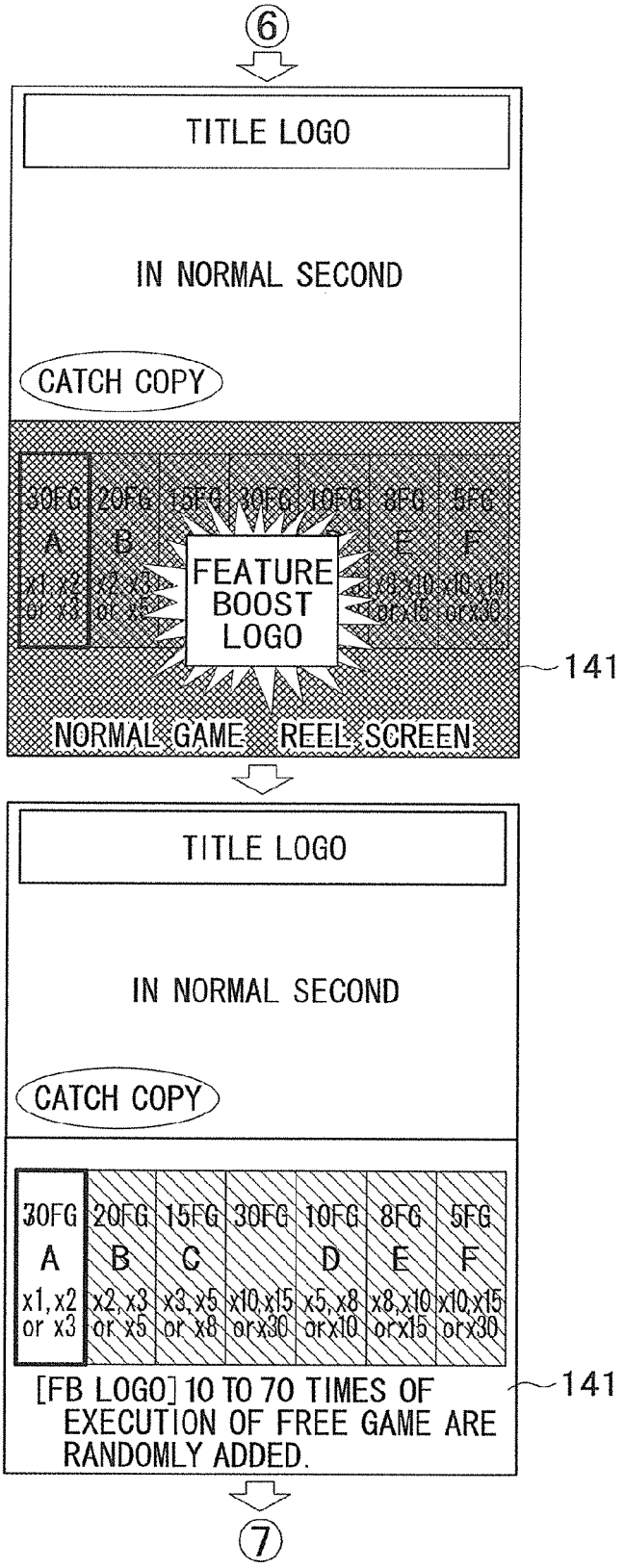
FIG. 57 shows an effect in the free game in the slot machine of the embodiment of the present invention.

When the FEATURE BOOST function is turned on, as shown in FIG. 57, a message logo (FEATURE BOOST logo) is displayed on the lower image display panel 141 to notify that the FEATURE BOOST function has been turned on. Then an effect of adding the determined additional number of times of execution of free game to the selected one of the options A to G is executed as shown in FIG. 57.

Figure 58:
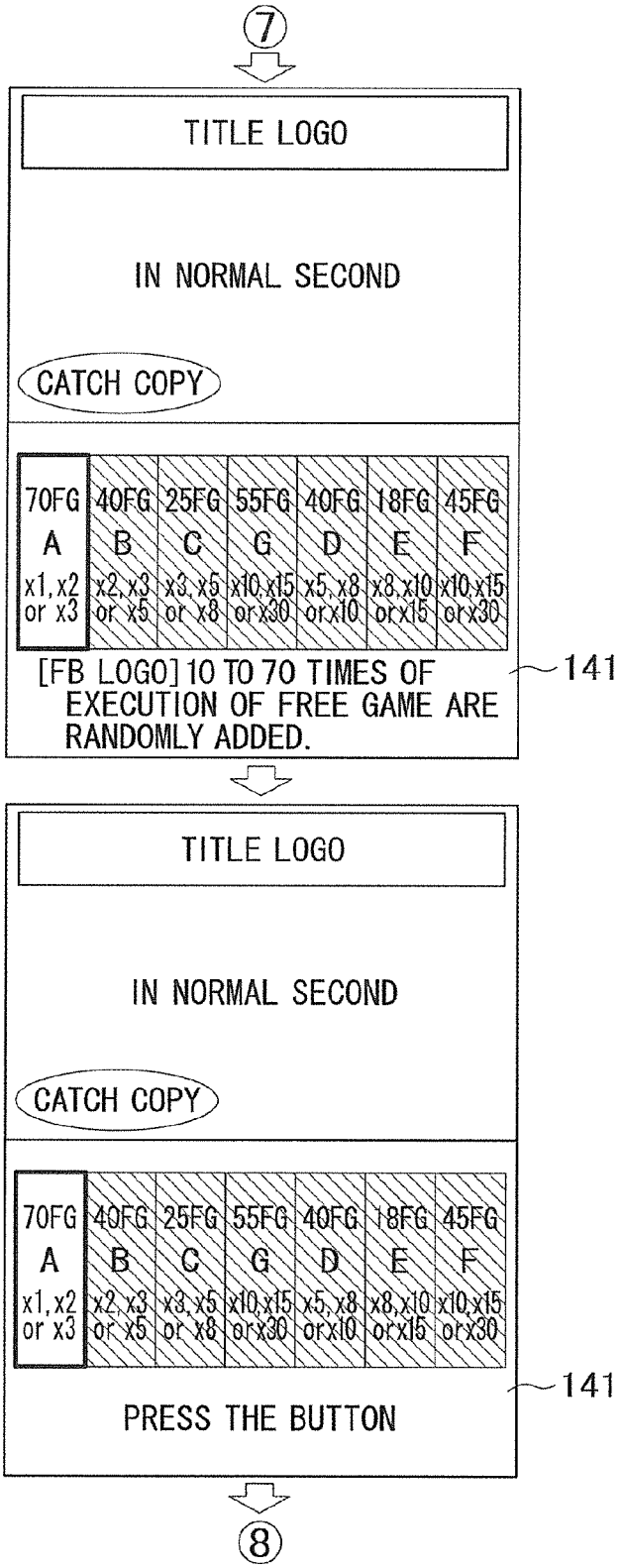
FIG. 58 shows an effect in the free game in the slot machine of the embodiment of the present invention.

Furthermore, as shown in FIG. 58, the number of times of execution of the free games, which would have been awarded when each non-selected one of the options A to G was selected, is displayed on the lower image display panel 141.

The main CPU 71 then executes an additional FG number effect process (S139). In this additional FG number effect process, as shown in FIG. 57, an effect of adding the additional number of times of execution of the free game determined in the additional FG number random determination process to the number of times of execution of the free game displayed on the selected one of the options A to G is performed.

Figure 56:
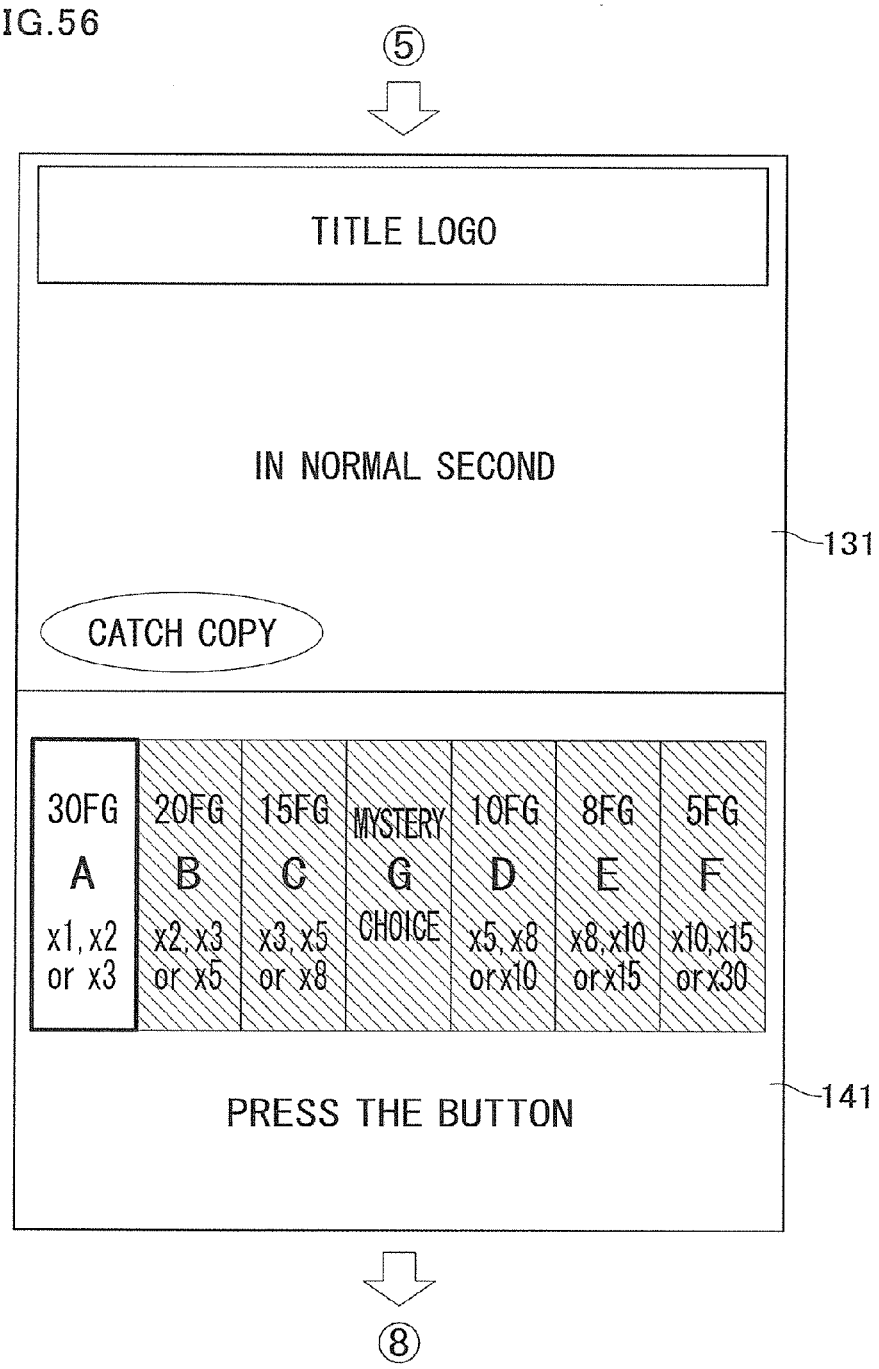
FIG. 56 shows an effect in the free game in the slot machine of the embodiment of the present invention.
Figure 59:
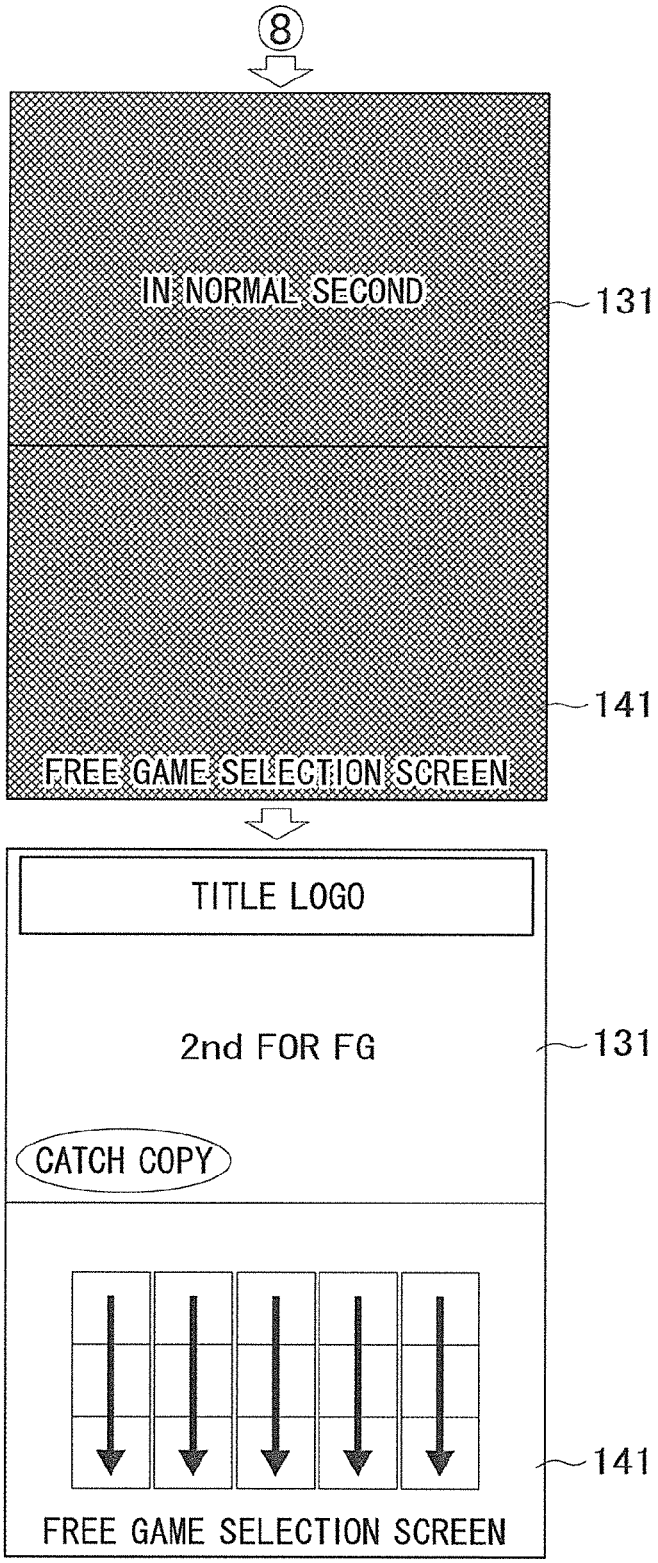
FIG. 59 shows an effect in the free game in the slot machine of the embodiment of the present invention.

After S139 or when it is determined in S137 that the FEATURE BOOST function is not turned on (S137: NO), as shown in FIG. 56 or FIG. 58, a message "PRESS THE BUTTON" is displayed, and the process is terminated when the player operates the spin button 46. When the process is terminated when the player operates the spin button 46, as shown in FIG. 59, dark change is executed on the upper image display panel 131 and the lower image display panel 141 and shifting to the free game screen is performed.

(Denomination Selection Process)

Figure 45:
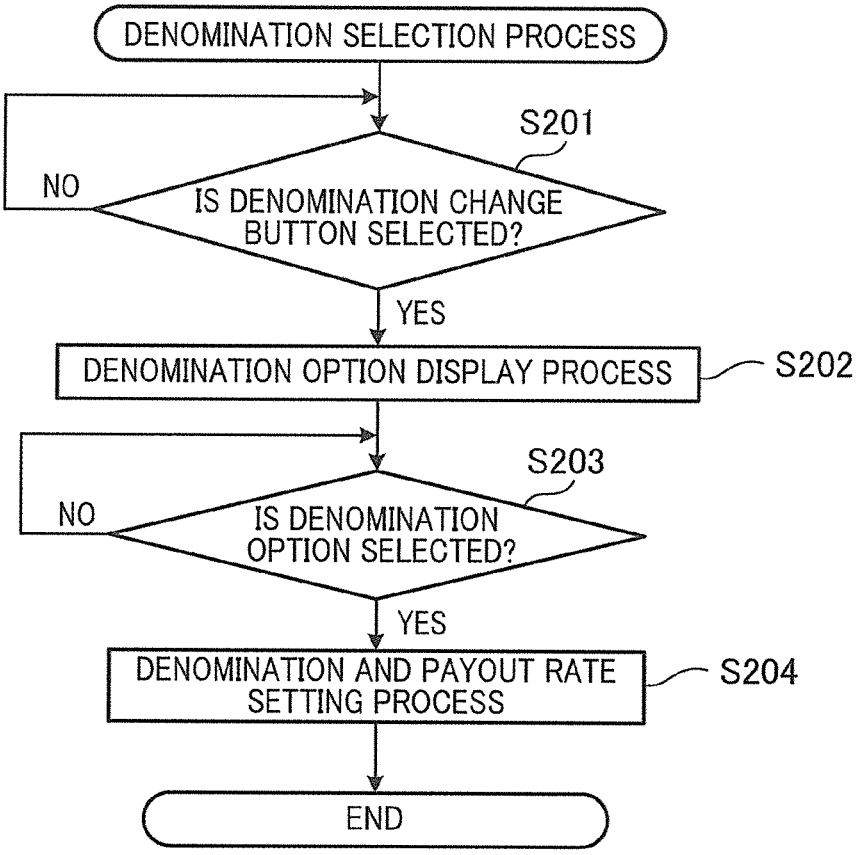
FIG. 45 is a flowchart of a denomination selection process in the slot machine of the embodiment of the present invention.

Now, with reference to FIG. 45, a denomination selection process is described.

Figure 75:
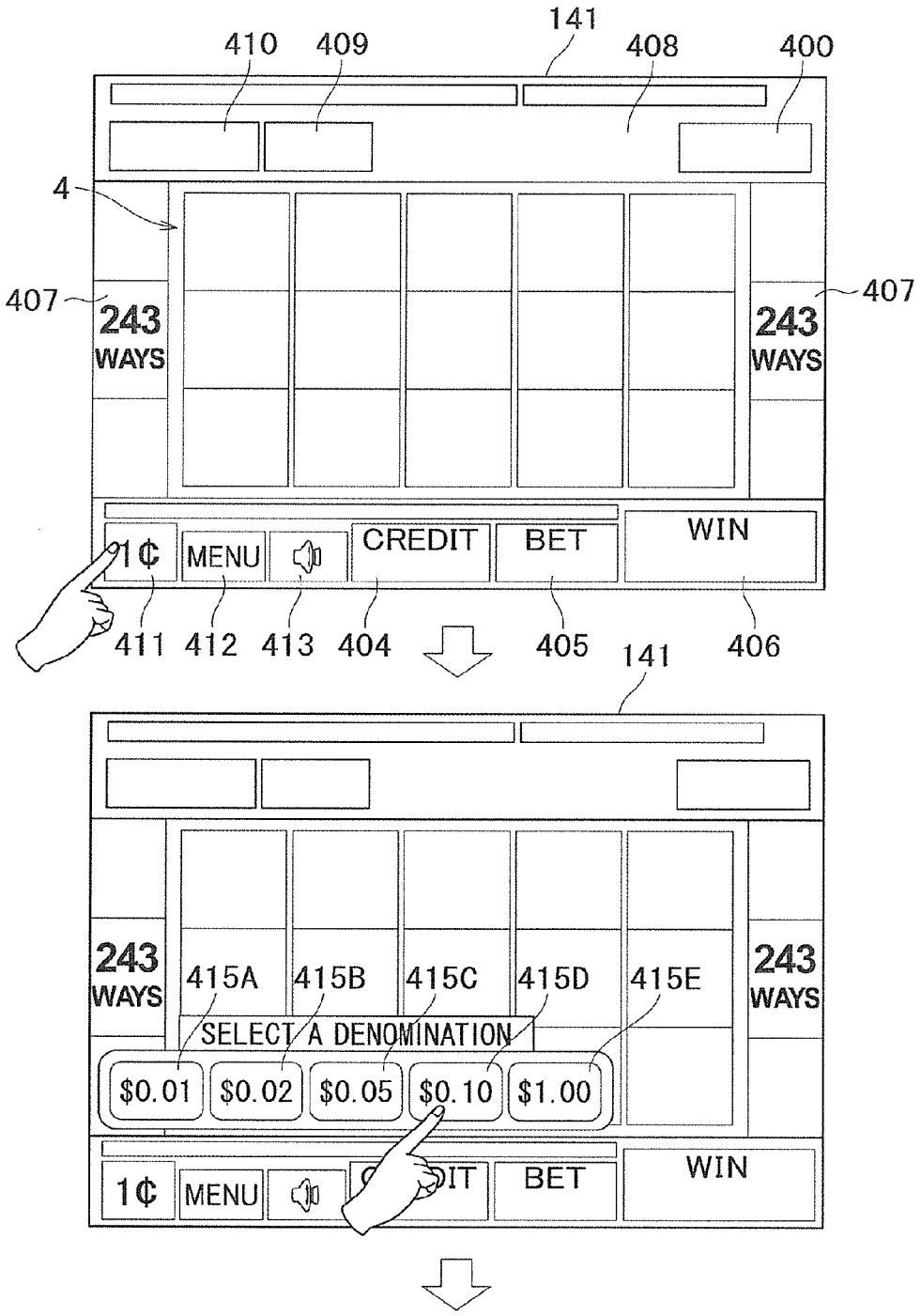
FIG. 75 shows a screen displayed in a denomination selection process related to the embodiment of the present invention.

To begin with, as shown in FIG. 75, the main CPU 71 determines whether a denomination change button 411 is selected on the touch panel 114 of the lower image display panel 141 (S201). If the denomination change button 411 is not selected (S201: NO), selection is waited.

On the other hand, when the denomination change button 411 is selected (S201: YES), a denomination option display process is executed (S202). In this denomination option display process, as shown in FIG. 75, denomination options 415A to 415E corresponding to the denomination values in the payout rate table show in FIG. 39 are displayed above the denomination change button 411 on the lower image display panel 141.

Figure 76:
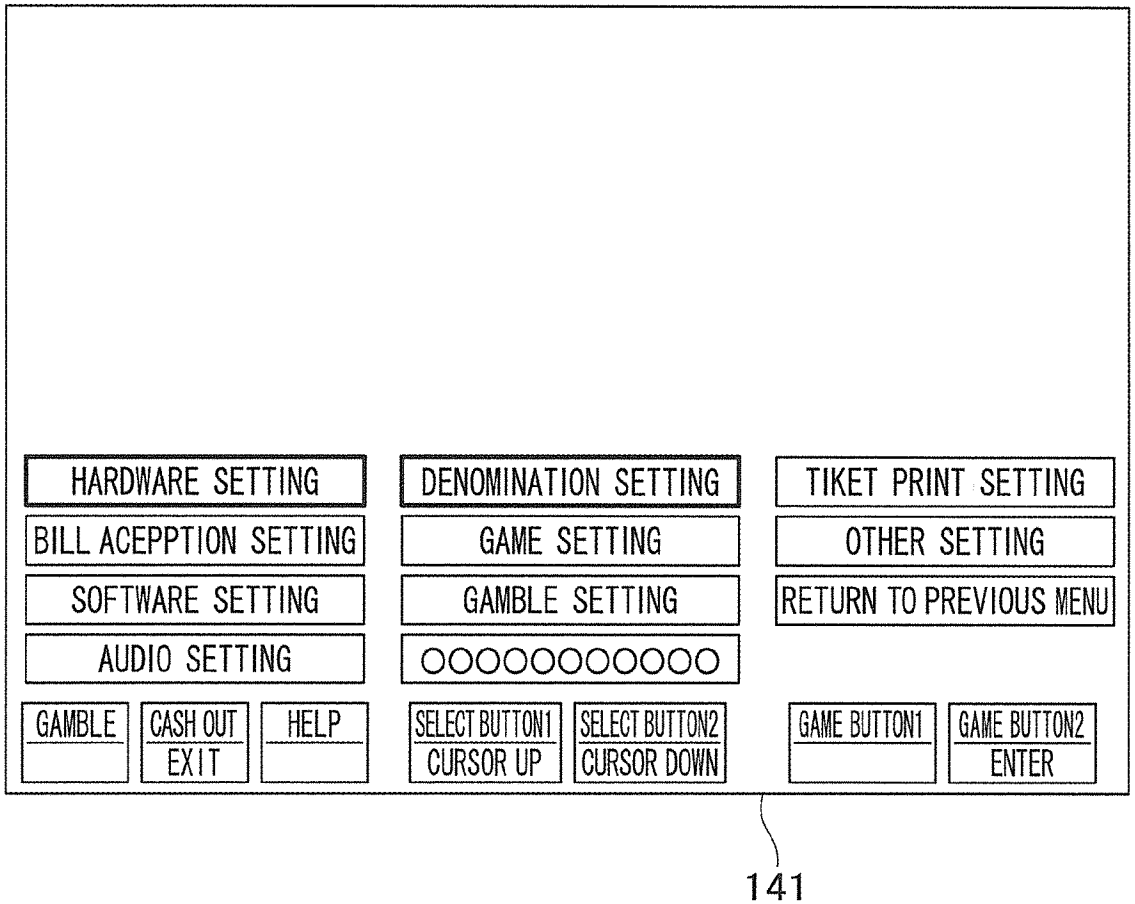
FIG. 76 shows a screen displayed in a denomination selection process related to the embodiment of the present invention.

The number of the denomination options displayed on the lower image display panel 141 and the denomination values corresponding to the denomination options can be optionally set from denomination values in the payout rate table shown in FIG. 39 by calling an administrator setting screen shown in FIG. 76 on the side of the administrator of the slot machine 1 and changing the "DENOMINATION SETTING". As the administrator sets selectable denomination values, the maximum and minimum of the denomination values selectable by the player are set.

In the present embodiment, as shown in FIG. 75, a denomination option 415A corresponding to $0.01, a denomination option 415B corresponding to $0.02, a denomination option 415C corresponding to $0.05, a denomination option 415D corresponding to $0.10, and a denomination option 415E corresponding to $1.00 are displayed.

The main CPU 71 then determines whether one of the denomination options 415A to 415E has been selected (S203). When none of the denomination options 415A to 415E is selected (S203: NO), selection is waited for.

On the other hand, when one of the denomination options 415A to 415E is selected (S203: YES), a denomination and payout rate setting process is executed (S204). In this process, a denomination value and a payout rate corresponding to the selected one of the denomination options 415A to 415E are set with reference to the payout rate table (FIG. 39). For example, when the denomination option 415D is selected, the denomination value is set at $0.10 and the payout rate is set to fall within a range from MIN91.94% to MAX91.07%. When the denomination option 415E is selected, the denomination value is set at $1.00 and the payout rate is set to fall within a range from MIN97.89% to MAX97.97%.

Then, the process is terminated.

According to the denomination selection process above, as the denomination change button 411 is touched, the denomination options 415A to 415E corresponding to denomination values, respectively, are displayed on the lower image display panel 141. It is therefore possible to easily set the denomination value corresponding to the selected one of the denomination options 415A to 415E. This allows the player to easily play a game with a bet based on a denomination value different from the denomination value of the game which is being currently played.

(Screen Display Specification)

Now, the screen display specification of the slot machine 1 will be described with reference to FIG. 46 to FIG. 48.

(Screen Display Specification in Game)

To begin with, screen display specification in the game will be described with reference to FIG. 46.

As shown in FIG. 46, on the upper image display panel 131 during the game, an image area 402 and a payout table area 403 are provided. In the image area 402, a main image of the game, brief explanation on game rules, and the like are displayed. In the payout table area 403, a payout table corresponding to the symbol combination table is displayed.

On the lower image display panel 141 during the game, in addition to the above-described symbol display area 4, a CREDIT meter 404, a BET meter 405, a WIN meter 406, a WAYS BET information area 407, a system message area 408, a stock counter 409, a free game play counter 410, a denomination change button 411, a menu button 412, a sound volume switching touch button 413, and a graph button 400 are provided.

The CREDIT meter 404 displays the remaining credit amount. The default value is 0. In other words, a credit amount stored in the RAM 73 is displayed. The BET meter 405 displays the total bet amount of the current game. The WIN meter 406 displays the total credit amount of WIN and the detail of the WIN. The WAYS BET information area 407 displays WAYS BET information (including whether the FEATURE BOOST function is turned on). Specifically, the area displays which type of the 5 staged WAYS BET (WAYS BET1, WAYS BET2, WAYS BET3, WAYS BET4, and WAYS BET5) is currently selected. The system message area 408 displays a message in accordance with the game progress. The stock counter 409 displays a value of the stock counter. The free game play counter 410 displays a value of the free game play counter. The denomination change button 411 is used for changing the denomination. The menu button 412 is used for calling help of the game or changing the display language. The sound volume switching touch button 413 is used for adjusting the sound volume. When touched by the player, the graph button 400 displays, in the form of graphs, the change of the obtained payout amount, the number of game play in the normal mode executed until the shifting to the high-probability mode, and the total obtained credit amount in the high-probability mode, on the upper image display panel 131. As the graph button 400 is touched, three types of graph images, i.e., line-graph, bar-graph, and block-graph are displayed in order.

(HELP Screen Display Specification)

Figure 47:
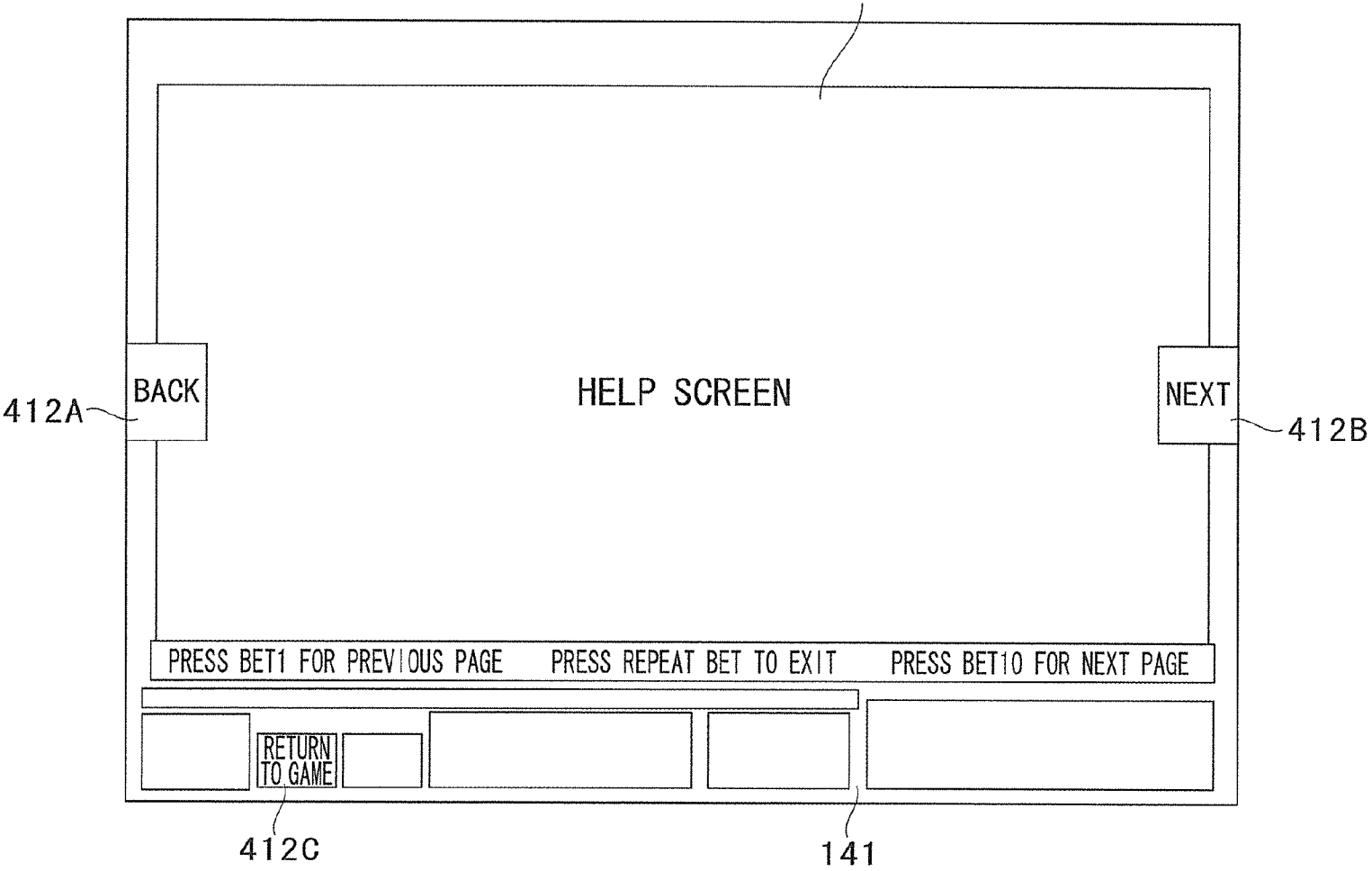
FIG. 47 shows the screen display specification when a HELP operation is performed in the slot machine of the embodiment of the present invention.
Figure 48:
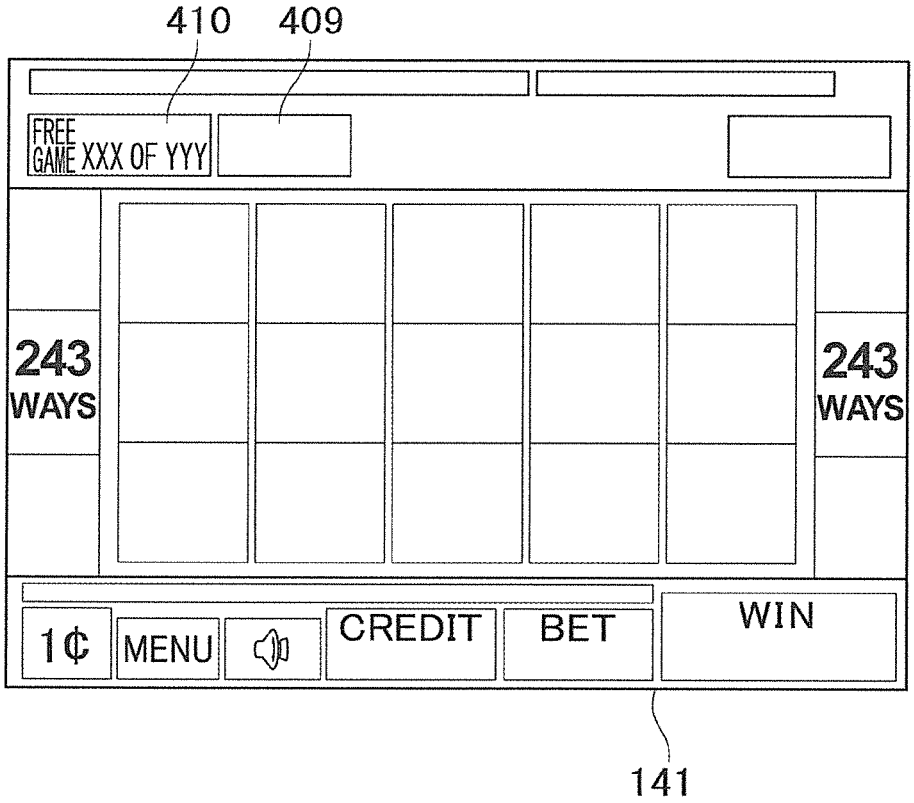
FIG. 48 shows the screen display specification in the free game in the slot machine of the embodiment of the present invention.

Now, the following describes HELP screen display specification, with reference to FIG. 47.

As the HELP button is displayed by touching the menu button 412 and the HELP button is touched, a BACK button 412A, a NEXT button 412B, a RETURN button 413C, and a HELP screen 412D are displayed on the lower image display panel 141 as shown in FIG. 47.

When the player touches the NEXT button 412B, the next page of the game explanation screen is displayed on the HELP screen 412D. When the player touches the BACK button 412A, the previous page of the game explanation screen is displayed on the HELP screen 412D. When the player touches the RETURN button 413C, the HELP screen 412D is closed and the screen during the game returns.

(Screen Display Specification in Free Game)

Now, screen display specification in the free game will be described with reference to FIG. 48.

In the free game, "Number of Currently-Played Free Game OF Awarded Number of Times of Execution of Free Game" is displayed as a value of stock counter on the stock counter 409 on the lower image display panel 141. The free game play counter 410 displays "•×Value of Free Game Play Counter" as a value of the free game play counter.

(Winning Symbol Effect)

Figure 49:
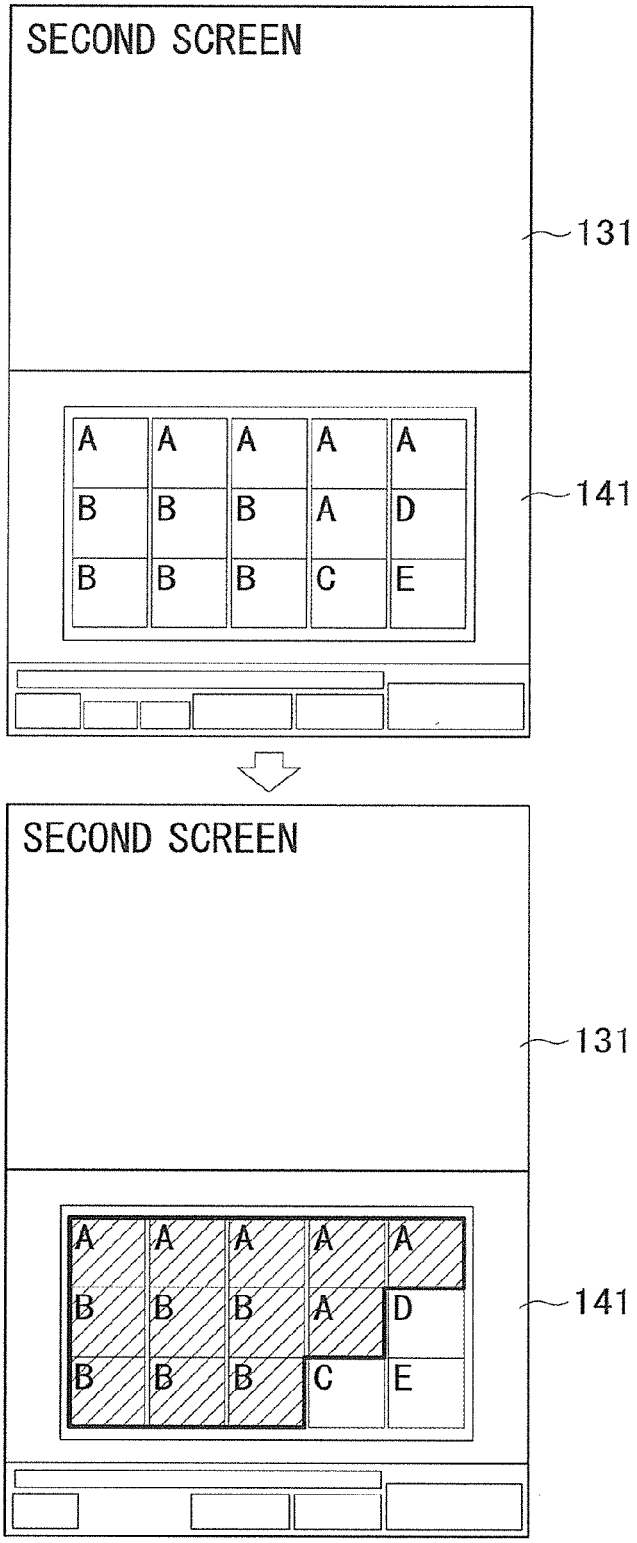
FIG. 49 shows the flow of a WIN effect of the slot machine related to the embodiment of the present invention.

On the lower image display panel 141, a winning symbol effect is executed for a symbol achieving winning in the normal game (in the normal mode or the chance mode) and the free game. In this winning symbol effect, to begin with, as shown in FIG. 49, after the stop of the video reels, a frame for entirety is displayed for all symbols constituting winning. (The frame is displayed for one second with an effect).

Figure 50:
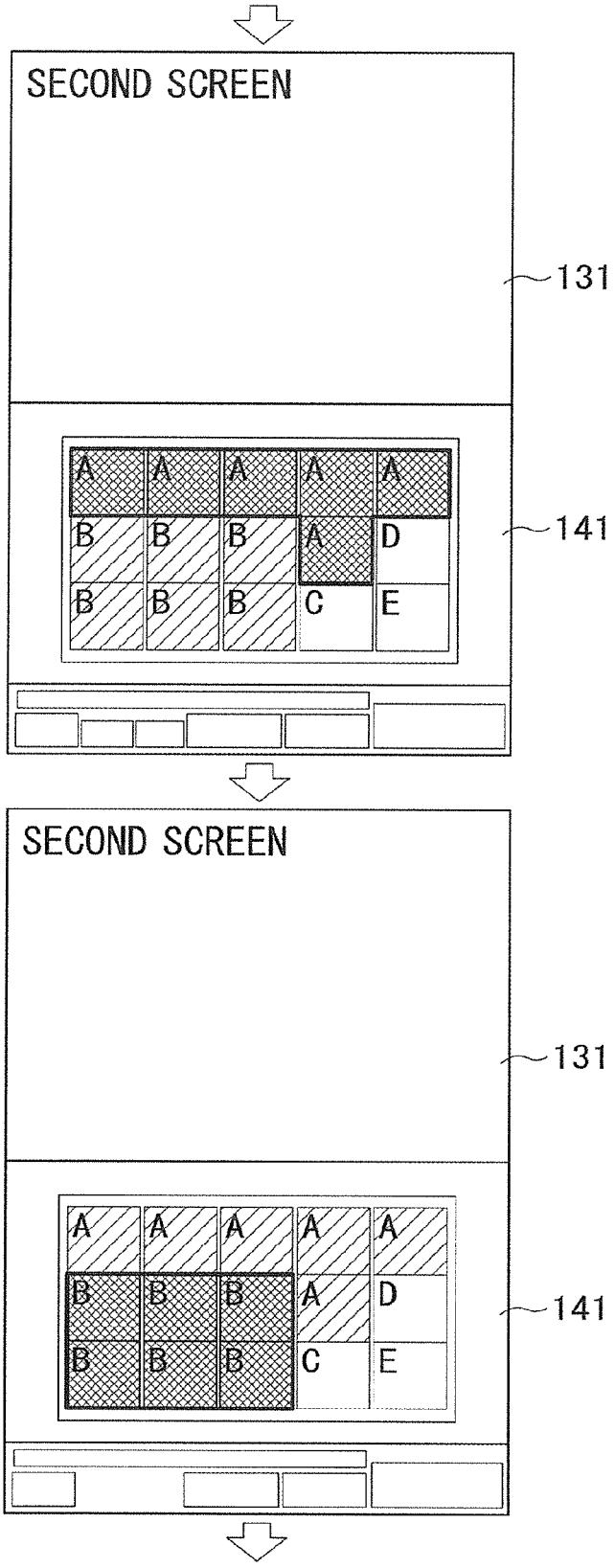
FIG. 50 shows the flow of a WIN effect of the slot machine related to the embodiment of the present invention.

Subsequently, as shown in FIG. 50, frames are serially displayed for symbol combinations each forming a winning. For example, when a winning formed of symbols A is established, a frame is displayed for the combination of the symbols A forming the winning. Subsequently, when a winning formed of symbols B is also established, a frame is displayed for the combination of the symbols B forming the winning. Such an effect is repeatedly displayed until the next game starts.

(Other Notes)

In the reverse appeal rewriting process above, an area of each chance mode video reel, in which area no "FEATURE" symbol is provided, is selected as the starting point of the scroll of the chance mode video reels 3 in the symbol display control process. Alternatively, as shown in FIG. 8 to FIG. 32, chance mode video reels in which the number of the "FEATURE" symbols is large as compared to the normal mode video reels and an area where the symbols identical with those on the normal mode video reels is provided for a predetermined number of symbols may be used. For example, when the chance mode video reels 3 (WAYS BET1: 3WAYS) shown in FIG. 13 to FIG. 16 are used, because the symbols corresponding to the code numbers "0" to "25" of the first reel 3*a* are identical with the symbols corresponding to the code numbers "0" to "25" of the first reel 3*a* of the normal mode video reels 3, the code numbers "23" to "25" are selected as the starting point of the scroll in the symbol display control process as the area where the same symbols as those on the normal mode video reels are provided. That is to say, on the first reel 3*a* of the chance mode video reels, "TEN", "TURTLE", and "JACK" symbols corresponding to the code numbers "23" to "25" are provided in the upper stage, the middle stage, and the lower stage of the first array area of the symbol display area 4. Similarly, because the symbols corresponding to the code numbers "0" to "28" of the second reel 3*b* of the chance mode video reels are identical with the symbols corresponding to the code numbers "0" to "28" of the first reel 3*a* of the normal mode video reels 3, the code numbers "26" to "28" are selected as the starting point of scroll in the symbol display control process, as an area where the same symbols as those on the normal mode video reels are displayed. That is to say, on the second reel 3*b* of the chance mode video reels, "PHOENIX", "TEN", and "FISH" symbols corresponding to the code numbers "26" to "28" are provided in the upper stage, the middle stage, and the lower stage of the second array area of the symbol display area 4.

According to the arrangement above, as the chance mode video reels are scrolled in the symbol display control process in the chance mode, the area in which the same symbols as those on the normal mode video reels are provided is scroll-displayed for a while. As such, the symbols identical with those on the normal mode video reels are scrolled for a while after the start of the scroll of the chance mode video reels, and hence it is possible to prevent the player from knowing that the game is in the chance mode with which the probability of rearrangement of the "FEATURE" symbol is high.

The embodiment above encompasses the following disclosure.

A gaming machine includes: a display device configured to display a game result by rearranging symbols arranged on video reels;

a storage device configured to store a free game number determination table in which runnable numbers of times of execution of the free game are associated with probabilities and a payout rate determination table in which multiplying factors of a payout are associated with probabilities; and a controller programmed to execute the processes of:

(1A) as a normal game, randomly selecting symbols to be rearranged on the display device;

(1B) rearranging the symbols selected in the step (1A) on the display device and awarding a benefit based on a combination of the rearranged symbols;

(1C) when the awarded benefit is the right to execute a free game, randomly determining the runnable number of times of execution of the free game with reference to the free game number determination table;

(1D) when the awarded benefit is the right to execute a free game, determining a multiplying factor of a payout obtained in the free game with reference to the payout rate determination table;

(1E) moving a winning indicator for a predetermined time across areas displayed on the display device and corresponding to respective numbers of times of execution of the free game, stopping the winning indicator at the area corresponding to the number of times of execution of the free game determined in the process (1C), and causing the stopped area to flicker;

(1F) moving a winning indicator for a predetermined time across areas displayed on the display device and corresponding to respective multiplying factors, stopping the winning indicator at the area corresponding to the multiplying factor determined in the process (1D), and causing the stopped area to flicker; and (1G) executing the free game for the number of times determined in the process (1C), multiplying the payout obtained in each play of the free game by the multiplying factor determined in the process (1D), and awarding the multiplied payout.

According to this arrangement, as the winning indicator moves across areas like roulette and the stopped area flickers, the runnable number of times of execution of the free game and the multiplying factor of the payout obtained in the free game are notified. This makes it possible to attract interest in the runnable number of times of execution of the free game and the multiplying factors of the payout obtained in the free game, and avoid monotonousness in the game progress.

The embodiment above encompasses the following disclosure.

A gaming machine includes: a display device configured to display a game result by rearranging symbols arranged on video reels;

a storage unit configured to store payout rate determination tables in which multiplying factors of a payout are associated with probabilities, a selection table in which the payout rate determination tables are associated with the runnable numbers of times of execution of the free game, and a free game number-multiplying factor determination table in which the runnable numbers of times of execution of the free game, the payout rate determination tables, and probabilities are associated; and a controller programmed to execute the processes of:

(2A) as the normal game, randomly selecting symbols to be rearranged on the display device;

(2B) rearranging the symbols selected in the step (2A) on the display device and awarding a benefit based on a combination of the rearranged symbols;

(2C) when the awarded benefit is the right to execute a free game, displaying options corresponding to the numbers of times of execution of the free game in the selection table and an option corresponding to the free game number-multiplying factor determination table;

(2D) when the option corresponding to the free game number-multiplying factor determination table is selected, randomly determining the runnable number of times of execution of the free game and a payout rate determination table used in the free game, based on the free game number-multiplying factor determination table.

(2E) moving a winning indicator for a predetermined time across areas displayed on the display device and corresponding to respective numbers of times of execution of the free game, stopping the winning indicator at the area corresponding to the number of times of execution of the free game determined in the process (2D), and causing the stopped area to flicker;

(2F) moving a winning indicator for a predetermined time across areas displayed on the display device and corresponding to the respective payout rate determination tables, stopping the winning indicator at the area corresponding to the payout rate determination table selected in the process (2D), and causing the stopped area to flicker; and (2G) executing the free game for the number of times determined in the process (2D), randomly determining a multiplying factor of the payout with reference to the payout rate determination table selected in the process (2D), multiplying the payout obtained in each play of the free game by the determined multiplying factor, and awarding the multiplied payout.

According to the arrangement above, when the option corresponding to the free game number-multiplying factor determination table by which the number of times of execution of the free game and the payout rate determination table used in the free game are randomly determined is selected, a winning indicator is moved across areas and stops like roulette and the stopped area is caused to flicker. With this, the runnable number of times of execution of the free game and the payout rate determination table used in the free game are notified. This makes it possible to attract interest in the runnable number of times of execution of the free game and the payout rate determination table used in the free game, and avoid monotonousness in the game progress.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

Further, the detailed description above is mainly focused on characteristics of the present invention to for the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A gaming machine comprising:

a display device configured to display a game result by rearranging symbols arranged on video reels;

a storage device configured to store a normal mode video reel on which the symbols including a predetermined symbol are arranged and a chance mode video reel on which a first number of the predetermined symbol is larger than a second number of the predetermined symbol on the normal mode video reel; and a controller configured to perform switching between a normal game in a normal mode using the normal mode video reel and a chance game in a chance mode using the chance mode video reel, when a predetermined condition is satisfied, wherein the predetermined condition is a case where a combination of rearranged symbols which are rearranged on the display device is a predetermined combination, wherein the controller randomly determines whether to execute the switching between the normal game in the normal mode and the chance game in the chance mode when the combination of the rearranged symbols is the predetermined combination, wherein there are plural predetermined combinations of symbols, wherein the storage device is configured to store a switching random determination table in which probabilities of execution of the switching between the normal game in the normal mode and the chance game in the chance mode are associated with the plural predetermined combinations, respectively, the probabilities being different from each other, wherein when the combination of the rearranged symbols is the predetermined combination of the rearranged symbols, the controller determines whether to execute the switching between the normal game in the normal mode and the chance game in the chance mode based on random determination with reference to the switching random determination table, and wherein, the plural predetermined combinations include a first predetermined combination and a second predetermined combination, a probability with which the combination of the rearranged symbols is the first predetermined combination being lower than a probability with which the combination of the rearranged symbols is the second predetermined combination, and in the switching random determination table, a probability of execution of the switching between the normal game in the normal mode and the chance game in the chance mode when the combination of the rearranged symbols is the first predetermined combination is higher than a probability of execution of the switching between the normal game in the normal mode and the chance game in the chance mode when the combination of the rearranged symbols is the second predetermined combination.

2. The gaming machine according to claim 1, wherein, in the chance game in the chance mode, the controller is configured to display the chance mode video reel on the display device so that a part of the predetermined symbol overlaps a symbol adjacent to the predetermined symbol.

3. The gaming machine according to claim 1, wherein, the display device is provided with a frame which is capable of encompassing a predetermined number of symbols successively arranged in an up-down direction on a video reel, and in the chance game in the chance mode, the controller is configured to display the chance mode video reel on the display device so that a part of the predetermined symbol overlaps background of each of symbols immediately above and below the predetermined symbol.

4. The gaming machine according to claim 3, wherein, when the predetermined symbol is rearranged inside the frame of the display device, the controller is configured to display another part of the predetermined symbol to overlap a front surface of the frame of the display device.

* * * * *